US007150513B2

(12) United States Patent
Shinkawa et al.

(10) Patent No.: US 7,150,513 B2
(45) Date of Patent: Dec. 19, 2006

(54) DROPLET EJECTION APPARATUS AND EJECTION FAILURE RECOVERY METHOD

(75) Inventors: Osamu Shinkawa, Chino (JP); Yusuke Sakagami, Shiojiri (JP)

(73) Assignee: Seiko Epson Corporation (JP)

( * ) Notice: Subject to any disclaimer, the term of this patent is extended or adjusted under 35 U.S.C. 154(b) by 380 days.

(21) Appl. No.: 10/789,819

(22) Filed: Feb. 27, 2004

(65) Prior Publication Data

US 2004/0223027 A1 Nov. 11, 2004

(30) Foreign Application Priority Data

Feb. 28, 2003 (JP) ..... 2003-055021
Mar. 18, 2003 (JP) ..... 2003-074628

(51) Int. Cl.
*B41J 2/165* (2006.01)
*B41J 29/393* (2006.01)
*B41J 2/19* (2006.01)

(52) U.S. Cl. ..... 347/23; 347/19; 347/92

(58) Field of Classification Search ..... 347/14, 347/19, 10, 11, 22–35, 68, 92
See application file for complete search history.

(56) References Cited

U.S. PATENT DOCUMENTS

| | | | | |
|---|---|---|---|---|
| 4,034,380 | A | 7/1977 | Isayama | |
| 4,695,852 | A * | 9/1987 | Scardovi | 347/14 |
| 5,500,657 | A | 3/1996 | Yauchi et al. | |
| 5,563,634 | A | 10/1996 | Fujii et al. | |
| 5,818,473 | A | 10/1998 | Fujii et al. | |
| 6,220,692 | B1 | 4/2001 | Iwaya et al. | |
| 6,375,299 | B1 | 4/2002 | Foster et al. | |
| 6,565,185 | B1 * | 5/2003 | Endo | 347/23 |
| 2002/0089562 | A1 | 7/2002 | Simons et al. | |

FOREIGN PATENT DOCUMENTS

| | | | |
|---|---|---|---|
| CN | 1103029 | | 5/1995 |
| CN | 1241490 | | 1/2000 |
| EP | 0 933 215 | A2 | 2/1999 |
| EP | 1 147 900 | A1 | 4/2000 |
| EP | 1 211 078 | A1 | 7/2001 |
| JP | 63-141750 | * | 6/1988 |
| JP | 02-003323 | | 1/1990 |
| JP | 08-309963 | | 11/1996 |
| JP | 2000-272116 | | 10/2000 |

(Continued)

OTHER PUBLICATIONS

Communication from European Patent Office re: counterpart application.

(Continued)

*Primary Examiner*—Shih-Wen Hsieh
(74) *Attorney, Agent, or Firm*—Harness, Dickey & Pierce, P.L.C.

(57) ABSTRACT

A droplet ejection apparatus is provided having a plurality of droplet ejection heads each ejecting liquid within a cavity through a nozzle in the form of droplets by driving an actuator with a driving circuit. The apparatus includes: ejection failure detecting means for detecting an ejection failure of the droplet ejection heads and a cause thereof; and recovery means for performing a recovery process depending on the cause of the ejection failure if the ejection failure detecting means detects the ejection failure when the droplets are ejected through the nozzles. Also, if a failing nozzle is detected, a recovery process is performed depending on the cause of the ejection failure at least for the failing nozzle. Thereafter, detection by the ejection failure detecting means is repeated by forcing the failing nozzle to perform a droplet ejection operation alone.

70 Claims, 48 Drawing Sheets

FOREIGN PATENT DOCUMENTS

JP 2002-187263 7/2002

OTHER PUBLICATIONS

Communication from JPO re: related PCT application No. PCT/JP2004/002401.
Communication from JPO re: related PCT application No. PCT/JP2004/002403.
Communication from JPO re: related PCT application No. PCT/JP2004/002437.
Communication from JPO re: related PCT application No. PCT/JP2004/002405.
Communication from JPO re: related PCT application No. PCT/JP2004/002400.
Communication from JPO re: related PCT application No. PCT/JP2004/002443.
Communication from JPO re: related PCT application No. PCT/JP2004/002390.
Communication from JPO re: related PCT application No. PCT/JP2004/002414.
Communication from China Patent Office regarding counterpart application.

* cited by examiner

AFTER ADHESION OF PAPER DUST

BEFORE ADHESION OF PAPER DUST

DROPLET EJECTION APPARATUS AND EJECTION FAILURE RECOVERY METHOD

RELATED APPLICATIONS

This application claims priority to Japanese Patent Application Nos. 2003-055021 filed Feb. 28, 2003 and 2003-074628 filed Mar. 18, 2003 which are hereby expressly incorporated by reference herein in their entireties.

BACKGROUND

1. Technical Field

The present invention relates to a droplet ejection apparatus and an ejection failure recovery method.

2. Background Art

An ink jet printer, which is one type of a droplet ejection apparatus, forms an image on a predetermined sheet of paper by ejecting ink drops (droplets) through a plurality of nozzles. A printing head (ink jet head) of the ink jet printer is provided with a number of nozzles. However, at times, some of the nozzles are blocked due to an increase of ink viscosity, intrusion of air bubbles, adhesion of dust or paper dust, etc., and become unable to eject ink drops. When the nozzles are blocked, a missing dot occurs within a printed image, which results in deterioration of image quality.

Conventionally, as a method of detecting such an ejection failure of ink drops (hereinafter, also referred to as the missing dot), JP-A-8-309963 has disclosed a method of optically detecting when no ink drops are ejected through the nozzles of the ink jet head (ink drop ejection failing state) for each nozzle of the ink jet head. This method makes it possible to identify a nozzle causing the missing dot (ejection failure).

According to the optical missing dot (droplet ejection failure) detecting method described above, however, a detector including a light source and an optical sensor is attached to a droplet ejection apparatus (for example, an ink jet printer). Hence, this detecting method generally has a problem that the light source and the optical sensor have to be set (provided) with exact accuracy (high degree of accuracy), so that droplets ejected through the nozzles of the droplet ejection head (ink jet head) pass through a space between the light source and the optical sensor and intercept light between the light source and the optical sensor. In addition, such a detector is generally expensive, which poses another problem in that the manufacturing costs of the ink jet printer are increased. Further, the output portion of the light source or the detection portion of the optical sensor may be smeared by ink mist through the nozzles or paper dust from printing sheets or the like, and the reliability of the detector may become a matter of concern.

Also, according to the optical missing dot detecting method described above, the missing dot, that is, an ejection failure (non-ejection) of ink drops of the nozzles can be detected; however, the cause of the missing dot (ejection failure) cannot be identified (judged) on the basis of the detection result. Hence, there is still another problem in that it is impossible to select and perform adequate recovery processing depending on the cause of the missing dot. For this reason, sequential recovery processing is performed independently of the cause of the missing dot in the conventional missing dot detecting method. For example, ink may be pump-sucked (vacuumed) from the ink jet head under circumstances where a wiping process is sufficient for recovery. This increases discharged ink (wasted ink), or causes recovery processing of several types to be performed because adequate recovery processing is not performed, and thereby reduces or deteriorates throughput of the ink jet printer (droplet ejection apparatus).

Incidentally, the droplet ejection apparatus (ink jet head) generally includes a plurality of nozzles and actuators corresponding to the respective nozzles, and it is difficult for such a droplet ejection apparatus having a plurality of nozzles to detect an ejection failure (non-ejection) of droplets (ink drops), that is, the missing dot during a printing (recording) operation, without reducing or deteriorating the throughput of the apparatus.

SUMMARY

One object of the invention is to provide a droplet ejection apparatus and an ejection failure recovery method, by which, in the presence of an ejection failure of a droplet ejection head, the cause of the ejection failure is identified, so that adequate recovery processing can be performed depending on the cause of the ejection failure instead of conventional sequential recovery processing.

In order to achieve the above object, a first aspect of the invention provides a droplet ejection apparatus having a head unit including a plurality of droplet ejection heads each ejecting liquid within a cavity through a nozzle in the form of droplets by driving an actuator with a driving circuit, and the droplet ejection apparatus of the invention is characterized by including:

ejection failure detecting means for detecting an ejection failure of the droplet ejection heads and a cause thereof; and recovery means for performing recovery processing depending on the cause of the ejection failure if the ejection failure detecting means detects the ejection failure when the droplets are ejected through the nozzles.

According to the droplet ejection apparatus of the invention, an ejection failure of the droplet ejection heads and the cause thereof are detected, and adequate recovery processing is performed depending on the detected cause. Hence, in contrast to the sequential recovery processing by the conventional droplet ejection apparatus, it is possible to prevent a reduction or deterioration of the throughput of the droplet ejection apparatus by reducing wastefully discharged ink during the recovery process.

It is preferable that the recovery means includes: wiping means for performing, with the use of a wiper, a wiping process on the nozzle surfaces of the droplet ejection heads where the nozzles are aligned; flushing means for performing a flushing process by which the droplets are preliminarily ejected through the nozzles by driving the actuators; and pumping means for performing a pump-suction process with the use of a pump connected to a cap covering the nozzle surfaces of the droplet ejection heads.

Also, it is preferable that the cause of an ejection failure detectable by the ejection failure detecting means includes intrusion of an air bubble inside the cavity, thickening of the liquid caused by drying in a vicinity of the nozzle, and adhesion of dust, e.g., paper dust, in a vicinity of an outlet of the nozzle; and the recovery means performs the pump-suction process by the pumping means in the case of the intrusion of an air bubble, the flushing process by the flushing means or the pump-suction process by the pumping means in the case of thickening caused by drying, and at least the wiping process by the wiper in the case of the adhesion of paper dust. In the invention, "paper dust" is not limited to mere paper dust generated from a recording sheet or the like, but includes all substances that could adhere in the vicinity of the nozzles and impede ejection of droplets, such as pieces of rubber from the advancing roller (feeding roller) and dust afloat in air. In this case, it is preferable that, when the ejection failure detecting means detects the intrusion of an air bubble and the thickening caused by drying that need the pump-suction process for more than one droplet ejection head of the head unit, the recovery means performs the pump-suction process at a time for the droplet ejection heads with which the intrusion of an air bubble and the thickening caused by drying are detected.

The droplet ejection apparatus of the invention may be configured in such a manner that:

each of the droplet ejection heads includes a diaphragm that is displaced when the actuator is driven; and the ejection failure detecting means detects residual vibration of the diaphragm and detects an ejection failure of the droplets on the basis of a vibration pattern of the detected residual vibration of the diaphragm. In this case, it is preferable that the ejection failure detecting means includes judging means for judging the presence or absence of an ejection failure of the droplets in the droplet ejection head on the basis of the vibration pattern of the residual vibration of the diaphragm, and judging the cause of the ejection failure upon judging the presence of the ejection failure of the droplets in the droplet ejection head. The residual vibration of the diaphragm referred to herein means a state that the diaphragm keeps vibrating while damping by the droplet ejection operation after the actuator performed the droplet ejection operation according to a driving signal (voltage signal) from the driving circuit until the actuator performs the droplet ejection operation again upon input of the following driving signal.

Also, the vibration pattern of the residual vibration of the diaphragm may preferably include a cycle of the residual vibration. In this case, it is preferable that the judging means judges that an air bubble has intruded inside the cavity when the cycle of the residual vibration of the diaphragm is shorter than a cycle of a predetermined range, the liquid has thickened by drying in the vicinity of the nozzle when the cycle of the residual vibration of the diaphragm is longer than a predetermined threshold, and paper dust is adhering in the vicinity of the outlet of the nozzle when the cycle of the residual vibration of the diaphragm is longer than the cycle of the predetermined range and shorter than the predetermined threshold. It is thus possible to judge the cause of an ejection failure of droplets, which cannot be judged by the conventional droplet ejection apparatus capable of performing missing dot detection, such as an optical detection device. This enables adequate recovery processing depending on the cause of an ejection failure as described above to be selected and performed as needed.

According to one embodiment of the invention, the apparatus may be configured in such a manner that the ejection failure detecting means includes an oscillation circuit, and the oscillation circuit oscillates on the basis of an electric capacitance component of the actuator that varies with the residual vibration of the diaphragm. In this case, it is preferable that the oscillation circuit forms a CR oscillation circuit from the electric capacitance component of the actuator and a resistance component of a resistor element connected to the actuator. Because the droplet ejection apparatus of the invention detects the residual vibration waveform (voltage waveform of the residual vibration) of the diaphragm as a minute change (change of the oscillation cycle) with time of the electric capacitance component of the actuator, the residual vibration waveform of the diaphragm can be detected with accuracy independently of the magnitude of an electromotive voltage when a piezoelectric element is used as the actuator.

It is preferable that the oscillation frequency of the oscillation circuit is about one or more orders of magnitude higher than the vibration frequency of the residual vibration of the diaphragm. By setting the oscillation frequency of the oscillation circuit several tens times higher than the vibration frequency of the residual vibration of the diaphragm in this manner, the residual vibration of the diaphragm can be detected accurately, which in turn enables an ejection failure of the droplets to be detected accurately.

Also, it is preferable that the ejection failure detecting means includes an F/V converting circuit that generates a voltage waveform of the residual vibration of the diaphragm from a predetermined signal group generated on the basis of a change of an oscillation frequency in an output signal from the oscillation circuit. By generating the voltage waveform with the use of the F/V converting circuit in this manner, the detection sensitivity can be set to a larger magnitude when the residual vibration waveform is detected, without affecting the driving of the actuator. In addition, the ejection failure detecting means may preferably include a waveform shaping circuit that shapes the voltage waveform of the residual vibration of the diaphragm generated in the F/V converting circuit into a predetermined waveform.

Herein, it is preferable to configure the apparatus in such a manner so that the waveform shaping circuit includes: DC component removing means for removing a direct current component from the voltage waveform of the residual vibration of the diaphragm generated in the F/V converting circuit; and a comparator that compares the voltage waveform, from which the direct current component has been removed by the DC component removing means, with a predetermined voltage value, so that the comparator generates and outputs a rectangular wave on the basis of the voltage comparison. In this case, it is more preferable that the ejection failure detecting means includes measuring means for measuring a cycle of the residual vibration of the diaphragm from the rectangular wave generated in the waveform shaping circuit. It is further preferable that the measuring means has a counter, so that it measures a time between rising edges or between a rising edge and a falling edge of the rectangular wave by counting pulses of a reference signal with the counter, allowing measurement of a cycle of the residual vibration. By measuring the cycle of the rectangular wave with the use of the counter in this manner, it is possible to detect the cycle of the residual vibration of the diaphragm accurately in a simple manner.

Also, it is preferable that the droplet ejection apparatus of the invention further includes switching means for switching a connection of the actuator from the driving circuit to the ejection failure detecting means after an ejection operation of the droplets is performed by driving the actuator. It is preferable to configure the droplet ejection apparatus of the invention to include more than one ejection failure detecting means and more than one switching means, so that switching means corresponding to a droplet ejection head that has performed the droplet ejection operation switches the connection of the actuator from the driving circuit to corresponding ejection failure detecting means, and the switched ejection failure detecting means detects an ejection failure of the droplets. Instead of the foregoing configuration, the switching means may preferably include more than one unit switching means corresponding to the droplet ejection heads, respectively. Also, in the droplet ejection apparatus of the invention, the ejection failure detecting means may further include detection determining means for determining for which nozzle among the nozzles detection of an ejection failure of the droplets is to be performed. In this case, the switching means may switch the connection of the actuator from the driving circuit to the ejection failure detecting means after the ejection operation of the droplets is performed by driving the actuator corresponding to the nozzle of the droplet ejection head determined by the detection determining means.

According to one embodiment of the invention, the apparatus may be configured in such a manner that the ejection failure detecting means detects an ejection failure of the droplets at timing of the droplet ejection operation during the flushing process or the droplet ejection operation during a print operation by the nozzle as a target of detection. Because the droplet ejection apparatus of the invention is able to detect an ejection failure of the droplets even during a printing (recording) operation, that is, during the droplet ejection operation in the middle of the print operation, the throughput of the droplet ejection apparatus will be neither reduced nor deteriorated.

Also, the actuator may be an electrostatic actuator, or a piezoelectric actuator using a piezoelectric effect of a piezoelectric element. In addition, it may be preferable that the droplet ejection apparatus of the invention further includes storage means for storing the cause of an ejection failure of the droplets detected by the ejection failure detecting means, in connection with the nozzle as the target of detection.

Another object of the invention is to provide a droplet ejection apparatus capable of identifying the cause of an ejection failure when the ejection failure of a droplet ejection head is detected and performing adequate recovery processing depending on the cause of the ejection failure instead of the conventional sequential recovery processing, as well as efficiently confirming whether the droplet ejection head has been restored to a normal state by the recovery processing.

In order to achieve the above object, another aspect of the invention provides a droplet ejection apparatus, provided with a plurality of droplet ejection heads each ejecting liquid through a nozzle communicating with a cavity in the form of droplets by changing an internal pressure of the cavity filled with the liquid by driving an actuator with a driving circuit, for ejecting the droplets through the nozzles while scanning the droplet ejection heads relatively with respect to a droplet receptor so that the droplets land on the droplet receptor, and the droplet ejection apparatus of the invention is characterized by including:

ejection failure detecting means for detecting an ejection failure of the droplets through the nozzles and a cause thereof;

recovery means for performing recovery processing for the droplet ejection heads to eliminate the cause of the ejection failure of the droplets; and storage means for storing a nozzle with which the ejection failure is detected by the ejection failure detecting means, in connection with the cause thereof, wherein if detection by the ejection failure detecting means is performed for all of the nozzles and the presence of a failing nozzle in which an ejection failure is occurring is detected, recovery processing depending on the cause of the ejection failure is performed by the recovery means at least for the failing nozzle, after which detection by the ejection failure detecting means is performed again by forcing the failing nozzle alone to perform a droplet ejection operation.

Consequently, when an ejection failure of the droplet ejection head is detected, adequate recovery processing is performed depending on the cause of the ejection failure of the failing nozzle. Hence, rather than performing the sequential recovery processing by the conventional droplet ejection apparatus, it is possible to prevent liquid intended to be ejected, such as ink, from being wastefully discharged during the recovery processing, and consumption of the liquid to be ejected can be thereby reduced. Also, because the recovery processing of certain types that need not to be performed will not be performed, a time needed for the recovery processing can be shortened, which in turn makes it possible to improve the throughput (the number of printed sheets per unit time) of the droplet ejection apparatus.

Also, because detection by the ejection failure detecting means is performed again for the failing nozzle after the recovery processing in order to confirm whether the failing nozzle has been restored to a normal state, the occurrence of an ejection failure during the printing operation performed later can be prevented in a more reliable manner. Also, because detection by the ejection failure detecting means is performed by forcing the failing nozzle alone to perform the droplet ejection operation, the nozzles judged as being normal in the last detection do not have to eject droplets. It is thus possible to avoid wasteful ejection of the liquid to be ejected, which can in turn further reduce consumption of the liquid to be ejected. Moreover, the load on the ejection failure detecting means or the like can be reduced.

With the droplet ejection apparatus of the invention, it is preferable that the recovery means includes: wiping means for performing a wiping process by which nozzle surfaces of the droplet ejection heads, where the nozzles are aligned, are wiped off by a wiper; flushing means for performing a flushing process by which the droplets are preliminarily ejected through the nozzles by driving the actuators; and pumping means for performing a pump-suction process with the use of a pump connected to a cap covering the nozzle surfaces of the droplet ejection heads.

This allows the recovery means to perform adequate and waste-less recovery processing by selecting such processing from the wiping process, the flushing process, and the pump-suction process depending on the cause of an ejection failure.

With the droplet ejection apparatus of the invention, it is preferable that the cause of an ejection failure detectable by the ejection failure detecting means includes intrusion of an air bubble inside the cavity, thickening of the liquid caused by drying in a vicinity of the nozzle, and adhesion of paper dust in a vicinity of an outlet of the nozzle; and the recovery means performs the pump-suction process by the pumping means in a case where the cause of the ejection failure of the failing nozzle is the intrusion of an air bubble, the flushing process by the flushing means or the pump-suction process by the pumping means in a case where the cause of the ejection failure of the failing nozzle is the thickening caused by drying, and at least the wiping process by the wiper in a case where the cause of the ejection failure of the failing nozzle is the adhesion of paper dust.

It is thus possible to perform adequate and waste-less recovery processing depending on the cause of an ejection failure including intrusion of an air bubble inside the cavity, drying and thickening of the liquid in the vicinity of the nozzle, and adhesion of paper dust in the vicinity of the outlet of the nozzle. In the invention, "paper dust" is not limited to mere paper dust generated from a recording sheet or the like, but includes all the substances that could adhere in the vicinity of the nozzles and impede ejection of droplets, such as pieces of rubber from the advancing roller (feeding roller) and dust afloat in air.

A droplet ejection apparatus of the invention is a droplet ejection apparatus, provided with a plurality of droplet ejection heads each ejecting liquid through a nozzle communicating with a cavity in the form of droplets by changing an internal pressure of the cavity filled with the liquid by driving an actuator with a driving circuit, for ejecting the droplets through the nozzles while scanning the droplet ejection heads relatively with respect to a droplet receptor so that the droplets land on the droplet receptor, and the droplet ejection apparatus of the invention is characterized by including:

ejection failure detecting means for detecting an ejection failure of the droplets through the nozzles and a cause thereof;

recovery means for performing recovery processing for the droplet ejection heads to eliminate the cause of the ejection failure of the droplets; and storage means for storing a nozzle with which the ejection failure is detected by the ejection failure detecting means, in connection with the cause thereof, wherein:

the recovery means includes flushing means for performing a flushing process by which the droplets are preliminarily ejected through the nozzles by driving the actuators; and.

in a case where the presence of a failing nozzle in which an ejection failure is occurring is detected when detection by the ejection failure detecting means is performed for all of the nozzles, the flushing process is performed for the failing nozzle alone, after which detection by the ejection failure detecting means is performed again by forcing the failing nozzle alone to perform a droplet ejection operation, and when the presence of a re-failing nozzle in which the ejection failure has not been eliminated is detected, recovery processing depending on the cause of the ejection failure of the re-failing nozzle is performed by the recovery means at least for the re-failing nozzle, after which detection by the ejection failure detecting means is performed once again by forcing the re-failing nozzle alone to perform the droplet ejection operation.

Hence, if an ejection failure of the droplet ejection head is detected and the cause of the ejection failure of this failing nozzle is minor, the failing nozzle can be restored to the normal state quickly by the flushing process. Also, because the normally operating nozzles do not eject droplets in this testing sequence, liquid to be ejected, such as ink, is not consumed wastefully.

Also, because detection by the ejection failure detecting means is performed again for the failing nozzle after the flushing process in order to confirm whether the failing nozzle has been restored to a normal state, the occurrence of an ejection failure during the printing operation performed later can be prevented in a more reliable manner. Also, because detection by the ejection failure detecting means is performed by forcing the failing nozzle alone to perform the droplet ejection operation, the nozzles judged as being normal in the last detection do not have to eject droplets. It is thus possible to avoid wasteful ejection of the liquid to be ejected, which can in turn further reduce consumption of the liquid to be ejected.

Also, when the recovery processing of the failing nozzle is confirmed and the result shows the presence of a re-failing nozzle in which the ejection failure has not been eliminated, adequate recovery processing is performed depending on the cause of the ejection failure of this re-failing nozzle. Hence, in contrast to the sequential recovery processing by the conventional droplet ejection apparatus, it is possible to prevent liquid from being wastefully discharged during the recovery processing, which can in turn further reduce consumption of the liquid. Also, because the recovery processing of the types that need not be performed will not be performed, a time needed for the recovery processing can be shortened, which in turn makes it possible to improve the throughput (the number of printed sheets per unit time) of the droplet ejection apparatus.

Also, because detection by the ejection failure detecting means is performed once again for the re-failing nozzle after the recovery processing for the re-failing nozzle in order to confirm whether the re-failing nozzle has been restored to the normal state, the occurrence of an ejection failure during the printing operation performed later can be prevented in a more reliable manner. Also, because detection by the ejection failure detecting means is performed by forcing the re-failing nozzle alone to perform the droplet ejection operation, the nozzles judged as operating normally in the last detection do not have to eject droplets. It is thus possible to avoid wasteful ejection of the liquid to be ejected, which can in turn further reduce consumption of the liquid to be ejected. Moreover, the load on the ejection failure detecting means or the like can be reduced.

With the droplet ejection apparatus of the invention, it is preferable that the recovery means further includes: wiping means for performing a wiping process by which nozzle surfaces of the droplet ejection heads, where the nozzles are aligned, are wiped off by a wiper; and pumping means for performing a pump-suction process with the use of a pump connected to a cap covering the nozzle surfaces of the droplet ejection heads.

This allows recovery means to perform adequate and waste-less recovery processing by selecting such processing from the wiping process, the flushing process, and the pump-suction process depending on the cause of an ejection failure.

With the droplet ejection apparatus of the invention, it is preferable that:

the cause of an ejection failure detectable by the ejection failure detecting means includes intrusion of an air bubble inside the cavity, thickening of the liquid caused by drying in a vicinity of the nozzle, and adhesion of paper dust in a vicinity of an outlet of the nozzle; and.

the recovery means performs the pump-suction process by the pumping means if the cause of the ejection failure of the re-failing nozzle is the intrusion of an air bubble or the thickening caused by drying, and at least the wiping process by the wiper if the cause of the ejection failure of the re-failing nozzle is the adhesion of paper dust.

It is thus possible to perform adequate and waste-less recovery processing depending on the cause of an ejection failure including the intrusion of an air bubble inside the cavity, the drying and thickening of the liquid in the vicinity of the nozzle, and the adhesion of paper dust in the vicinity of the outlet of the nozzle.

With the droplet ejection apparatus of the invention, it is preferable that the recovery means performs the flushing process for each of the nozzles after the recovery processing depending on the cause of the ejection failure is performed.

It is thus possible to forestall the mixing of liquid to be ejected of various kinds in different colors or the like remaining on the nozzle surfaces.

With the droplet ejection apparatus of the invention, it is preferable that the wiping means is formed to be able to perform the wiping process separately for plural sets of nozzle groups, so that when performing the wiping process depending on the cause of the ejection failure of the failing nozzle or the re-failing nozzle, the wiping means performs the wiping process only for a nozzle group including the failing nozzle or the re-failing nozzle.

Hence, because the wiping process can be performed selectively only for the nozzle group including the nozzle that needs the wiping process, a waste-less and efficient wiping process can be performed compared with a case where the wiping process is performed for all the nozzles at a time.

With the droplet ejection apparatus of the invention, it is preferable that the pumping means is formed to be able to perform the pump-suction process separately for plural sets of nozzle groups, so that when performing the pump-suction process depending on the cause of the ejection failure of the failing nozzle or the re-failing nozzle, the pumping means performs the pump-suction process only for a nozzle group including the failing nozzle or the re-failing nozzle.

Hence, because the pump-suction process can be performed selectively only for the nozzle group including the nozzle that needs the pump-suction process, a waste-less and efficient pump-suction process can be performed compared with a case where the pump-suction process is performed for all the nozzles at a time.

With the droplet ejection apparatus of the invention, it is preferable that the plural sets of nozzle groups have different kinds of droplets to be ejected.

It is thus possible to perform the wiping process or the pump-suction process for individual nozzle groups used for ejecting different kinds of liquid to be ejected. Hence, not only can waste-less and efficient recovery processing be performed, but also the mixing of different kinds of liquid to be ejected can be forestalled.

It is preferable that the droplet ejection apparatus of the invention further include informing means for informing a detection result when a result of detection by the ejection failure detecting means shows the presence of a nozzle with which an ejection failure is detected.

It is thus possible to inform the user (operator) of the occurrence of an ejection failure quickly.

With the droplet ejection apparatus of the invention, it is preferable that:

the actuator of each of the droplet ejection heads have a diaphragm that can be displaced in such a manner so as to change an internal pressure of the corresponding cavity; and the ejection failure detecting means detects residual vibration of the diaphragm and detects an ejection failure on the basis of a vibration pattern of the detected residual vibration of the diaphragm.

It is thus possible to detect an ejection failure and the cause thereof with accuracy in a reliable manner by a relatively simple configuration.

With the droplet ejection apparatus of the invention, it is preferable that the actuator is an electrostatic actuator.

Hence, in the case of the droplet ejection head employing an electrostatic actuator, an ejection failure and the cause thereof can be detected with accuracy in a reliable manner by a relatively simple configuration.

With the droplet ejection apparatus of the invention, it is preferable that the actuator is a piezoelectric actuator using a piezoelectric effect of a piezoelectric element.

Hence, in the case of the droplet ejection head employing a piezoelectric actuator, an ejection failure and the cause thereof can be detected with accuracy in a reliable manner by a relatively simple configuration.

With the droplet ejection apparatus of the invention, it is preferable that the ejection failure detecting means includes an oscillation circuit, and the oscillation circuit oscillates on the basis of an electric capacitance component of the actuator that varies with the residual vibration of the diaphragm.

It is thus possible to detect an ejection failure accurately by an inexpensive circuit of a simple design.

With the droplet ejection apparatus of the invention, it is preferable that the oscillation circuit form a CR oscillation circuit from the electric capacitance component of the actuator and a resistance component of a resistor element connected to the actuator.

It is thus possible to detect the residual vibration of the diaphragm accurately, which in turn enables an ejection failure to be detected accurately.

With the droplet ejection apparatus of the invention, it is preferable that the actuator of each of the droplet ejection heads has a heating element that can give rise to film boiling by heating the liquid filled in the corresponding cavity;

each of the droplet ejection heads further includes a diaphragm that is displaced elastically in association with a change in internal pressure of the cavity, and an electrode provided opposite to the diaphragm; and the ejection failure detecting means detects residual vibration of the diaphragm and detects an ejection failure on the basis of a vibration pattern of the detected residual vibration of the diaphragm.

Hence, in the case of the droplet ejection head of the thermal jet method, an ejection failure and the cause thereof can be detected with accuracy in a reliable manner by a relatively simple configuration.

With the droplet ejection apparatus of the invention, it is preferable that the ejection failure detecting means includes an oscillation circuit, and the oscillation circuit oscillates on the basis of a variance with time of an electric capacitance of a capacitor formed from the diaphragm and the electrode, associated with the residual vibration of the diaphragm.

It is thus possible to detect an ejection failure accurately by an inexpensive circuit of a simple design.

With the droplet ejection apparatus of the invention, it is preferable that the oscillation circuit forms a CR oscillation circuit from an electric capacitance component of the capacitor and a resistance component of a resistor element.

It is thus possible to detect the residual vibration of the diaphragm accurately, which in turn enables an ejection failure to be detected accurately.

With the droplet ejection apparatus of the invention, it is preferable that the vibration pattern of the residual vibration of the diaphragm include a cycle of the residual vibration.

It is thus possible to detect an ejection failure with a high degree of accuracy.

With the droplet ejection apparatus of the invention, it is preferable that: the ejection failure detecting means include judging means for judging the presence or absence of an ejection failure of the droplets in the corresponding droplet ejection head on the basis of the vibration pattern of the residual vibration of the diaphragm, and judging the cause of the ejection failure upon judging the presence of the ejection failure of the droplets in the droplet ejection head.

It is thus possible to judge the presence or absence of an ejection failure and the cause thereof in a reliable manner.

With the droplet ejection apparatus of the invention, it is preferable that the judging means judges that an air bubble has intruded inside the cavity when the cycle of the residual vibration of the diaphragm is shorter than a cycle of a predetermined range, the liquid has thickened by drying in the vicinity of the nozzle when the cycle of the residual vibration of the diaphragm is longer than a predetermined threshold, and paper dust is adhering in the vicinity of the outlet of the nozzle when the cycle of the residual vibration of the diaphragm is longer than the cycle of the predetermined range and shorter than the predetermined threshold.

It is thus possible to differentiate the intrusion of air bubbles inside the cavity from drying, thickening of the liquid in the vicinity of the nozzle and adhesion of paper dust in the vicinity of the outlet of the nozzle, as the cause of an ejection failure.

With the droplet ejection apparatus of the invention, it is preferable that the ejection failure detecting means includes an F/V converting circuit that generates a voltage waveform of the residual vibration of the diaphragm from a predetermined signal group generated on the basis of a change of an oscillation frequency in an output signal from the oscillation circuit.

It is thus possible to set the detection sensitivity to a larger magnitude when the residual vibration waveform is detected.

With the droplet ejection apparatus of the invention, it is preferable that the ejection failure detecting means include a waveform shaping circuit that shapes the voltage waveform of the residual vibration of the diaphragm generated in the F/V converting circuit into a predetermined waveform.

It is thus possible to set the detection sensitivity to a larger magnitude when the residual vibration waveform is detected.

With the droplet ejection apparatus of the invention, it is preferable that the waveform shaping circuit includes: DC component removing means for removing a direct current component from the voltage waveform of the residual vibration of the diaphragm generated in the F/V converting circuit; and a comparator that compares the voltage waveform, from which the direct current component has been removed by the DC component removing means, with a predetermined voltage value, so that the comparator generates and outputs a rectangular wave on the basis of the voltage comparison.

It is thus possible to set the detection sensitivity to a larger magnitude when the residual vibration waveform is detected.

With the droplet ejection apparatus of the invention, it is preferable that the ejection failure detecting means include measuring means for measuring a cycle of the residual vibration of the diaphragm from the rectangular wave generated in the waveform shaping circuit.

It is thus possible to detect the cycle of the residual vibration of the diaphragm accurately in a simple manner.

With the droplet ejection apparatus of the invention, it is preferable that the measuring means has a counter, and measures a time between rising edges or between a rising edge and a falling edge of the rectangular wave by counting pulses of a reference signal with the counter.

It is thus possible to detect the cycle of the residual vibration of the diaphragm accurately in a simple manner.

Still another aspect of the invention provides an ejection failure recovery method for a droplet ejection apparatus having a head unit including a plurality of droplet ejection heads each ejecting liquid within a cavity through a nozzle in the form of droplets by driving an actuator with a driving circuit, and the ejection failure recovery method for a droplet ejection apparatus of the invention is characterized by including:

detecting an ejection failure of the droplet ejection heads and a cause thereof; and performing recovery processing depending on the cause of the ejection failure if the ejection failure is detected when the droplets are ejected through the nozzles.

According to the ejection failure recovery method for a droplet ejection apparatus of the invention, the same advantages as those achieved by the droplet ejection apparatus described above can be obtained.

BRIEF DESCRIPTION OF THE DRAWINGS

The above and other objects, features, and the advantages of the invention will readily become more apparent from the following detailed description of preferred embodiments of the invention with reference to the accompanying drawings.

DETAILED DESCRIPTION

Preferred embodiments of a droplet ejection apparatus and an ejection failure recovery method of the invention will now be described in detail with reference to FIG. 1 through FIG. 49. It is to be understood that these embodiments are for the purpose of illustration and interpretations of the content of the invention are not limited to these embodiments. It should be noted that, in the embodiments below, an ink jet printer that prints an image on a recording sheet (droplet receptor) by ejecting ink (liquid material) will be described as one example of the droplet ejection apparatus of the invention.

First Embodiment

Figure 1:
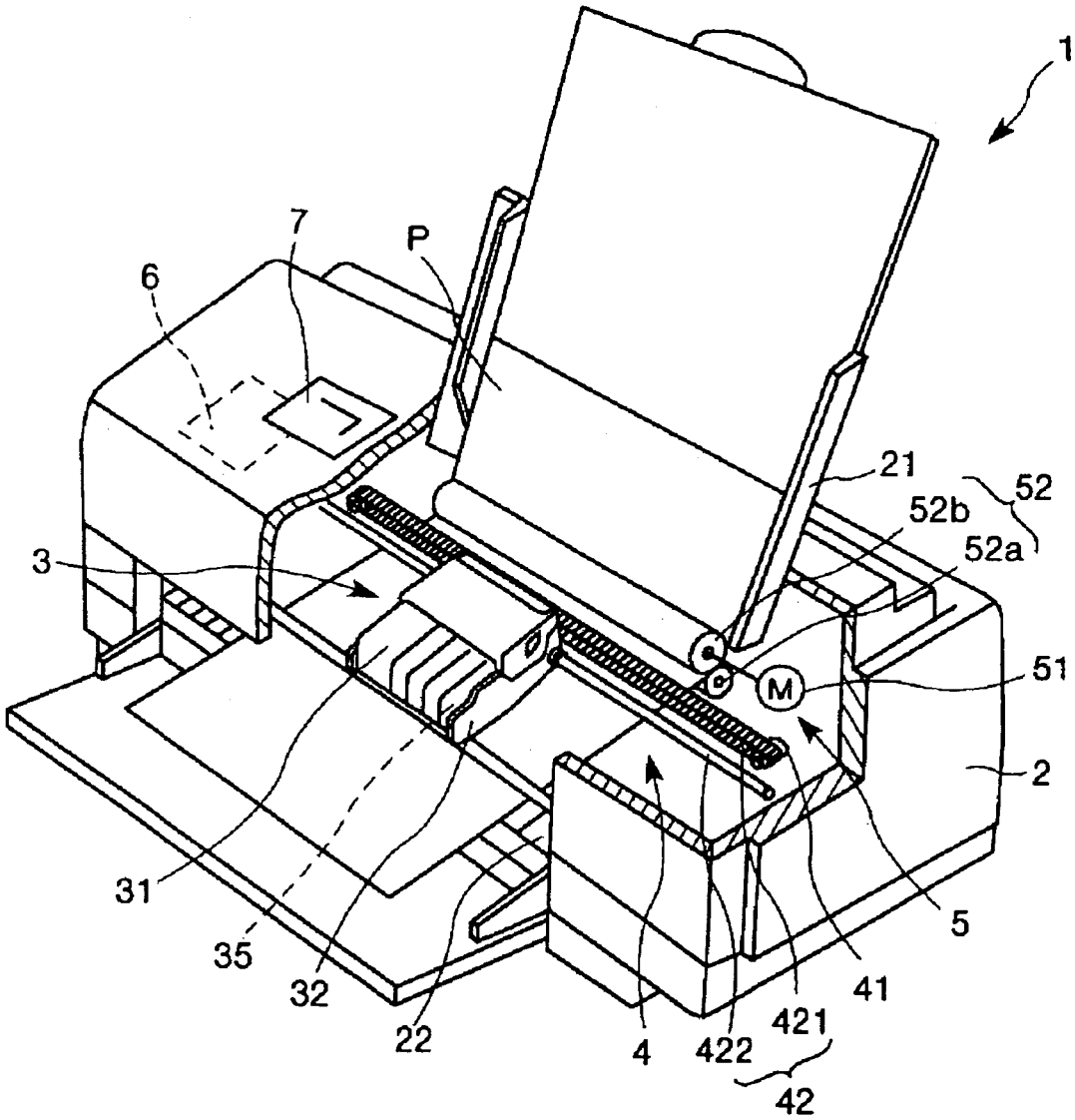
FIG. 1 is a schematic view showing the configuration of an ink jet printer as one type of a droplet ejection apparatus of the invention.

FIG. 1 is a schematic view showing the configuration of an ink jet printer 1 as one type of a droplet ejection apparatus according to a first embodiment of the invention. Hereinafter, the upper side and the lower side of FIG. 1 are referred to as "top" and "bottom", respectively. First, the configuration of the ink jet printer 1 will be described.

The ink jet printer 1 shown in FIG. 1 includes an apparatus main body 2. A tray 21, on which a recording sheet P is placed, is provided rearward of the top, a sheet discharge port 22, through which the recording sheet P is discharged, is provided frontward of the bottom, and an operation panel 7 is provided on the top surface.

The operation panel 7 comprises, for example, a liquid crystal display, an organic EL display, an LED lap, etc., and is provided with a display portion (not shown) to display an error message or the like and an operation portion (not shown) comprising various kinds of switches or the like. The display portion of the operation panel 7 functions as informing means.

Also, the apparatus main body 2 chiefly encloses a printing apparatus (printing means) 4 equipped with print device (movable body) 3 performing a reciprocating motion, a feeding apparatus (droplet receptor transporting means) 5 feeding/discharging a recording sheet P to/from the printing apparatus 4, and a control portion (control means) 6 controlling the printing apparatus 4 and the feeding apparatus 5.

The feeding apparatus 5 intermittently feeds recording sheets P one by one under the control of the control portion 6. The recording sheet P passes by the vicinity of the bottom of the print device 3. In this instance, the print device 3 reciprocates in a direction intersecting at almost right angles with the feeding direction of the recording sheet P, and printing on the recording sheet P is thereby performed. In other words, printing by the ink jet method is performed while the reciprocating motion of the print device 3 and the intermittent feeding of the recording sheet P take place as the main scanning and the sub scanning of printing, respectively.

The printing apparatus 4 is provided with the print device 3, a carriage motor 41 serving as a driving source for moving the print device 3 (causing it to reciprocate) in the main scanning direction, and a reciprocating mechanism 42 receiving rotations of the carriage motor 41 and causing the print device 3 to reciprocate.

The print device 3 includes a plurality of head units 35 corresponding to the kinds of ink and provided with a number of nozzles 110, ink cartridges (I/Cs) 31 supplying the respective head units 35 with ink, a carriage 32 on which the respective head units 35 and ink cartridges 31 are mounted.

Also, as will be described below with reference to FIG. 3, each head unit 35 is provided with a number of ink jet recording heads (ink jet heads or droplet ejection heads) 100, each comprising one nozzle 110, one diaphragm 121, one electrostatic actuator 120, one cavity 141, and one ink supply port 142, etc. FIG. 1 shows the configuration in which the head units 35 include the ink cartridges 31; however, the head units 35 are not limited to this configuration. For example, in the case of an ink jet printer consuming a large quantity of ink, the ink cartridges 31 may be provided in another place, so that the head units 35 are supplied with ink by a tube or the like. Hence, hereinafter, apart from the print device 3, those provided with a plurality of ink jet heads 100, each comprising one nozzle 110, one diaphragm 121, one electrostatic actuator 120, one cavity 141, and one ink supply port 142, etc., are referred to as the head units 35.

By using cartridges respectively filled with four colors of ink, including yellow, cyan, magenta, and black, as the ink cartridges 31, full-color printing becomes possible. In this case, head units 35 corresponding to the respective colors are provided to the print device 3 (the configuration of which will be described in detail below). Herein, FIG. 1 shows four ink cartridges 31 corresponding to four colors of ink, respectively; however, the print device 3 may be configured to further include an ink cartridge 31 for ink of a special color, for example, light cyan, light magenta, or dark yellow.

The reciprocating mechanism 42 includes a carriage guide shaft 422 supported by a frame (not shown) at both ends, and a timing belt 421 extending in parallel with the carriage guide shaft 422.

The carriage 32 is supported by the carriage guide shaft 422 of the reciprocating mechanism 42 so as to be free to reciprocate while being fixed to part of the timing belt 421.

When the timing belt 421 is run forward and backward via a pulley by the operation of the carriage motor 41, the print device 3 is guided by the carriage guide shaft 422 and starts to reciprocate. During this reciprocating motion, ink drops are ejected through the respective ink jet heads 100 of the head units 35 as needed in response to image data (printing data) to be printed, and printing on the recording sheet P is thereby performed.

The feeding apparatus 5 includes a feeding motor 51 serving as a driving source, and a feeding roller 52 rotating in association with the operation of the feeding motor 51.

The feeding roller 52 comprises a driven roller 52*a* and a driving roller 52*b* opposing vertically with a transportation path of a recording sheet P (recording sheet P) in between. The driving roller 52*b* is coupled to the feeding motor 51. This allows the feeding roller 52 to feed a number of recording sheets P on the tray 21 to the printing apparatus 4 one by one, or discharge the recording sheets P from the printing apparatus 4 one by one. Instead of the tray 21, a feeding cassette accommodating the recording sheets P may be removably attached.

Further, the feeding motor 51 advances a recording sheet P depending on the resolution of an image in association with the reciprocating motion of the print device 3. The feeding operation and the advancing operation may be performed individually by separate motors, or alternatively, they may be performed by the same motor with the use of a part that switches torque transmission, such as an electromagnetic clutch.

The control portion 6 performs printing processing on a recording sheet P by controlling the printing apparatus 4, the feeding apparatus 5, etc. according to the printing data inputted from a host computer 8, such as a personal computer (PC) and a digital camera (DC). The control portion 6 also controls the display portion of the operation panel 7 to display an error message or the like, or an LED lamp or the like to switch ON/OFF, and controls the respective portions to perform corresponding processing according to depressed signals of various switches inputted from the operation portion. Further, the control portion 6 may be configured to transfer information, such as an error message or an ejection failure, to the host computer 8 via an interface portion 9 as the necessity arises.

Figure 2:
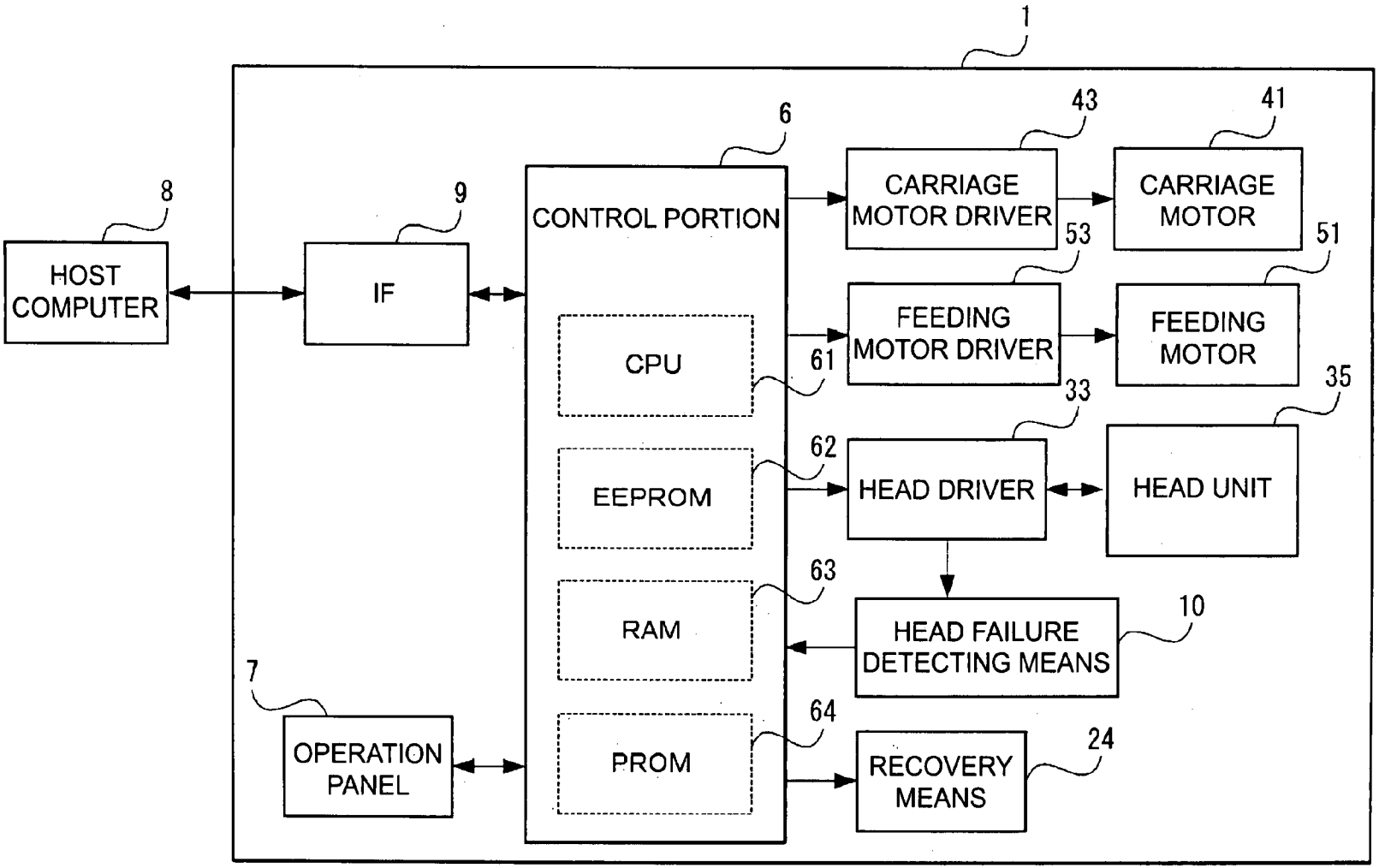
FIG. 2 is a block diagram schematically showing a major portion of the ink jet printer of the invention.

FIG. 2 is a block diagram schematically showing a major portion of the ink jet printer of the invention. Referring to FIG. 2, an ink jet printer 1 of the invention is provided with the interface portion (IF) 9 receiving printing data or the like inputted from the host computer 8, the control portion 6, the carriage motor 41, a carriage motor driver 43 driving the carriage motor 41 under its control, the feeding motor 51, a feeding motor driver 53 driving the feeding motor 51 under its control, the head units 35, a head driver 33 driving the head units 35 under its control, ejection failure detecting means (device) 10, recovery means (device) 24, and the operation panel 7. The ejection failure detecting device 10, the recovery device 24, and the head driver 33 will be described below in detail.

Referring to FIG. 2, the control portion 6 is provided with a CPU (Central Processing Unit) 61 performing various types of processing including printing processing, ejection failure detection processing, etc., an EEPROM (Electrically Erasable Programmable Read-Only Memory) (storage means) 62 as one kind of non-volatile semiconductor memory used to store printing data inputted from the host computer 8 via the IF 9 in an unillustrated data storage region, a RAM (Random Access Memory) 63 temporarily storing various kinds of data when ejection failure detection processing or the like described below is performed or temporarily developing an application program for printing processing or the like, and a PROM 64 as one kind of non-volatile semiconductor memory used to store control programs or the like for controlling the respective portions. The respective components of the control portion 6 are electrically connected via an unillustrated bus.

As has been described, the print device 3 is provided with a plurality of head units 35 corresponding to the respective colors of ink. Also, each head unit 35 is provided with a plurality of nozzles 110 and the electrostatic actuators 120 corresponding to the respective nozzles 110. In other words, each head unit 35 is configured to include a plurality of ink jet heads 100 (droplet ejection heads) each comprising a set including the nozzle 110 and the electrostatic actuator 120. Meanwhile, the head driver 33 comprises a driving circuit 18 controlling ejection timing of ink by driving the electrostatic actuators 120 of the respective ink jet heads 100, and switching means (device) 23 (see FIG. 16). The configurations of the ink jet head 100 and the electrostatic actuator 120 will be described below.

Although it is not shown in the drawing, various kinds of sensors capable of detecting, for example, a remaining quantity of ink in the ink cartridges 31, the position of the print device 3, printing environments, such as temperature and humidity, etc. are electrically connected to the control portion 6.

Upon receipt of printing data from the host computer 8 via the IF 9, the control portion 6 stores the printing data in the EEPROM 62. The CPU 61 then performs predetermined processing on the printing data, and outputs driving signals to each of the drivers 33, 43, and 53 according to the processing data thus obtained and input data from the various kinds of sensors. Upon input of these driving signals through each of the drivers 33, 43, and 53, the electrostatic actuators 120 corresponding to a plurality of ink jet heads 100 of the head units 35, the carriage motor 41 of the printing apparatus 4, and the feeding apparatus 5 start to operate individually. Printing processing is thus performed on a recording sheet P.

Figure 4:
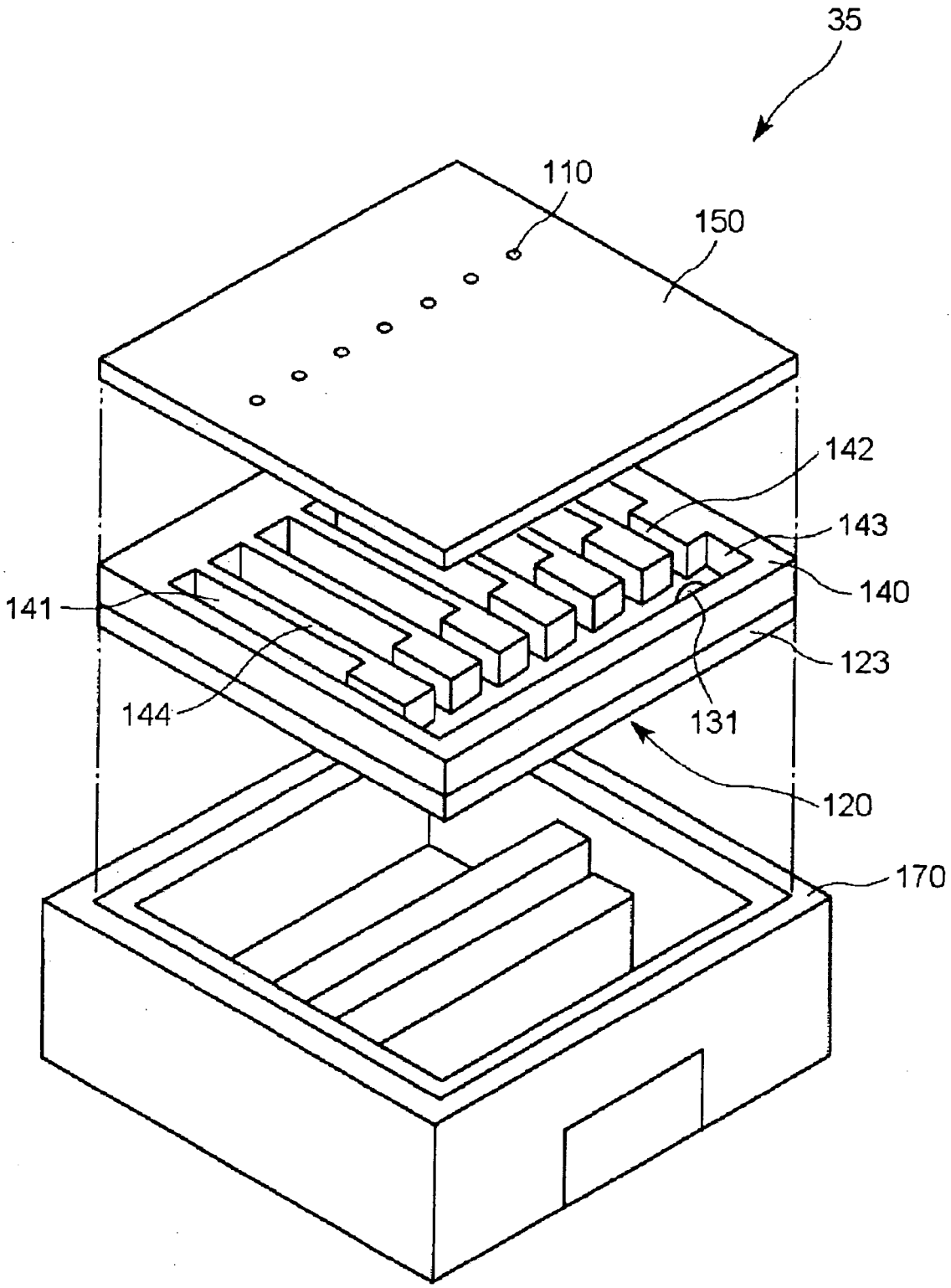
FIG. 4 is an exploded perspective view showing the configuration of the head unit of FIG. 3.
Figure 5:
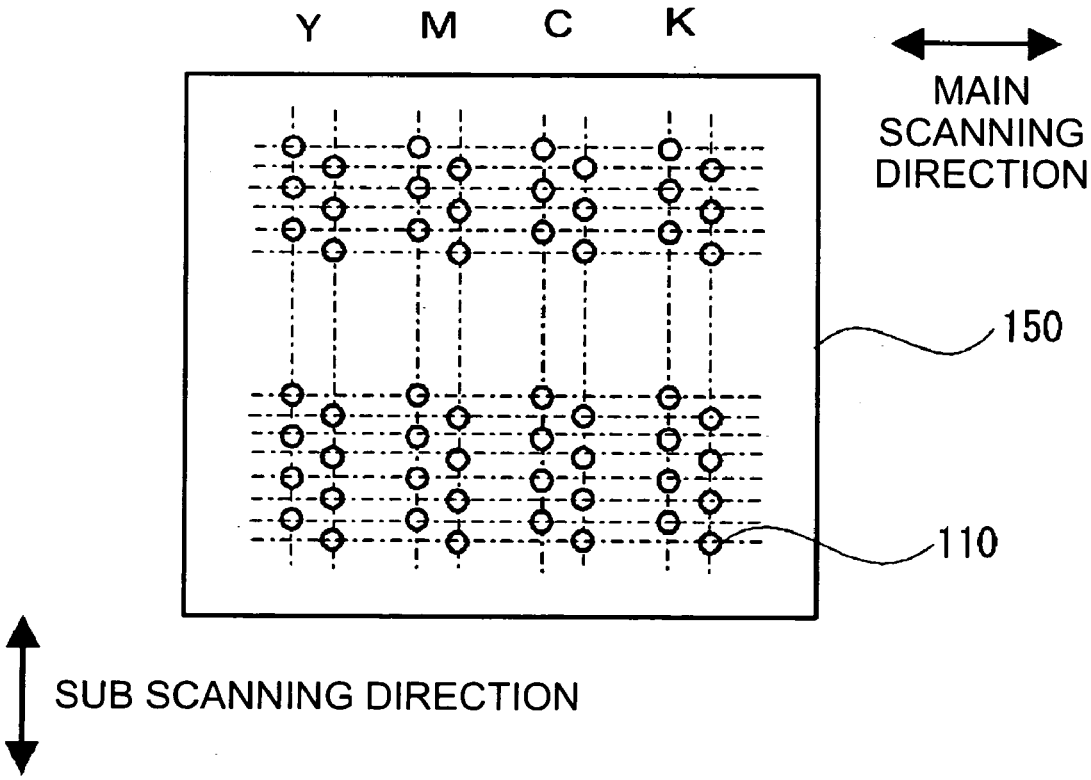
FIG. 5 shows one example of a nozzle alignment pattern in a nozzle plate of the head unit using four colors of ink.

The structure of each ink jet head 100 in each head unit 35 will now be described. FIG. 3 is a schematic cross section (including a common portion, such as the ink cartridge 31) of one ink jet head 100 of each head unit 35 shown in FIG. 1. FIG. 4 is an exploded perspective view schematically showing the configuration of the head unit 35 corresponding to one color of ink. FIG. 5 is a plan view showing an example of a nozzle surface of the print device 3 adopting the head unit 35 shown in FIG. 3 and FIG. 4. It should be noted that FIG. 3 and FIG. 4 are shown upside down from the normally used state.

Figure 3:
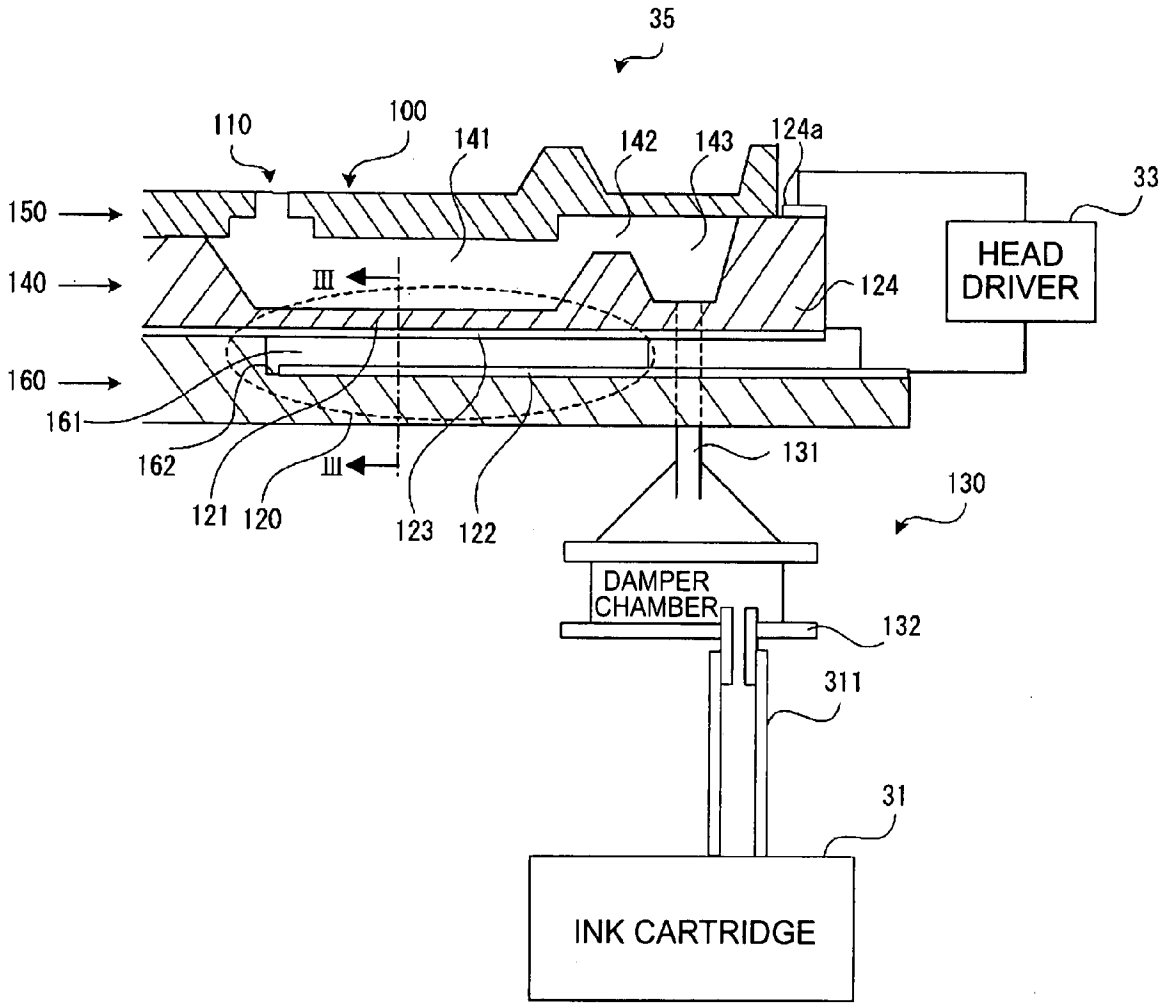
FIG. 3 is a schematic cross section of a head unit (ink jet head) in the ink jet printer shown in FIG. 1.

As shown in FIG. 3, the head unit 35 is connected to the ink cartridge 31 via an ink intake port 131, a damper chamber 130; and an ink supply tube 311. The damper chamber 130 is provided with a damper 132 made of rubber. The damper chamber 130 can absorb fluctuation of ink and a change in ink pressure when the carriage 32 reciprocates, which makes it possible to supply the respective ink jet heads 100 of the head unit 35 with a predetermined quantity of ink in a stable manner.

Also, the head unit 35 is of a triple-layer structure, comprising a silicon substrate 140 in the middle, a nozzle plate 150 also made of silicon layered on the upper side, and a borosilicate glass substrate (glass substrate) 160, having a coefficient of thermal expansion close to that of silicon, layered on the lower side. The silicon substrate 140 in the middle is provided with a plurality of independent cavities (pressure chambers) 141 (seven cavities are shown in FIG. 4), one reservoir (common ink chamber) 143, and grooves each functioning as an ink supply port (orifice) 142 allowing communication between the reservoir 143 and the respective cavities 141. Each groove is formed, for example, by applying etching processing from the surface of the silicon substrate 140. The nozzle plate 150, the silicon substrate 140, and the glass substrate 160 are bonded to each other in this order, and the respective cavities 141, the reservoir 143, and the respective ink supply ports 142 are thereby defined.

Each of these cavities 141 is formed in the shape of a strip (rectangular prism), and is configured in such a manner that a volume thereof is variable with vibration (displacement) of a diaphragm 121 described below, and this change in volume causes ink (liquid material) to be ejected through the nozzle 110. The nozzles 110 are formed in the nozzle plate 150 at positions corresponding to the respective cavities 141 at the portions on the tip side, and communicate with the respective cavities 141. Also, the ink intake port 131 communicating with the reservoir 143 is formed in the glass substrate 160 at a portion where the reservoir 143 is located. Ink is supplied from the ink cartridge 31 to the reservoir 143 by way of the ink supply tube 311 and the damper chamber 130 through the ink intake port 131. Ink supplied to the reservoir 143 passes through the respective ink supply ports 142 and is then supplied to the respective independent cavities 141. The respective cavities 141 are defined by the nozzle plate 150, sidewalls (partition walls) 144, and bottom walls 121.

The bottom wall 121 of each of the independent cavity 141 is formed thin, and the bottom wall 121 is formed to function as a diaphragm that can undergo elastic deformation (elastic displacement) in the out-of-plane direction (thickness direction), that is, in the vertical direction of FIG. 3. Hence, hereinafter, the portion of this bottom wall 121 will be occasionally referred to as the diaphragm 121 for ease of explanation (in other words, the same reference numeral 121 is used for both the bottom wall and the diaphragm).

Shallow concave portions 161 are formed on the surface of the glass substrate 160 on the silicon substrate 140 side, at the positions corresponding to the respective cavities 141 in the silicon substrate 140. Hence, the bottom wall 121 of each cavity 141 opposes, with a predetermined clearance in between, the surface of an opposing wall 162 of the glass substrate 160 in which the concave portions 161 are formed. In other words, a clearance of a predetermined thickness (for example, approximately 0.2 micron) is present between the bottom wall 121 of each cavity 141 and a segment electrode 122 described below. The concave portions 161 can be formed, for example, by etching.

The bottom wall (diaphragm) 121 of each cavity 141 forms part of a common electrode 124 on the respective cavities 141 side for accumulating charges by a driving signal supplied from the head driver 33. In other words, the diaphragm 121 of each cavity 141 also serves as one of the counter electrodes (counter electrodes of the capacitor) of the corresponding electrostatic actuator 120 described below. The segment electrodes 122 serving as electrodes opposing the common electrode 124 are formed respectively on the surfaces of the concave portions 161 in the glass substrate 160 so as to face the bottom walls 121 of the respective cavities 141. Also, as shown in FIG. 3, the surfaces of the bottom walls 121 of the respective cavities 141 are covered with an insulation layer 123 made of a silicon dioxide ($SiO_2$) film. In this manner, the bottom walls 121 of the respective cavities 141, that is, the diaphragms 121 and the corresponding respective segment electrodes 122 form (constitute) the counter electrodes (counter electrodes of the capacitor) via the insulation layer 123 formed on the surfaces of the bottom walls 121 of the cavities 141 on the lower side of FIG. 3 and clearances within the concave portions 161. Hence, the diaphragm 121, the segment electrode 122, and the insulation layer 123 and the clearance therebetween together form the major portion of the electrostatic actuator 120.

As shown in FIG. 3, the head driver 33 including the driving circuit 18 used to apply a driving voltage between these counter electrodes charges and discharges these counter electrodes in response to a print signal (print data) inputted from the control portion 6. One output terminal of the head driver (voltage applying means) 33 is connected to the respective segment electrodes 122, and the other output terminal is connected to an input terminal 124*a* of the common electrode 124 formed in the silicon substrate 140. Because the silicon substrate 140 is doped with impurities and therefore has electrical conduction by itself, it is possible to supply the common electrode 124 of the bottom walls 121 with a voltage from the input terminal 124*a* of the common electrode 124. Alternatively, for example, a thin film made of an electrically conductive material, such as gold and copper, may be formed on one surface of the silicon substrate 140. This allows a voltage (charges) to be supplied to the common electrode 124 at low electric resistance (efficiently). This thin film may be formed, for example, by vapor deposition, sputtering, etc. In this embodiment, for example, because the silicon substrate 140 and the glass substrate 160 are coupled (bonded) to each other through anode bonding, an electrical conductive film used as an electrode in this anode bonding is formed on the silicon substrate 140 on the channel forming surface side (on the top side of the silicon substrate 140 shown in FIG. 3). This electrically conductive film is directly used as the input terminal 124*a* of the common electrode 124. It should be appreciated, however, that in the invention, for example, the input terminal 124*a* of the common electrode 124 may be omitted and the bonding method of the silicon substrate 140 and the glass substrate 160 is not limited to the anode bonding.

As shown in FIG. 4, the head unit 35 is provided with the nozzle plate 150 in which a plurality of nozzles 110 are formed, the silicon substrate (ink chamber substrate) 140 in which a plurality of cavities 141, a plurality of ink supply ports 142, and one reservoir 143 are formed, and the insulation layer 123, all of which are accommodated in a base body 170 containing the glass substrate 160. The base body 170 is made of, for example, various kinds of resin materials, various kinds of metal materials, etc., and the silicon substrate 140 is fixed to and supported by the base body 170.

The nozzles 110 formed in the nozzle plate 150 are aligned linearly almost parallel to the reservoir 143 in FIG. 4 to make the illustration simple. However, the alignment pattern of the nozzles is not limited to this, and in general, for example, they are aligned in shifted stages as in the nozzle alignment pattern shown in FIG. 5. Also, the pitch between the nozzles 110 can be set appropriately depending on the printing resolution (dpi: dot per inch). FIG. 5 shows the alignment pattern of the nozzles 110 in a case where four colors of ink (ink cartridges 31) are used.

Figure 6C:
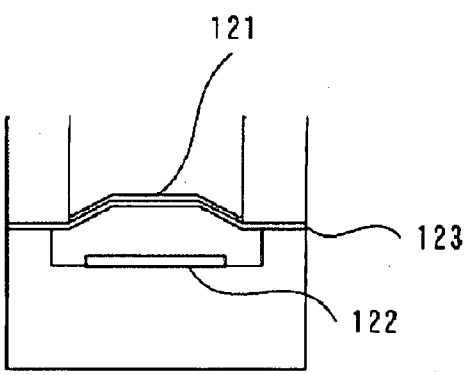
FIG. 6 shows views of respective states of a cross section taken along the line III—III of FIG. 3 upon input of a driving signal.
Figure 6B:
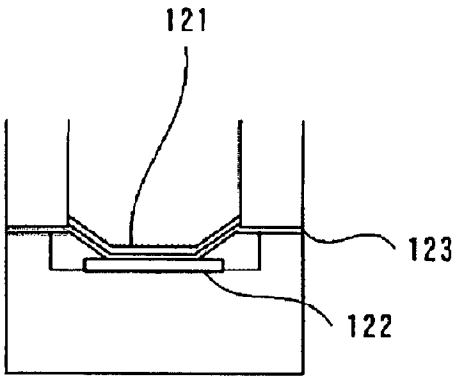
Figure 6A:
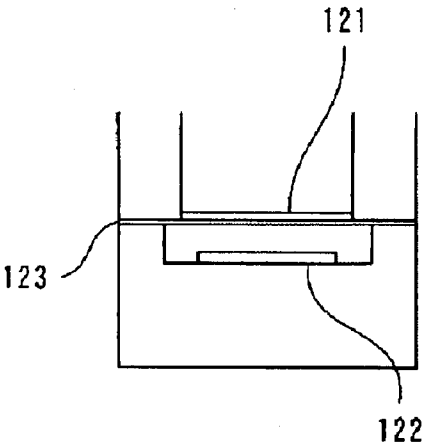

FIG. 6 shows respective states of the cross section taken along the line III—III of FIG. 3 upon input of a driving signal. When a driving voltage is applied between the counter electrodes from the head driver 33, a Coulomb's force develops between the counter electrodes. The bottom wall (diaphragm) 121 then bends towards the segment electrode 122 from the initial state (FIG. 6(*a*)), which causes the volume of the cavity 141 to increase (FIG. 6(*b*)). When the charges between the counter electrodes are discharged abruptly in this state under the control of the head driver 33, the diaphragm 121 restores upward in the drawing due to its elastic restoring force, and moves upwards above its initial position which causes the volume of the cavity 141 to contract abruptly (FIG. 6(*c*)). In this instance, part of the ink (liquid material) filled in the cavity 141 is ejected through the nozzle 110 communicating with this cavity 141 in the form of ink drops by the compression pressure generated within the cavity 141.

The damped vibration of the diaphragm 121 in each cavity 141 is continued by this series of operations (the ink ejection operation by the driving signal from the head driver 33) until ink drops are ejected again upon input of the following driving signal (driving voltage). Hereinafter, this damped vibration is also referred to as the residual vibration. The residual vibration of the diaphragm 121 is assumed to have an intrinsic vibration frequency that is determined by the acoustic resistance r given by the shapes of the nozzles 110 and the ink supply ports 142 or a degree of ink viscosity, the inertance m given by a weight of ink within the channel, and the compliance Cm of the diaphragm 121.

Figure 7:
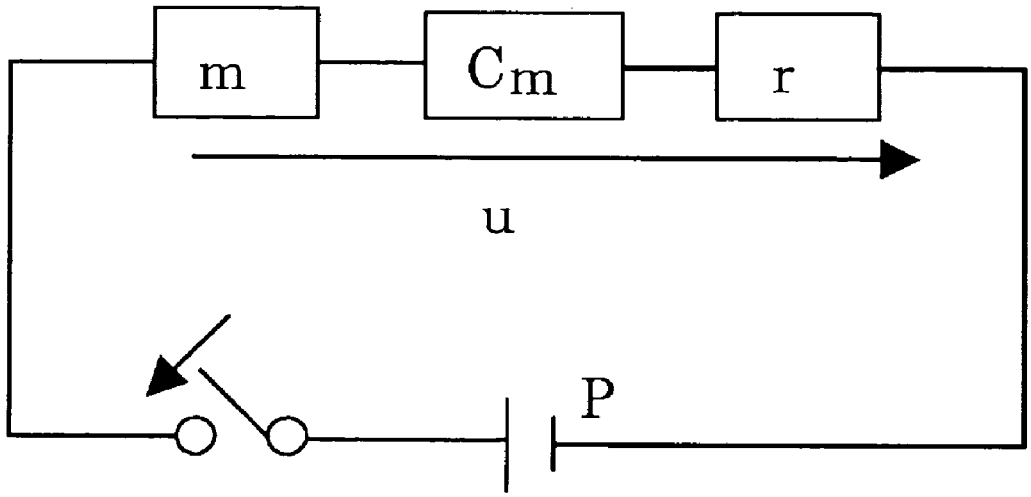
FIG. 7 is a circuit diagram showing a computation model of simple harmonic vibration on the assumption of residual vibration of a diaphragm of FIG. 3.

The computation model of the residual vibration of the diaphragm 121 based on the above assumption will now be described. FIG. 7 is a circuit diagram showing the computation model of simple harmonic vibration on the assumption of the residual vibration of the diaphragm 121. In this manner, the computation model of the residual vibration of the diaphragm 121 can be represented by a sound pressure P, and the aforementioned inertance m, compliance Cm and acoustic resistance r. Then, by computing a step response in terms of a volume velocity u when the sound pressure P is given to the circuit of FIG. 7, following equations are obtained.

(Mathematical Expression 1)

$$u = \frac{P}{\omega \cdot m} e^{-\alpha x} \cdot \sin \omega t \tag{1}$$

$$\omega = \sqrt{\frac{1}{m \cdot C_m} - \alpha^2} \tag{2}$$

$$\alpha = \frac{r}{2m} \tag{3}$$

Figure 8:
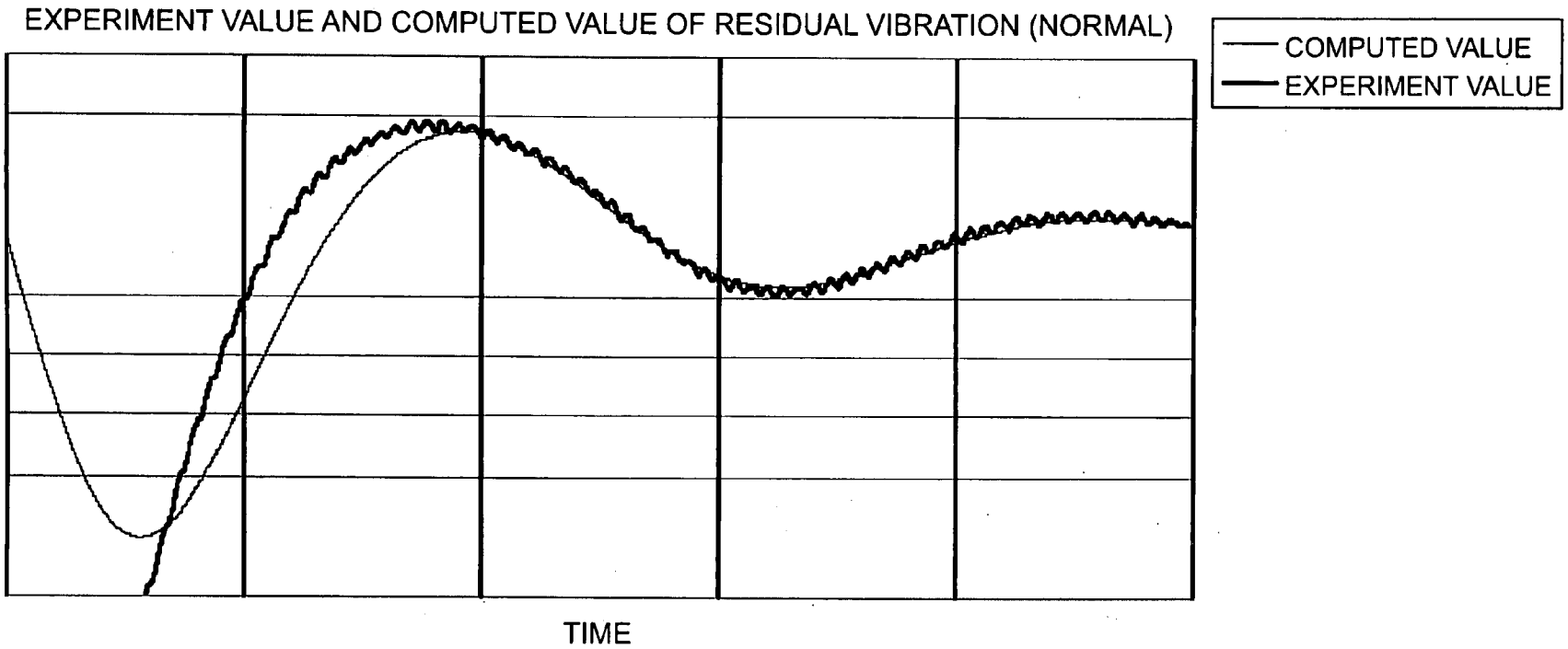
FIG. 8 is a graph showing the relation between an experiment value and a computed value of residual vibration of the diaphragm of FIG. 3 in the case of normal ejection.

The computation result obtained from the equations above is compared with the experiment result from an experiment performed separately as to the residual vibration of the diaphragm 121 after ejection of ink drops. FIG. 8 is a graph showing the relation between the experiment value and the computed value of the residual vibration of the diaphragm 121. As can be understood from the graph shown in FIG. 8, two waveforms of the experiment value and the computed value almost agree with each other.

Incidentally, a phenomenon may occur in the respective ink jet heads 100 of the head unit 35 that ink drops are not ejected normally through the nozzles 110 even when the aforementioned ejection operation is performed, that is, the occurrence of an ejection failure of droplets. The occurrence of an ejection failure is attributed to, as will be described below, (1) intrusion of an air bubble inside the cavity 141, (2) drying and thickening (fixing) of ink in the vicinity the nozzle 110, (3) adhesion of paper dust in the vicinity the outlet of the nozzle 110, etc.

Once the ejection failure occurs, it typically results in non-ejection of droplets through the nozzle 110, that is, the advent of a droplet non-ejection phenomenon, which gives rise to the missing dot in pixels forming an image printed (drawn) on a recording sheet P. Also, in the case of the ejection failure, even when droplets are ejected through the nozzle 110, the ejected droplets do not land on the recording sheet P adequately because a quantity of droplets is too small or the flying direction (trajectory) of droplets is deviated, which also appears as a missing dot in the pixels. For this reason, hereinafter, an ejection failure of droplets may also be referred to simply as the missing dot.

In the following, values of the acoustic resistance r and/or the inertance m are adjusted on the basis of the comparison result shown in FIG. 8 for each cause of the missing dot (ejection failure) phenomenon (droplet non-ejection phenomenon) during the printing processing occurring in the nozzle 110 of the ink jet head 100, so that the computed value and the experiment value of the residual vibration of the diaphragm 121 match (almost agree) with each other. Herein, three causes, that is, intrusion of an air bubble, thickening caused by drying, and adhesion of paper dust, will be discussed.

Figure 9:
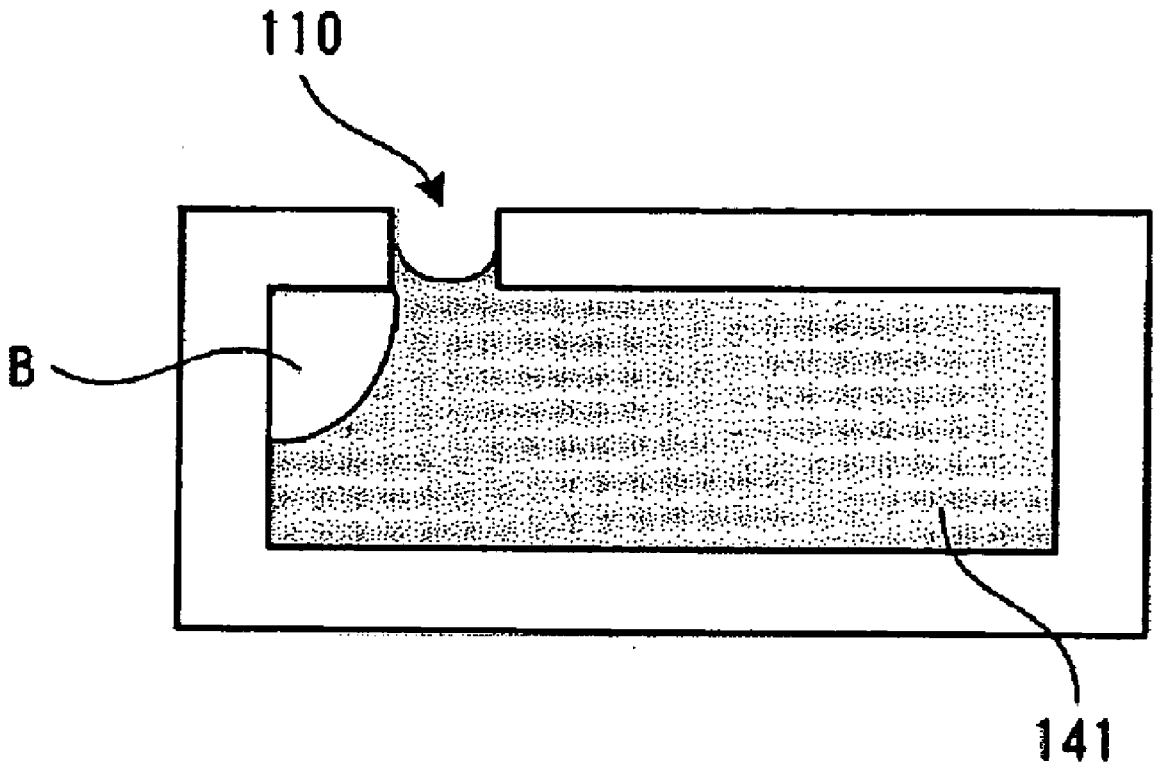
FIG. 9 is a conceptual view in the vicinity of a nozzle in a case where an air bubble has intruded inside a cavity of FIG. 3.

Firstly, intrusion of an air bubble inside the cavity 141, which is one of the causes of the missing dot, will be discussed. FIG. 9 is a conceptual view in the vicinity of the nozzle 110 in a case where an air bubble B has intruded inside the cavity 141 of FIG. 3. As is shown in FIG. 9, the air bubble B thus generated is assumed to be generated and adhering to the wall surface of the cavity 141 (FIG. 9 shows a case where the air bubble B is adhering in the vicinity of the nozzle 110, as one example of the adhesion position of the air bubble B).

When the air bubble B has intruded inside the cavity 141 in this manner, a total weight of ink filling the cavity 141 is thought to decrease, which in turn lowers the inertance m. Also, because the air bubble B is adhering to the wall surface of the cavity 141, the nozzle 110 is thought to be in a state where its diameter is increased in size by the diameter of the air bubble B, which in turn lowers the acoustic resistance r.

Figure 10:
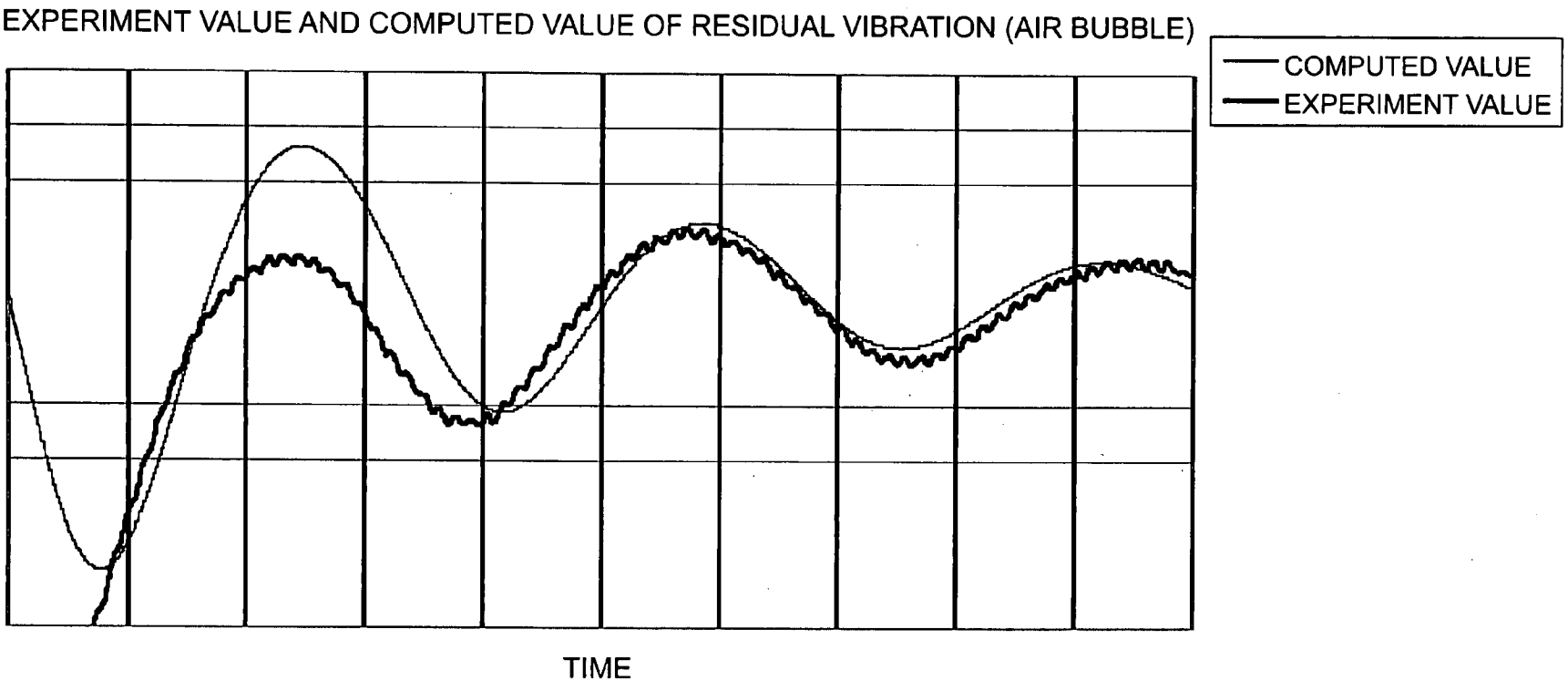
FIG. 10 is a graph showing the computed value and the experiment value of residual vibration in a state where ink drops are not ejected due to intrusion of an air bubble inside the cavity.

Hence, by setting both the acoustic resistance r and the inertance m smaller than in the case of FIG. 8 where ink is ejected normally, to be matched with the experiment value of the residual vibration in the case of intrusion of an air bubble, the result (graph) as shown in FIG. 10 was obtained. As can be understood from the graphs of FIG. 8 and FIG. 10, in the case of intrusion of an air bubble inside the cavity 141, a residual vibration waveform, characterized in that the frequency becomes higher than in the case of normal ejection, is obtained. It is also confirmed that the damping rate of amplitude of the residual vibration becomes smaller as the acoustic resistance r is lowered, and the amplitude of the residual vibration thus becomes smaller slowly.

Figure 11:
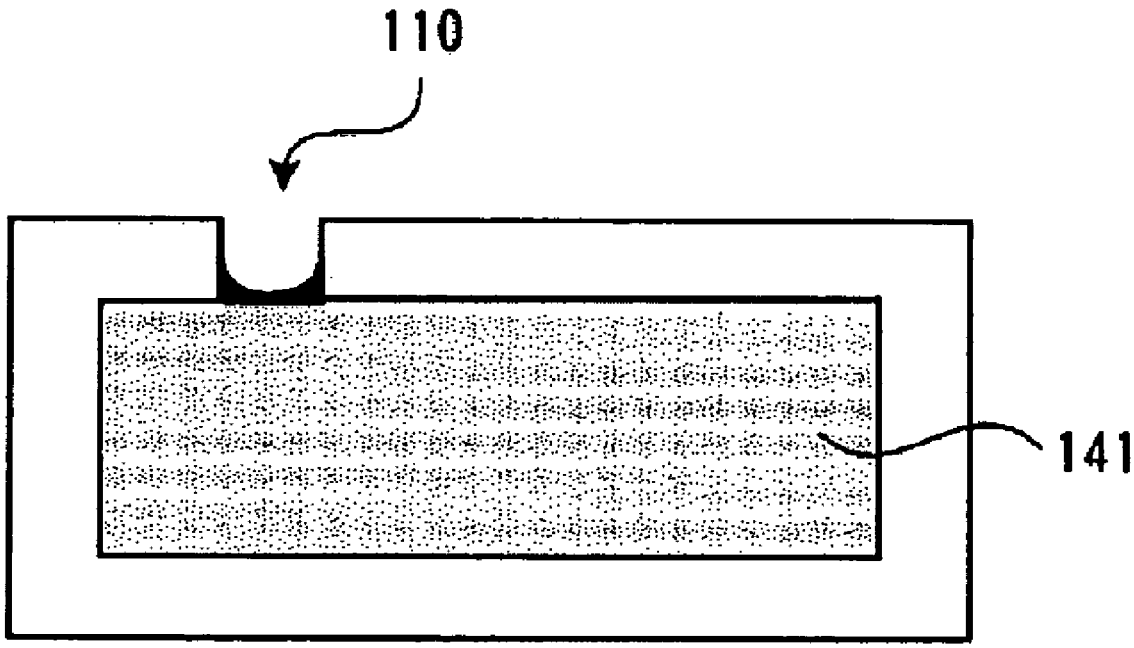
FIG. 11 is a conceptual view in the vicinity of the nozzle in a case where ink has fixed by drying in the vicinity of the nozzle of FIG. 3.

Next, drying (fixing and thickening) of ink in the vicinity of the nozzle 110, which is another cause of the missing dot, will be discussed. FIG. 11 is a conceptual view in the vicinity of the nozzle 110 in a case where ink has fixed by drying in the vicinity of the nozzle 110 of FIG. 3. As is shown in FIG. 11, in a case where ink has fixed by drying in the vicinity of the nozzle 110, ink within the cavity 141 is in a situation that it is trapped within the cavity 141. When ink dries and thickens in the vicinity of the nozzle 110 in this manner, the acoustic resistance r is thought to increase.

Figure 12:
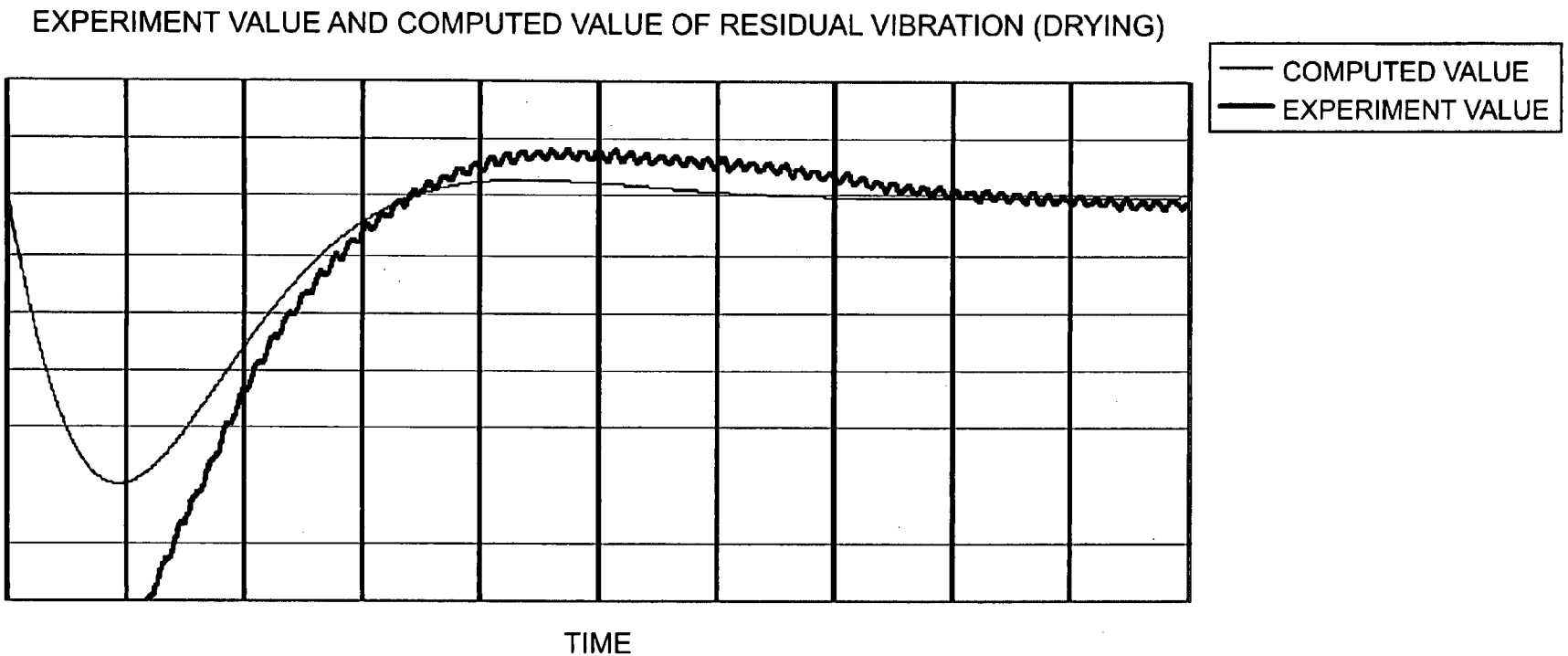
FIG. 12 is a graph showing the computed value and the experiment value of residual vibration in a state where ink has thickened by drying in the vicinity of the nozzle.

Hence, by setting the acoustic resistance r larger than in the case of FIG. 8 where ink is ejected normally, to be matched with the experiment value of the residual vibration in the case of fixing (thickening) of ink caused by drying in the vicinity of the nozzle 110, the result (graph) as shown in FIG. 12 was obtained. The experiment values shown in FIG. 12 are those obtained by measuring the residual vibration of the diaphragm 121 in a state that the head unit 35 was allowed to stand for a few days without attaching an unillustrated cap, so that ink could not be ejected because the ink had dried and thickened (ink had fixed) in the vicinity of the nozzle 110. As can be understood from the graphs of FIG. 8 and FIG. 12, in a case where ink has thickened by drying in the vicinity of the nozzle 110, a residual vibration waveform, characterized in that not only the frequency becomes extremely low compared with the case of normal ejection, but also the residual vibration is over-damped, is obtained. The reason for this is that when the diaphragm 121 moves upward in FIG. 3 after the diaphragm 121 is attracted downward in FIG. 3 in order to eject ink drops and ink thereby flows into the cavity 141 from the reservoir 143, there is no escape for ink within the cavity 141 and the diaphragm 121 suddenly becomes unable to vibrate anymore (is over-damped).

Figure 13:
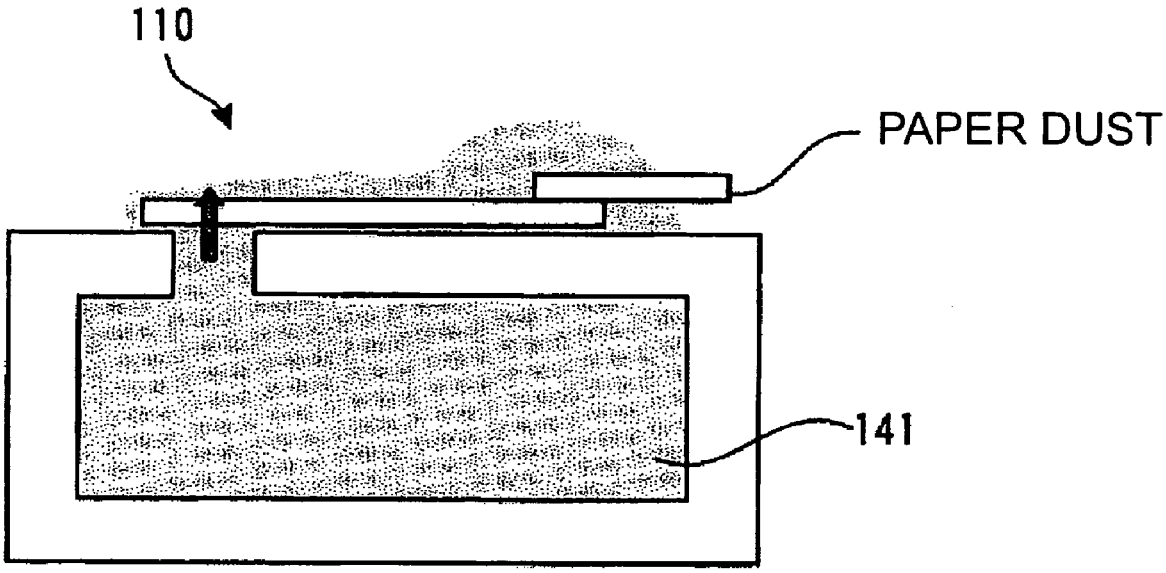
FIG. 13 is a conceptual view of the vicinity of the nozzle in a case where paper dust is adhering in the vicinity of the outlet of the nozzle of FIG. 3.

Next, adhesion of paper dust in the vicinity of the outlet of the nozzle 110, which is still another cause of the missing dot, will be described. FIG. 13 is a conceptual view in the vicinity of the nozzle 110 in the case of adhesion of paper dust in the vicinity of the outlet of the nozzle 110 of FIG. 3. As is shown in FIG. 13, in a case where paper dust is adhering in the vicinity of the outlet of the nozzle 110, not only ink seeps out from the cavity 141 through paper dust, but also it becomes impossible to eject ink through the nozzle 110. In a case where paper dust is adhering in the vicinity of the outlet of the nozzle 110 and ink seeps out from the nozzle 110 in this manner, a quantity of ink within the cavity 141 when viewed from the diaphragm 121 and ink seeping out is thought to increase compared with the normal state, which in turn causes the inertance m to increase. Also, fibers of the paper dust adhering in the vicinity of the outlet of the nozzle 110 are thought to cause the acoustic resistance r to increase.

Figure 14:
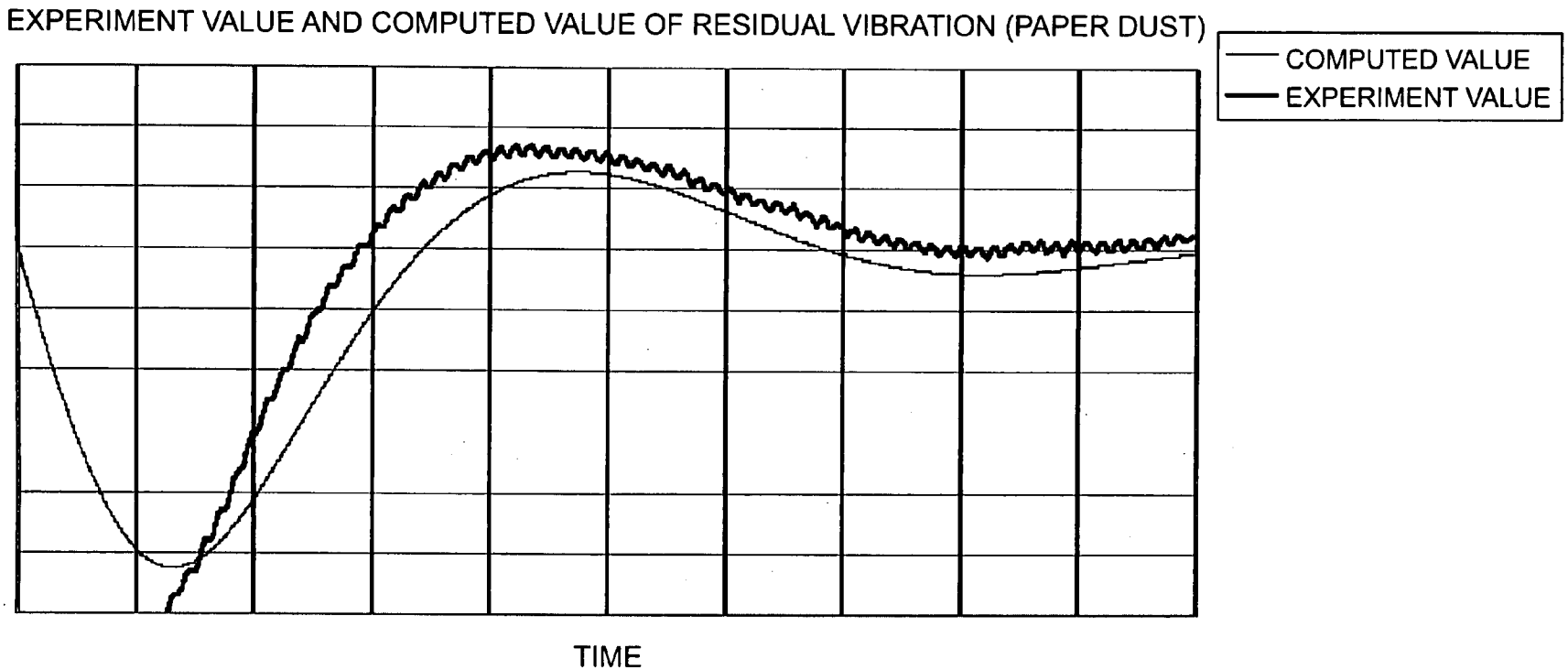
FIG. 14 is a graph showing the computed value and the experiment value of residual vibration in a state where paper dust is adhering to the outlet of the nozzle.
Figure 15B:
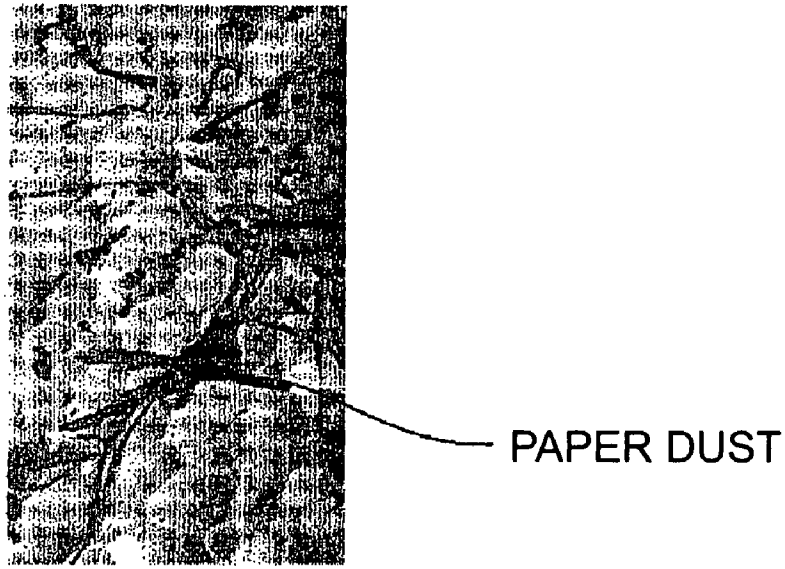
FIG. 15 shows pictures of the nozzle states before and after adhesion of paper dust in the vicinity of the nozzle.
Figure 15A:
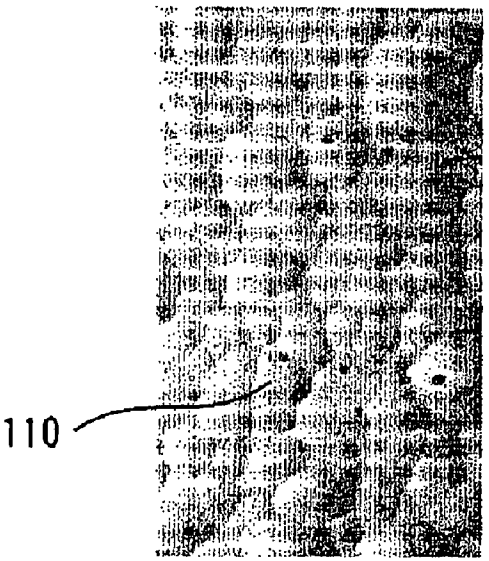

Hence, by setting both the inertance m and the acoustic resistance r larger than in the case of FIG. 8 where ink is ejected normally, to be matched with the experiment value of the residual vibration in the case of adhesion of paper dust in the vicinity of the outlet of the nozzle 110, the result (graph) as shown in FIG. 14 was obtained. As can be understood from the graphs of FIG. 8 and FIG. 14, in a case where paper dust is adhering in the vicinity of the outlet of the nozzle 110, a residual vibration waveform, characterized in that the frequency becomes lower than in the case of normal ejection, is obtained (it is also understood from the graphs of FIG. 12 and FIG. 14 that in the case of adhesion of paper dust, the frequency of the residual vibration is higher than in the case of thickening ink). FIG. 15 shows pictures of the states of the nozzle 110 before and after adhesion of paper dust. It can be seen from FIG. 15(*b*) that once paper dust adheres in the vicinity of the outlet of the nozzle 110, ink seeps out along the paper dust.

Note that in both the cases where ink has thickened by drying in the vicinity of the nozzle 110 and where paper dust is adhering in the vicinity of the outlet of the nozzle 110, the frequency of the damped vibration is lower than in the case where ink drops are ejected normally. Hence, a comparison is made, for example, with the frequency or the cycle (period) of the damped vibration, or with a predetermined threshold in the phase to identify these two causes of the missing dot (non-ejection of ink: ejection failure) from the waveform of the residual vibration of the diaphragm 121, or alternatively the causes can be identified from a change of the cycle of the residual vibration (damped vibration) or the damping rate of a change in amplitude. In this manner, an ejection failure of the respective ink jet heads 100 can be detected from a change of the residual vibration of the diaphragm 121, in particular, a change of the frequency thereof, when ink drops are ejected through the nozzles 110 of the respective ink jet heads 100. Also, by comparing the frequency of the residual vibration in this case with the frequency of the residual vibration in the case of normal ejection, the cause of the ejection failure can be identified.

Figure 16:
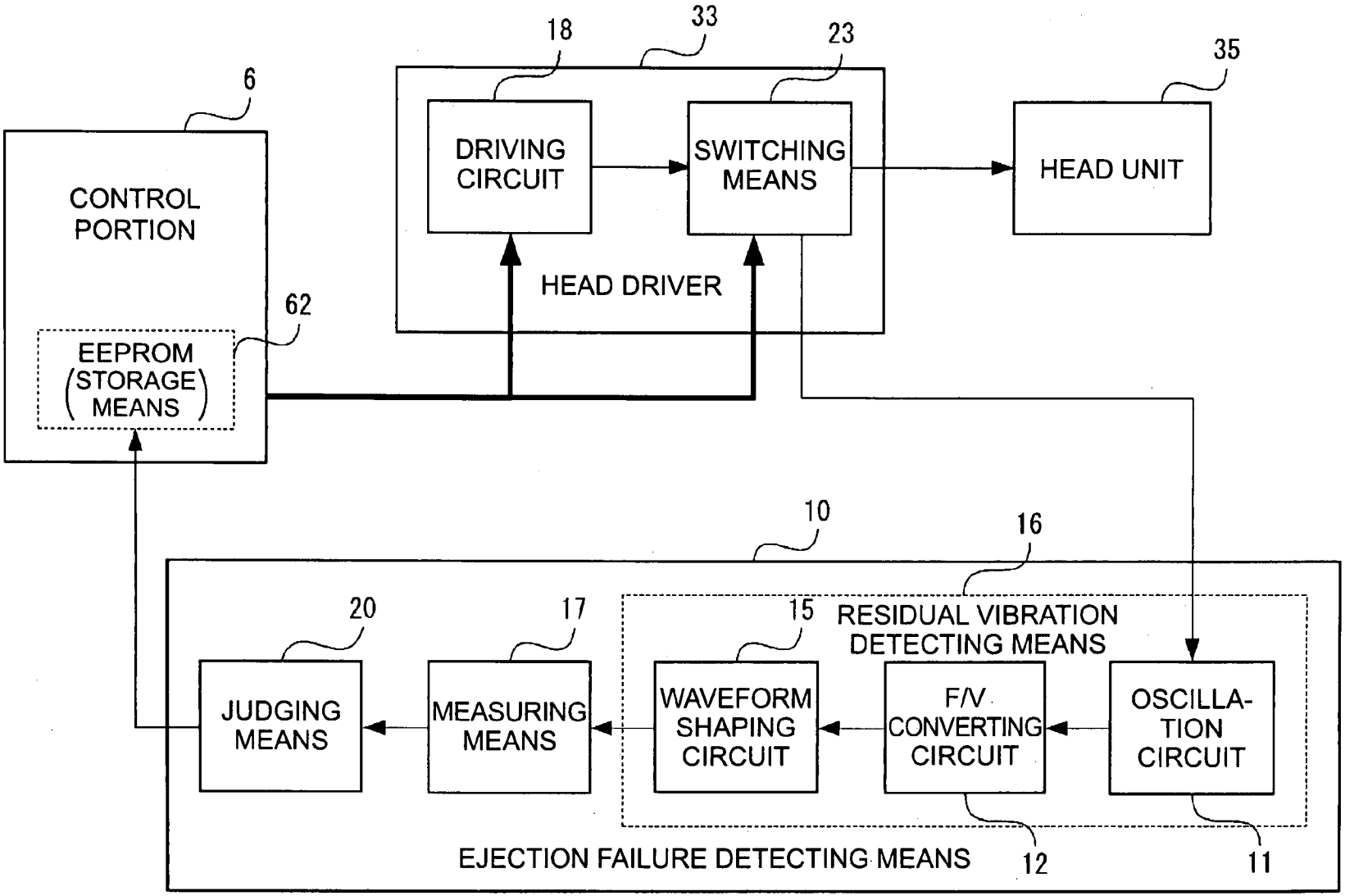
FIG. 16 is a schematic block diagram of ejection failure detecting means.

The ejection failure detecting device 10 will now be described. FIG. 16 is a schematic block diagram of the ejection failure detecting device 10 shown in FIG. 3. As is shown in FIG. 16, the ejection failure detecting device 10 is provided with residual vibration detecting means (device) 16 comprising an oscillation circuit 11, an F/V (frequency-to-voltage) converting circuit 12, and a waveform shaping circuit 15, measuring means (device) 17 for measuring the cycle or amplitude from the residual vibration waveform data detected in the residual vibration detecting device 16, and judging means (device) 20 for judging an ejection failure of the ink jet head 100 on the basis of the cycle or the like measured by the measuring device 17. In the ejection failure detecting device 10, the residual vibration detecting device 16 detects the vibration waveform, which is formed in the F/V converting circuit 12 and the waveform shaping circuit 15 from the oscillation frequency of the oscillation circuit 11 that oscillates on the basis of the residual vibration of the diaphragm 121 of the electrostatic actuator 120. The measuring device 17 then measures the cycle or the like of the residual vibration on the basis of the vibration waveform thus detected, and the judging device 20 detects and judges an ejection failure of the respective ink jet heads 100 provided to the respective head units 35 in the print device 3, on the basis of the cycle or the like of the residual vibration thus measured. In the following, respective components of the ejection failure detecting device 10 will be described.

Figure 17:
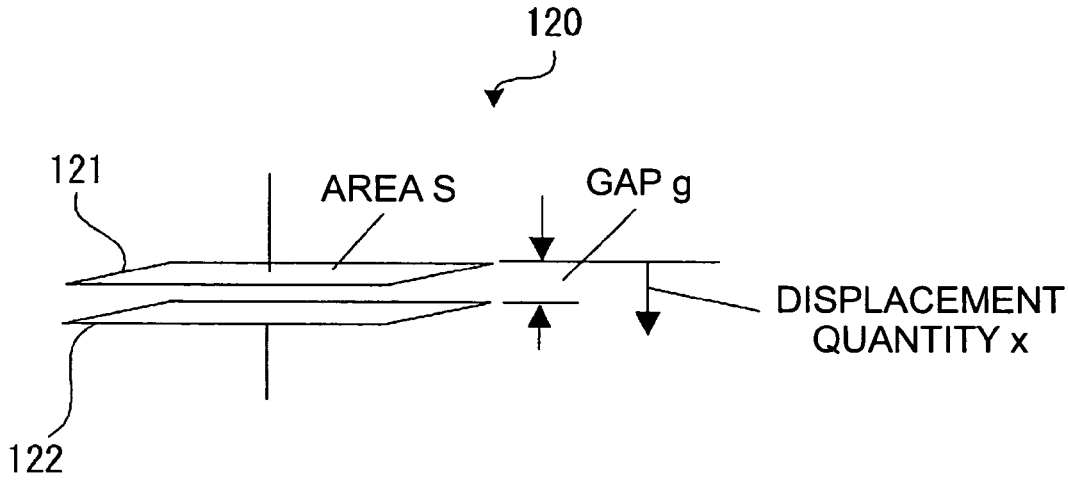
FIG. 17 is a conceptual view in a case where a parallel plate capacitor is used as an electrostatic actuator of FIG. 3.
Figure 18:
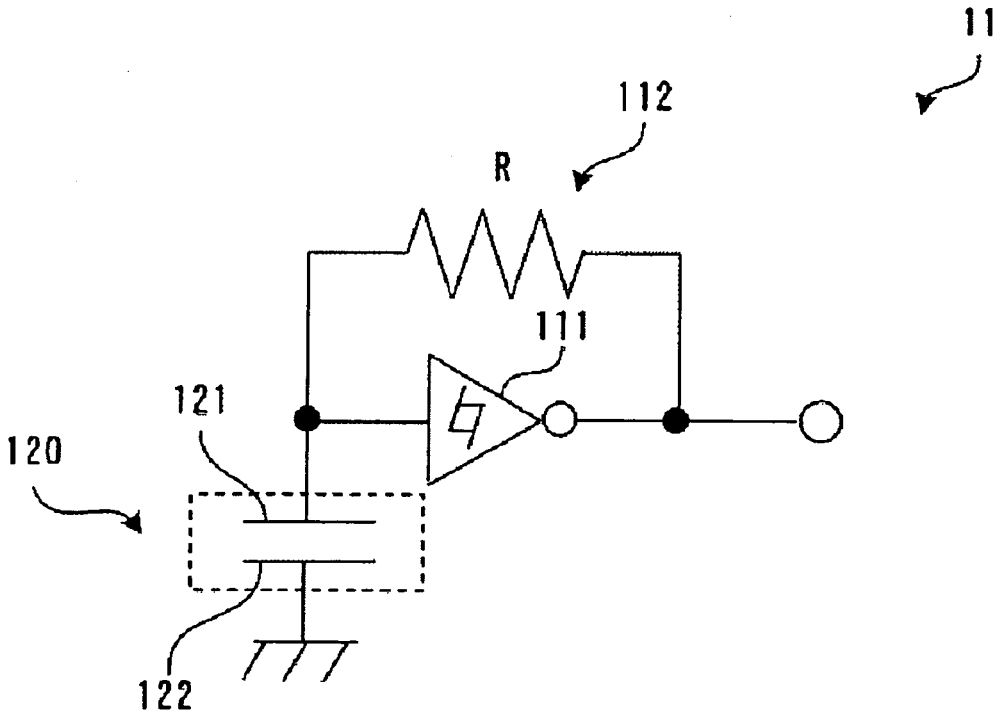
FIG. 18 is a circuit diagram of an oscillation circuit including a capacitor comprising the electrostatic actuator of FIG. 3.

First, a method of using the oscillation circuit 11 to detect the frequency (the number of vibration) of the residual vibration of the diaphragm 121 of the electrostatic actuator 120 will be described. FIG. 17 is a conceptual view in a case where a parallel plate capacitor is used as the electrostatic actuator 120 of FIG. 3. FIG. 18 is a circuit diagram of the oscillation circuit 11 including a capacitor comprising the electrostatic actuator 120 of FIG. 3. The oscillation circuit 11 shown in FIG. 18 is a CR oscillation circuit using the hysteresis characteristic of a schmitt trigger; however, in the invention, the oscillation circuit is not limited to such a CR oscillation circuit, and any oscillation circuit can be used provided that it is an oscillation circuit using electric capacitance components (capacitor C) of the actuator (including the diaphragm). The oscillation circuit 11 may comprise, for example, the one using an LC oscillation circuit. Also, this embodiment describes an example case using a schmitt trigger inverter; however, a CR oscillation circuit using inverters in three stages may be formed.

In the ink jet head 100 shown in FIG. 3, as has been described above, the diaphragm 121 and the segment electrode 122 spaced apart therefrom by an extremely small interval (clearance) together form the electrostatic actuator 120 that forms the counter electrodes. The electrostatic actuator 120 can be deemed as the parallel plate capacitor as shown in FIG. 17. Let C be the electric capacitance of the capacitor, S be the surface area of each of the diaphragm 121 and the segment electrode 122, g be a distance (gap length) between the two electrodes 121 and 122, and $\epsilon$ be a dielectric constant of the space (clearance) sandwiched by both electrodes (given $\epsilon_0$ as a dielectric constant in vacuum and $\epsilon_r$ as a specific dielectric constant in the clearance, then $\epsilon=\epsilon_0\cdot\epsilon_r$), then an electric capacitance C(x) of the capacitor (electrostatic actuator 120) shown in FIG. 17 can be expressed by the following equation.

(Mathematical Expression 4)

$$C(x) = \varepsilon_0 \cdot \varepsilon_r \frac{S}{g - x} \ (F) \tag{4}$$

As is shown in FIG. 17, x in Equation (4) above indicates a displacement quantity of the diaphragm 121 from the reference position thereof, caused by the residual vibration of the diaphragm 121.

As can be understood from Equation (4) above, the smaller the gap length g (gap length g—displacement quantity x), the larger the electric capacitance C(x) becomes, and conversely, the larger the gap length g (gap length g—displacement quantity x), the smaller the electric capacitance C(x) becomes. In this manner, the electric capacitance C(x) is inversely proportional to (gap length g—displacement quantity x)(the gap length g when x is 0). For the electrostatic actuator 120 shown in FIG. 3, a specific dielectric constant, $\epsilon_r$=1, because the clearance is fully filled with air.

Also, because ink drops (ink dots) to be ejected become finer with an increase of the resolution of the droplet ejection apparatus (the ink jet printer 1 in this embodiment), the electrostatic actuator 120 is increased in density and decreased in size. The surface area S of the diaphragm 121 of the ink jet head 100 thus becomes smaller and a smaller electrostatic actuator 120 is assembled. Further, the gap length g of the electrostatic actuator 120 that varies with the residual vibration caused by ink drop ejection is approximately one tenth of the initial gap $g_0$. Hence, as can be understood from Equation (4) above, a quantity of change of the electric capacitance of the electrostatic actuator 120 takes an extremely small value.

In order to detect a quantity of change of the electric capacitance of the electrostatic actuator 120 (varies with the vibration pattern of the residual vibration), a method as follows is used, that is, a method of forming an oscillation circuit as the one shown in FIG. 18 on the basis of the electric capacitance of the electrostatic actuator 120, and analyzing the frequency (cycle) of the residual vibration on the basis of the oscillation signal. The oscillation circuit 11 shown in FIG. 18 comprises a capacitor (C) composed of the electrostatic actuator 120, a schmitt trigger inverter 111, and a resistor element (R) 112.

When an output signal from the schmitt trigger inverter 111 is in the high level, the capacitor C is charged via the resistor element 112. When the charged voltage in the capacitor C (a potential difference between the diaphragm 121 and the segment electrode 122) reaches an input threshold voltage $V_T$+ of the schmitt trigger inverter 111, the output signal from the schmitt trigger inverter 111 inverts to a low level. Then, when the output signal from the schmitt trigger inverter 111 shifts to the low level, charges charged in the capacitor C via the resistor element 112 are discharged. The voltage of the capacitor C reaches the input threshold voltage $V_T$− of the schmitt trigger inverter 111 through this discharge, and the output signal from the schmitt trigger inverter 111 inverts again to the high level. Thereafter, this oscillation operation is performed repetitively.

In order to detect a change with time of the electric capacitance of the capacitor C in each of the aforementioned phenomena (intrusion of an air bubble, drying, adhesion of paper dust, and normal ejection), the oscillation frequency of the oscillation circuit 11 has to be set to an oscillation frequency at which the frequency in the case of intrusion of an air bubble (see FIG. 10), where the frequency of the residual vibration is the highest, can be detected. For this reason, the oscillation frequency of the oscillation circuit 11 has to be increased, for example, to a few or several tens of times or more than the frequency of the residual vibration to be detected, that is, it has to be one or more orders of magnitude higher than the frequency in the case of intrusion of an air bubble. In this case, it is preferable to set the oscillation frequency to an oscillation frequency at which the residual vibration frequency in the case of intrusion of an air bubble can be detected, because the frequency of the residual vibration in the case of intrusion of an air bubble shows a high frequency in comparison with the case of normal ejection. Otherwise, the frequency of the residual vibration cannot be detected accurately for the phenomenon of the ejection failure. In this embodiment, therefore, a time constant of the CR of the oscillation circuit 11 is set in response to the oscillation frequency. By setting the oscillation frequency of the oscillation circuit 11 high in this manner, it is possible to detect the residual vibration waveform accurately on the basis of a minute change of the oscillation frequency.

The digital information for each oscillation frequency can be obtained for the residual vibration waveform by counting pulses of the oscillation signal outputted from the oscillation circuit 11 in every cycle (pulse) of the oscillation frequency with the use of a measuring count pulse (counter), and by subtracting a count quantity of the pulses of the oscillation frequency when the oscillation circuit 11 is oscillated with an electric capacitance of the capacitor C at the initial gap go from the count quantity thus measured. By performing D/A (digital-to-analog) conversion on the basis of the digital information, a schematic residual vibration waveform can be generated. The method as described above may be used; however, the measuring count pulse (counter) of a type having a high frequency (high resolution) that can measure a minute change of the oscillation frequency is needed. Such a count pulse (counter) increases the cost, and for this reason, the ejection failure detecting device 10 uses the F/V converting circuit 12 shown in FIG. 19.

Figure 19:
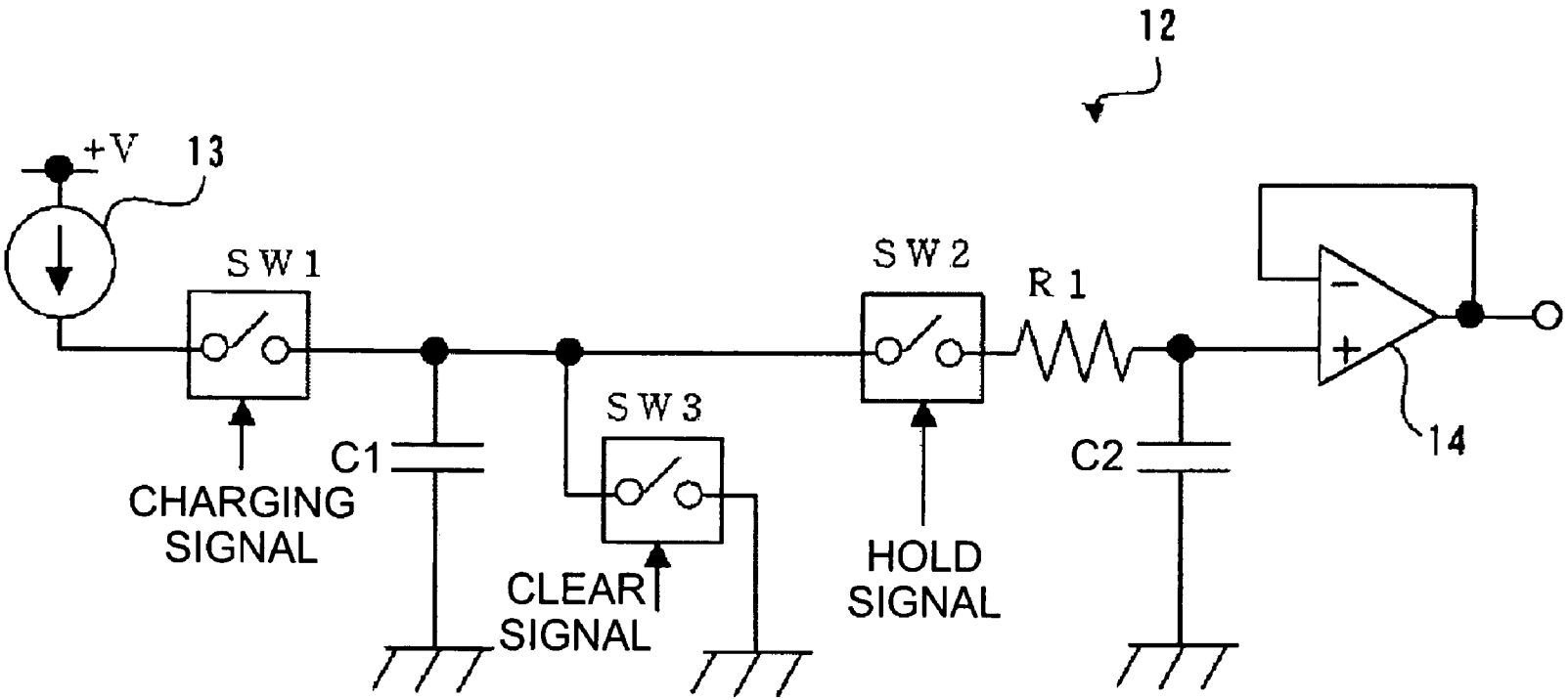
FIG. 19 is a circuit diagram of an F/V converting circuit in the ejection failure detecting means shown in FIG. 16.

FIG. 19 is a circuit diagram of the F/V converting circuit 12 in the ejection failure detecting device 10 shown in FIG. 16. As is shown in FIG. 19, the F/V converting circuit 12 comprises three switches SW1, SW2, and SW3, two capacitors C1 and C2, a resistor element R1, a constant current source 13 from which a constant current Is is outputted, and a buffer 14. The operation of the F/V converting circuit 12 will be described with the use of the timing chart of FIG. 20 and the graph of FIG. 21.

First, a method of generating a charging signal, a hold signal, and a clear signal shown in the timing chart of FIG. 20 will be described. The charging signal is generated in such a manner that a fixed time tr is set from the rising edge of the oscillation pulse of the oscillation circuit 11 and the signal remains in the high level for the fixed time tr. The hold signal is generated in such a manner that the signal rises in sync with the rising edge of the charging signal, and falls to the low level after it is held in the high level for a predetermined fixed time. The clear signal is generated in such a manner that the signal rises in sync with the falling edge of the hold signal and falls to the low level after it is held in the high level for a predetermined fixed time. As will be described below, because charges move from the capacitor C1 to the capacitor C2 and the capacitor C1 discharges instantaneously, in regard to pulses of the hold signal and the clear signal, it is sufficient for each signal to include one pulse until the following rising edge of the output signal from the oscillation circuit 11 comes, and the rising edge and the falling edge are not limited to those described above.

Figure 21:
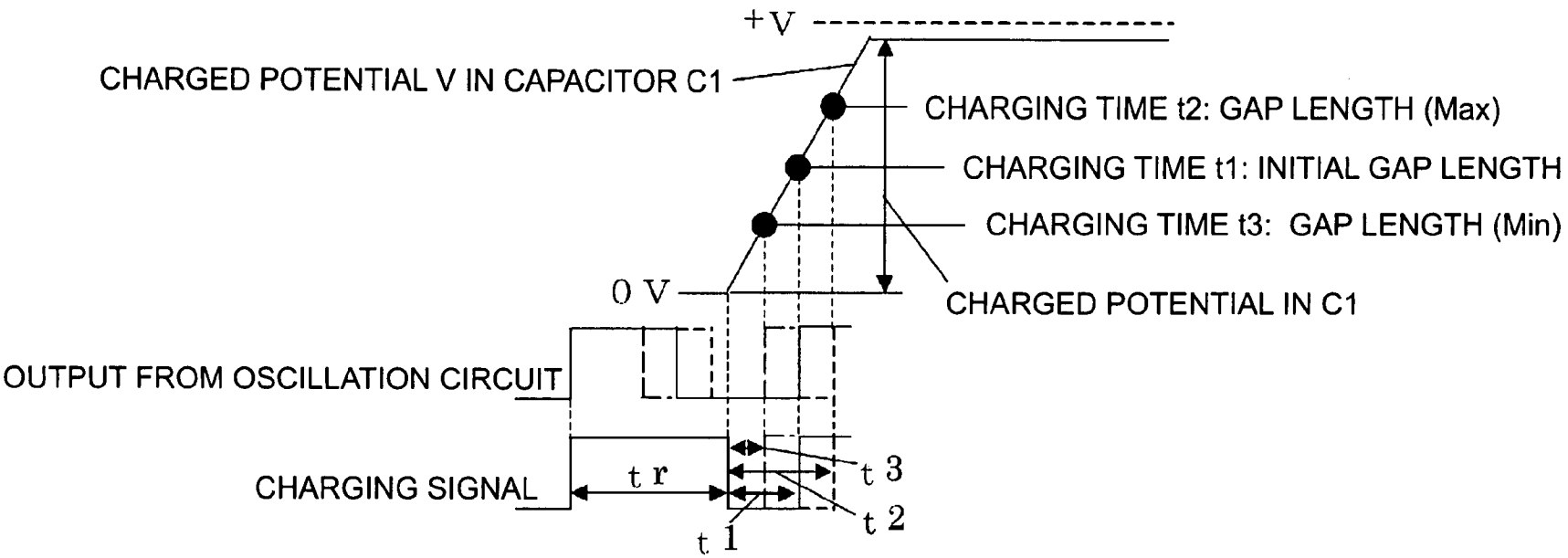
FIG. 21 is a view used to explain a setting method of fixed times tr and t1.

With reference to FIG. 21, a setting method of the fixed times tr and t1 in obtaining a sharp waveform (voltage waveform) of the residual vibration will be described. The fixed time tr is adjusted from the cycle of the oscillation pulse oscillated with the electric capacitance C when the electrostatic actuator 120 is at the initial gap length $g_0$, and is set so that a charged potential by the charging time t1 is about half the charging range of C1. Also, a gradient of the charged potential is set so as not to exceed the charging range of the capacitor C1 from a charging time t2 at the position at which the gap length g is the maximum (Max) to a charging time t3 at the position at which the gap length g is minimum (Min). In other words, because the gradient of the charged potential is determined by dV/dt=. Is/C1, it is sufficient to set the output constant current Is from the constant current source 13 to an adequate value. By setting the output constant current Is of the constant current source 13 as high as possible within the range, a minute change of the electric capacitance of the capacitor comprising the electrostatic actuator 120 can be detected with high sensitivity, which enables a minute change of the diaphragm 121 of the electrostatic actuator 120 to be detected.

Figure 22:
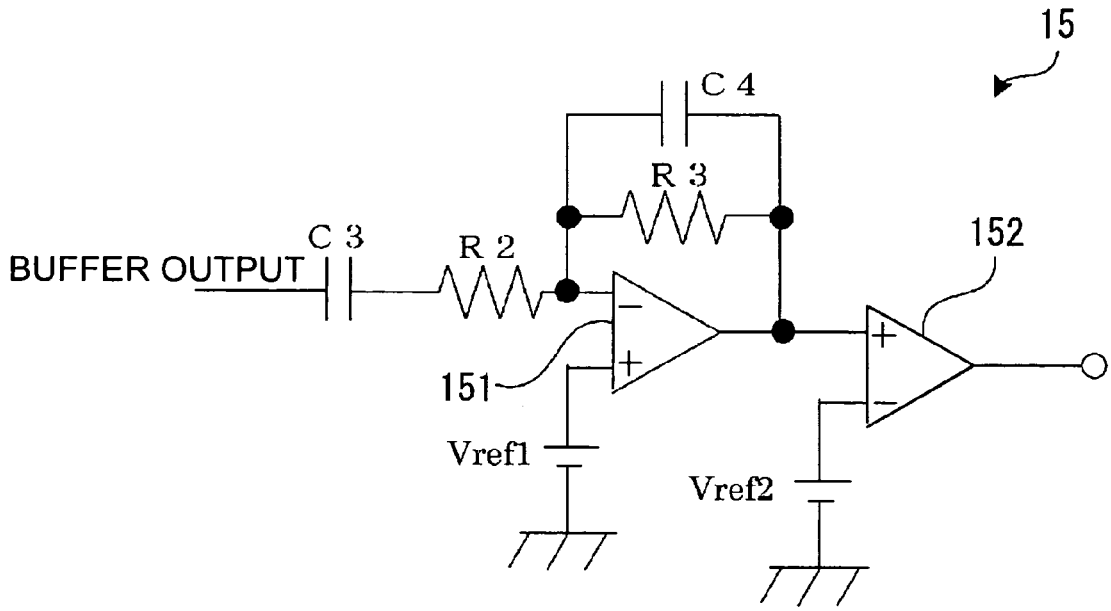
FIG. 22 is a circuit diagram showing the circuitry of a waveform shaping circuit of FIG. 16.

The configuration of the waveform shaping circuit 15 shown in FIG. 16 will now be described with reference to FIG. 22. FIG. 22 is a circuit diagram showing the circuitry of the waveform shaping circuit 15 of FIG. 16. The waveform shaping circuit 15 outputs the residual vibration waveform to the judging device 20 in the form of a rectangular wave. As is shown in FIG. 22, the waveform shaping circuit 15 comprises two capacitors C3 (DC component removing means) and C4, two resistor elements R2 and R3, two direct current voltage sources Vref1 and Vref2, an operational amplifier 151, and a comparator 152. The waveform shaping circuit 15 may be configured to measure the amplitude of the residual vibration waveform by outputting a wave height value detected in the waveform shaping processing of the residual vibration waveform intact.

The output from the buffer 14 in the F/V converting circuit 12 includes electric capacitance components of DC components (direct current components) based on the initial gap go of the electrostatic actuator 120. Because the direct current components vary with each ink jet head 100, the capacitor C3 is used to remove the direct current components of the electric capacitance. The capacitor C3 thus removes the DC components from an output signal from the buffer 14, and outputs only the AC components of the residual vibration to the inverting input terminal of the operational amplifier 151.

The operational amplifier 151 inverts and amplifies the output signal from the buffer 14 in the F/V converting circuit 12, from which the direct current components have been removed, and also forms a low-pass filter to remove a high band of the output signal. The operational amplifier 151 is assumed to be a single power source circuit. The operational amplifier 151 forms an inverting amplifier from the two resistor elements R2 and R3, and the residual vibration (alternating current components) inputted therein is therefore amplified by a factor of −R3/R2.

Also, because of the single power source operation, the operational amplifier 151 outputs an amplified residual vibration waveform of the diaphragm 121 that vibrates about the potential set by the direct current voltage source Vref1 connected to the non-inverting input terminal thereof. Here, the direct current voltage source Vref1 is set to about half the voltage range within which the operational amplifier 151 is operable with a single power source. Further, the operational amplifier 151 forms a low-pass filter, having a cut-off frequency of $1/(2\pi \times C4 \times R3)$, from the two capacitors C3 and C4. Then, as is shown in the timing chart of FIG. 20, the residual vibration waveform of the diaphragm 121, which is amplified after the direct current components are removed therefrom, is compared with the potential of the other direct current voltage source Vref2 in the comparator 152 in the following stage, and the comparison result is outputted from the waveform shaping circuit 15 in the form of a rectangular wave. The direct current voltage source Vref1 may be used commonly as the other direct current voltage source Vref2.

The operations of the F/V converting circuit 12 and the waveform shaping circuit 15 of FIG. 19 will now be described with reference to the timing chart shown in FIG. 20. The F/V converting circuit 12 shown in FIG. 19 operates according to the charging signal, the clear signal, and the hold signal generated as described above. Referring to the timing chart of FIG. 20, when the driving signal of the electrostatic actuator 120 is inputted into the ink jet head 100 via the head driver 33, the diaphragm 121 of the electrostatic actuator 120 is attracted toward the segment electrode 122 as shown in FIG. 6(*b*), and abruptly contracts upward in FIG. 6 in sync with the falling edge of the driving signal (see FIG. 6(*c*)).

A driving/detection switching signal that switches between the driving circuit 18 and the ejection failure detecting device 10 shifts to the high level in sync with the falling edge of the driving signal. The driving/detection switching signal is held in the high level during the driving halt period of the corresponding ink jet head 100, and shifts to the low level before the following driving signal is inputted. While the driving/detection switching signal remains in the high level, the oscillation circuit 11 of FIG. 18 keeps oscillating while changing the oscillation frequency in response to the residual vibration of the diaphragm 121 of the electrostatic actuator 120.

As has been described, the charging signal is held in the high level from the falling edge of the driving signal, that is, the rising edge of the output signal from the oscillation circuit 11 until the elapse of the fixed time tr, which is set in advance so that the waveform of the residual vibration will not exceed the chargeable range of the capacitor C1. It should be noted that the switch SW1 remains OFF while the charging signal is held in the high level.

When the fixed time tr elapses and the charging signal shifts to the low level, the switch SW1 is switched ON in sync with the falling edge of the charging signal (see FIG. 19). The constant current source 13 and the capacitor C1 are then connected to each other, and the capacitor C1 is charged with the gradient Is/C1 as described above. That is, the capacitor C1 is kept charged while the charging signal remains in the low level, that is, until it shifts to the high level in sync with the rising edge of the following pulse of the output signal from the oscillation circuit 11.

When the charging signal shifts to the high level, the switch SW1 is switched OFF (opens), and the constant current source 13 is isolated from the capacitor C1. In this instance, the capacitor C1 holds a potential charged during the period t1 during which the charging signal remained in the low level (that is, ideally speaking, Is×t1/C1(V)). When the hold signal shifts to the high level in this state, the switch SW2 is switched ON (see FIG. 19), and the capacitor C1 and the capacitor C2 are connected to each other via the resistor element R1. After the switch SW2 is connected, charging and discharging are performed due to a charged potential difference between the two capacitors C1 and C2, and the charges move from the capacitor C1 to the capacitor C2 so that the potential differences in the two capacitors C1 and C2 become almost equal.

Herein, the electric capacitance of the capacitor C2 is set to approximately one tenth or less of the electric capacitance of the capacitor C1. For this reason, a quantity of charges that move (are used) due to the charging and discharging caused by a potential difference between the two capacitors C1 and C2 is one tenth or less of the charges charged in the capacitor C1. Hence, after the charges moved from the capacitor C1 to the capacitor C2, a potential difference in the capacitor C1 varies little (drops little). In the F/V converting circuit 12 of FIG. 19, a primary low-pass filter is formed from the resistor element R1 and the capacitor C2 in preventing the charged potential from rising abruptly by the inductance or the like of the wiring in the F/V converting circuit 12 when the capacitor C2 is charged.

After the charged potential, which is almost equal to the charged potential in the capacitor C1, is held in the capacitor C2, the hold signal shifts to the low level, and the capacitor C1 is isolated from the capacitor C2. Further, when the clear signal shifts to the high level and the switch SW3 is switched ON, the capacitor C1 is connected to the ground GND, and a discharge operation is performed so that the charges charged in the capacitor C1 is reduced to 0. After the capacitor C1 is discharged, the clear signal shifts to the low level, and the switch SW3 is switched OFF, in response to which the electrode of the capacitor C1 at the top in FIG. 19 is isolated from the ground GND, and stands by until the following charging signal is inputted, that is, until the charging signal shifts to the low level.

The potential held in the capacitor C2 is updated at each rising time of the charging signal, that is, at each timing at which the charging to the capacitor C2 is completed, and is outputted to the waveform shaping circuit 15 of FIG. 22 in the form of the residual vibration waveform of the diaphragm 121 via the buffer 14. Hence, by setting the electric capacitance of the electrostatic actuator 120 (in this case, a variation width of the electric capacitance due to the residual vibration has to be taken into account) and the resistance value of the resistor element 112 so that the oscillation frequency of the oscillation circuit 11 becomes high, each step (step difference) in the potential in the capacitor C2 (output from the buffer 14) shown in the timing chart of FIG. 20 can be more in detail, which enables a change with time of the electric capacitance due to the residual vibration of the diaphragm 121 to be detected more in detail.

Thereafter, the charging signal repetitively shifts to the low level→high level→low level and so forth, and the potential held in the capacitor C2 is outputted at the predetermined timing to the waveform shaping circuit 15 via the buffer 14. In the waveform shaping circuit 15, the direct current components are removed by the capacitor C3 from the voltage signal (the potential in the capacitor C2 in the timing chart of FIG. 20) inputted from the buffer 14, and the resulting signal is inputted into the inverting input terminal of the operational amplifier 151 via the resistor element R2. The alternating current (AC) components of the residual vibration thus inputted are inverted and amplified in the operational amplifier 151, and outputted to one input terminal of the comparator 152. The comparator 152 compares the potential (reference voltage) set in advance by the direct current voltage source Vref2 with the potential of the residual vibration waveform (alternating current components), and outputs a rectangular wave (output from the comparator in the timing chart of FIG. 20).

Figure 23:
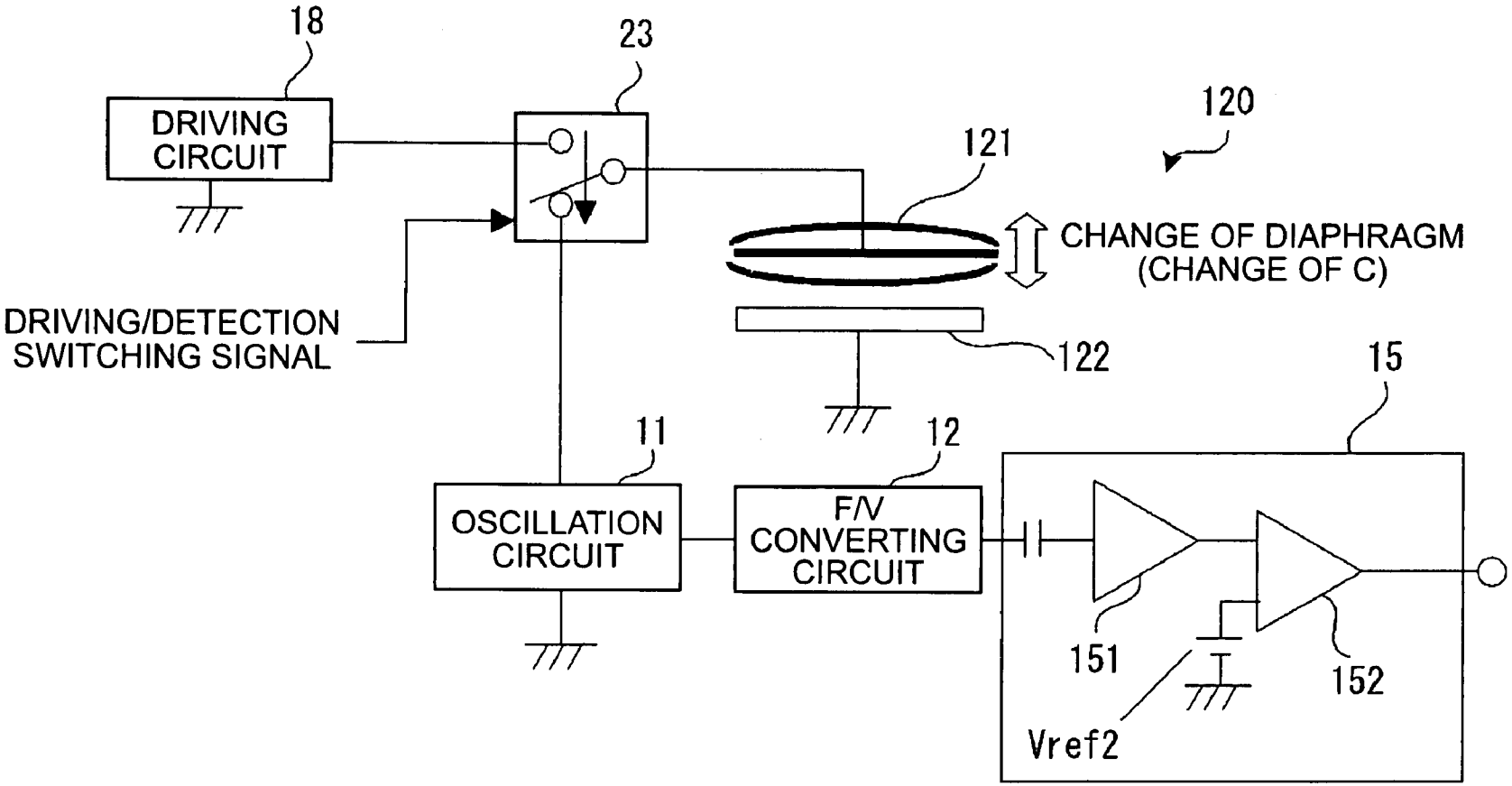
FIG. 23 is a block diagram schematically showing switching means switching between a driving circuit and a detection circuit.

The switching time between an ink drop ejection operation (driving) and an ejection failure detection operation (driving halt) of the ink jet head 100 will now be described. FIG. 23 is a block diagram schematically showing the switching device 23 switching between the driving circuit 18 and the ejection failure detecting device 10. Referring to FIG. 23, the driving circuit 18 in the head driver 33 shown in FIG. 16 will be described as the driving circuit of the ink jet head 100. As is shown in the timing chart of FIG. 20, the ejection failure detection processing is performed in a period between the driving signals of the ink jet head 100, that is, during the driving halt period.

Referring to FIG. 23, the switching device 23 is initially connected to the driving circuit 18 side to drive the electrostatic actuator 120. As has been described, when the driving signal (voltage signal) is inputted from the driving circuit 18 to the diaphragm 121, the electrostatic actuator 120 starts to be driven, and the diaphragm 121 is attracted toward the segment electrode 122. Then, when the applied voltage drops to 0, the diaphragm 121 displaces abruptly in a direction to move away from the segment electrode 122 and starts to vibrate (residual vibration). In this instance, ink drops are ejected through the nozzle 110 of the ink jet head 100.

When the pulse of the driving signal falls, the driving/detection switching signal is inputted into the switching device 23 in sync with the falling edge thereof (see the timing chart of FIG. 20), and the switching device 23 is switched from the driving circuit 18 to the ejection failure detecting device (detection circuit) 10 side, so that the electrostatic actuator 120 (used as the capacitor of the oscillation circuit 11) is connected to the ejection failure detecting device 10.

Then, the ejection failure detecting device 10 performs the detection processing of an ejection failure (missing dot) as described above, and converts the residual vibration waveform data (rectangular wave data) of the diaphragm 121 outputted from the comparator 152 in the waveform shaping circuit 15 into numerical forms, such as the cycle or the amplitude of the residual vibration waveform, with the use of the measuring device 17. In this embodiment, the measuring device 17 measures a particular vibration cycle from the residual vibration waveform data, and outputs the measurement result (numerical value) to the judging device 20.

To be more specific, in order to measure a time (cycle of the residual vibration) from the first rising edge to the following rising edge of the waveform (rectangular wave) of the output signal from the comparator 152, the measuring device 17 counts the pulses of the reference signal (predetermined frequency) with the use of an unillustrated counter, and measures the cycle (particular vibration cycle) of the residual vibration from the count value. Alternatively, the measuring device 17 may measure a time from the first rising edge to the following falling edge, and output a time two times longer than the measured time to the judging device 20 as the cycle of the residual vibration. Hereinafter, the cycle of the residual vibration obtained in either manner is referred to as Tw.

The judging device 20 judges the presence or absence of an ejection failure of the nozzle, the cause of the ejection failure, a comparative deviation, etc. on the basis of the particular vibration cycle (measurement result) of the residual vibration waveform measured by the measuring device 17, and outputs the judgment result to the control portion 6. The control portion 6 then saves the judgment result in a predetermined storage region of the EEPROM (storage means) 62. The driving/detection switching signal is inputted into the switching device 23 again at the timing at which the following driving signal from the driving circuit 18 is inputted, and the driving circuit 18 and the electrostatic actuator 120 are thereby connected to each other. Because the driving circuit 18 holds the ground (GND) level once the driving voltage is applied thereto, the switching device 23 performs the switching as described above (see the timing chart of FIG. 20). It is thus possible to detect the residual vibration waveform of the diaphragm 121 of the electrostatic actuator 120 accurately without being influenced by a disturbance or the like from the driving circuit 18.

In the invention, the residual vibration waveform data is not limited to that made into a rectangular wave by the comparator 152. For example, it may be arranged in such a manner that the residual vibration amplitude data outputted from the operational amplifier 151 is converted into numerical forms as needed in the measuring device 17 that performs the A/D (analog-to-digital) conversion, without performing the comparison processing by the comparator 152, then the presence or absence of an ejection failure or the like is judged by the judging device 20 on the basis of the data converted into the numerical forms in this manner, and the judgment result is stored into the storage device 62.

Also, because the meniscus (the surface on which ink within the nozzle 110 comes in contact with air) of the nozzle 110 vibrates in sync with the residual vibration of the diaphragm 121, the ink jet head 100 waits for the residual vibration of the meniscus to be damped by the acoustic resistance r in almost a determined time after the ink drops ejection operation (stand by for a predetermined time), and then starts the following ejection operation. In the invention, because the residual vibration of the diaphragm 121 is detected by effectively using this stand-by time, detection of an ejection failure can be performed without influencing the driving of the ink jet head 100. In other words, it is possible to perform the ejection failure detection processing of the nozzle 110 of the ink jet head 100 without reducing the throughput of the ink jet printer 1 (droplet ejection apparatus).

As has been described, in a case where an air bubble has intruded inside the cavity 141 of the ink jet head 100, because the frequency becomes higher than that of the residual vibration waveform of the diaphragm 121 in the case of normal ejection, the cycle thereof conversely becomes shorter than the cycle of the residual vibration in the case of normal ejection. Also, in a case where ink has thickened or fixed by drying in the vicinity of the nozzle 110, the residual vibration is over-damped. Hence, because the frequency becomes extremely low in comparison with the residual vibration waveform in the case of normal ejection, the cycle thereof becomes markedly longer than the cycle of the residual vibration in the case of normal ejection. Also, in a case where paper dust is adhering in the vicinity of the outlet of the nozzle 110, the frequency of the residual vibration is lower than the frequency of the residual vibration in the case of normal ejection and higher than the frequency of the residual vibration in the case of drying/thickening of ink. Hence, the cycle thereof becomes longer than the cycle of the residual vibration in the case of normal ejection and shorter than the cycle of the residual vibration in the case of drying of ink.

Hence, by setting a predetermined range Tr (upper limit Tru, lower limit Tr1) as the cycle of the residual vibration in the case of normal ejection, and by setting a predetermined threshold T1 to differentiate the cycle of the residual vibration in a case where paper dust is adhering to the outlet of the nozzle 110 from the cycle of the residual vibration in a case where ink has dried in the vicinity of the outlet of the nozzle 110, it is possible to determine the cause of such an ejection failure of the ink jet head 100. The judging device 20 judges the cause of an ejection failure depending on whether the cycle Tw of the residual vibration waveform detected in the ejection failure detection processing described above is a cycle within the predetermined range, and longer than the predetermined threshold.

Figure 24:
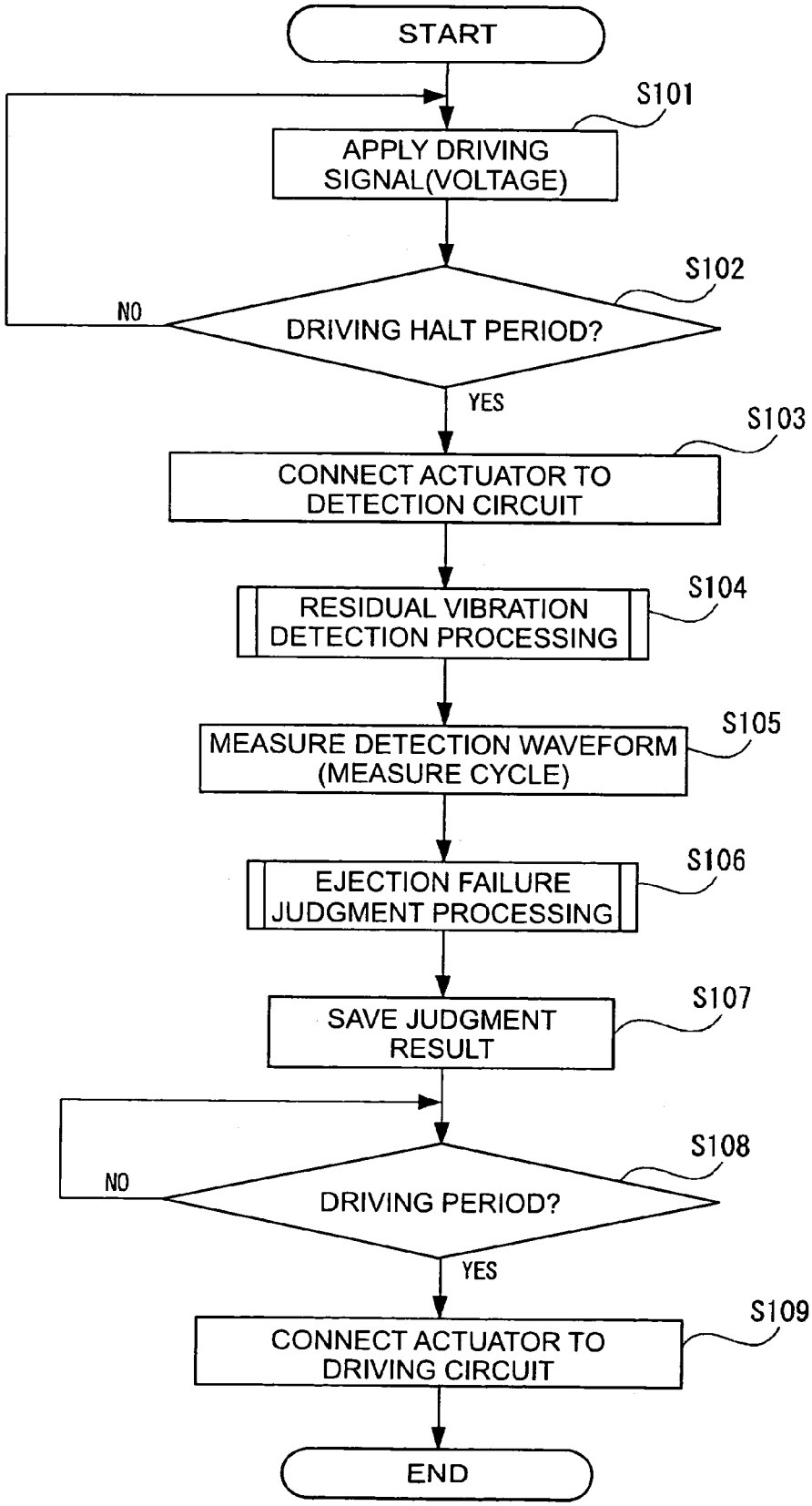
FIG. 24 is a flowchart detailing ejection failure detection and judgment processing.

The operation of the droplet ejection apparatus of the invention will now be described on the basis of the configuration of the ink jet printer 1 as described above. Firstly, the ejection failure detection processing (including the driving/detection switching processing) for the nozzle 110 of one ink jet head 100 will be described. FIG. 24 is a flowchart detailing the ejection failure detection and judgment process. When print data to be printed (or ejection data used for the flushing operation) is inputted into the control portion 6 from the host computer 8 via the interface (IF) 9, the ejection failure detection processing is performed at the predetermined timing. In the flowchart shown in FIG. 24, the ejection failure detection processing corresponding to an ejection operation of one ink jet head 100, that is one nozzle 110, will be detailed for ease of explanation.

Figure 20:
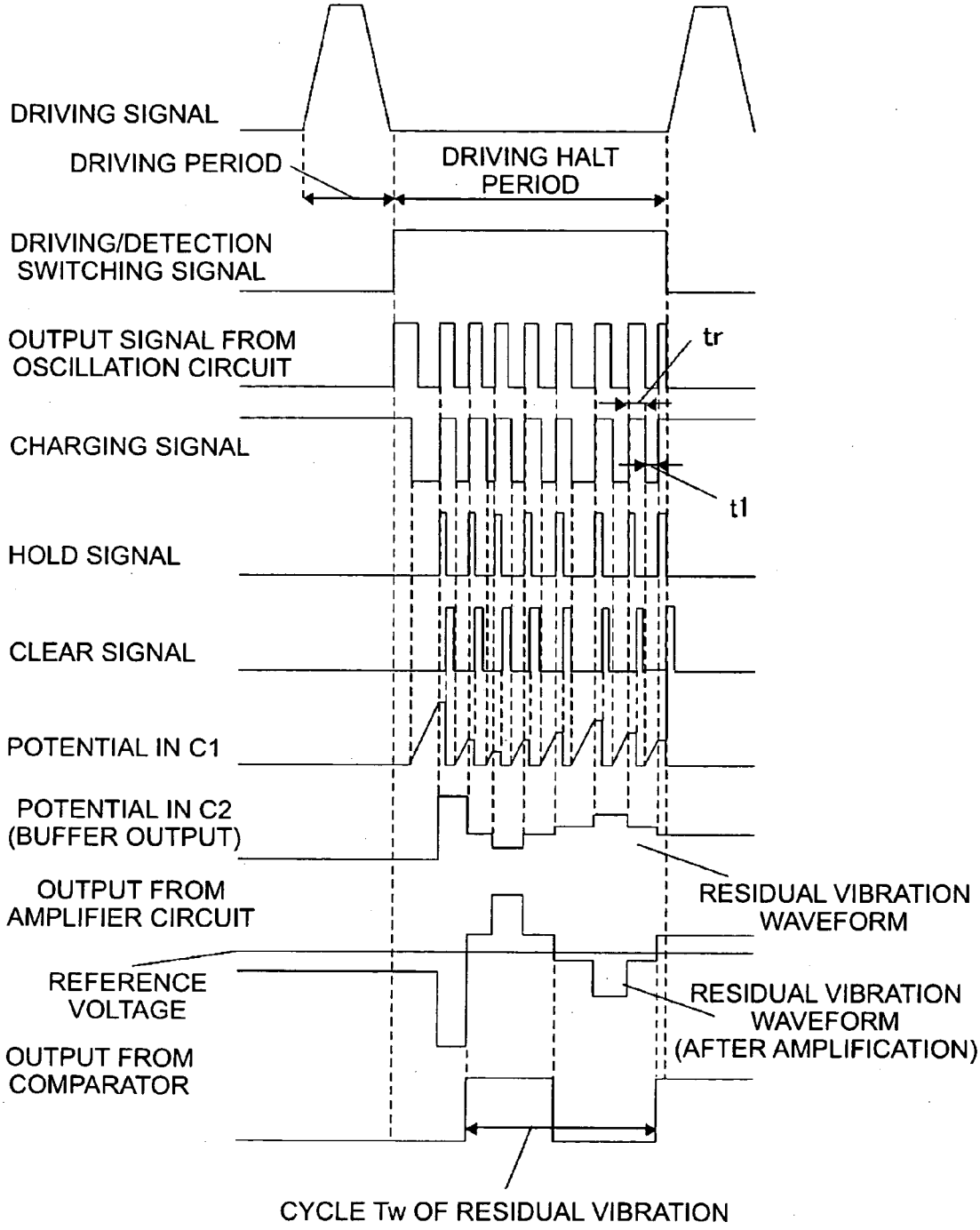
FIG. 20 is a timing chart showing the timing of output signals from respective portions based on an oscillation frequency outputted from the oscillation circuit.

Initially, the driving signal corresponding to the print data (ejection data) is inputted from the driving circuit 18 of the head driver 33, in response to which the driving signal (voltage signal) is applied between both electrodes of the electrostatic actuator 120 according to the timing of the driving signal as shown in the timing chart of FIG. 20 (Step S101). The control portion 6 then judges whether the ink jet head 100 that has ejected ink drops is in a driving halt period on the basis of the driving/detection switching signal (Step S102). At this point, the driving/detection switching signal shifts to the high level in sync with the falling edge of the driving signal (see FIG. 20), and is inputted into the switching device 23 from the control portion 6.

When the driving/detection switching signal is inputted into the switching device 23, the electrostatic actuator 120, that is, the capacitor forming the oscillation circuit 11, is isolated from the driving circuit 18 by the switching device 23, and is connected to the ejection failure detecting device 10 (detection circuit) side, that is, to the oscillation circuit 11 of the residual vibration detecting device 16 (Step S103). Subsequently, the residual vibration detection processing described below is performed (Step S104), and the measuring device 17 measures the predetermined numerical value from the residual vibration waveform data detected in the residual vibration detection processing (Step S105). In this instance, the measuring device 17 measures the cycle of the residual vibration from the residual vibration waveform data as described above.

Subsequently, the ejection failure judgment processing described below is performed by the judging device 20 on the basis of the measurement result by the measuring device (Step S106), and the judgment result is saved in the predetermined storage region in the EEPROM (storage means) 62 of the control portion 6 (Step S107). In subsequent Step S108, whether the ink jet head 100 is in the driving period is judged. In other words, whether the driving halt period has ended and the following driving signal is inputted is judged, and the flow is suspended in Step S108 until the following driving signal is inputted.

When the driving/detection switching signal shifts to the low level in sync with the rising edge of the driving signal at the timing at which the following driving signal is inputted (YES in Step S108), the switching device 23 switches the connection of the electrostatic actuator 120 from the ejection failure detecting device (detection circuit) 10 to the driving circuit 18 (Step S109), and ends the ejection failure detection processing.

The flowchart shown in FIG. 24 shows a case where the measuring device 17 measures the cycle from the residual vibration waveform detected in the residual vibration detection processing (the residual vibration detecting device 16); however, the invention is not limited to this case. For example, the measuring device 17 may measure a phase difference or amplitude of the residual vibration waveform from the residual vibration waveform data detected in the residual vibration detection processing.

Figure 25:
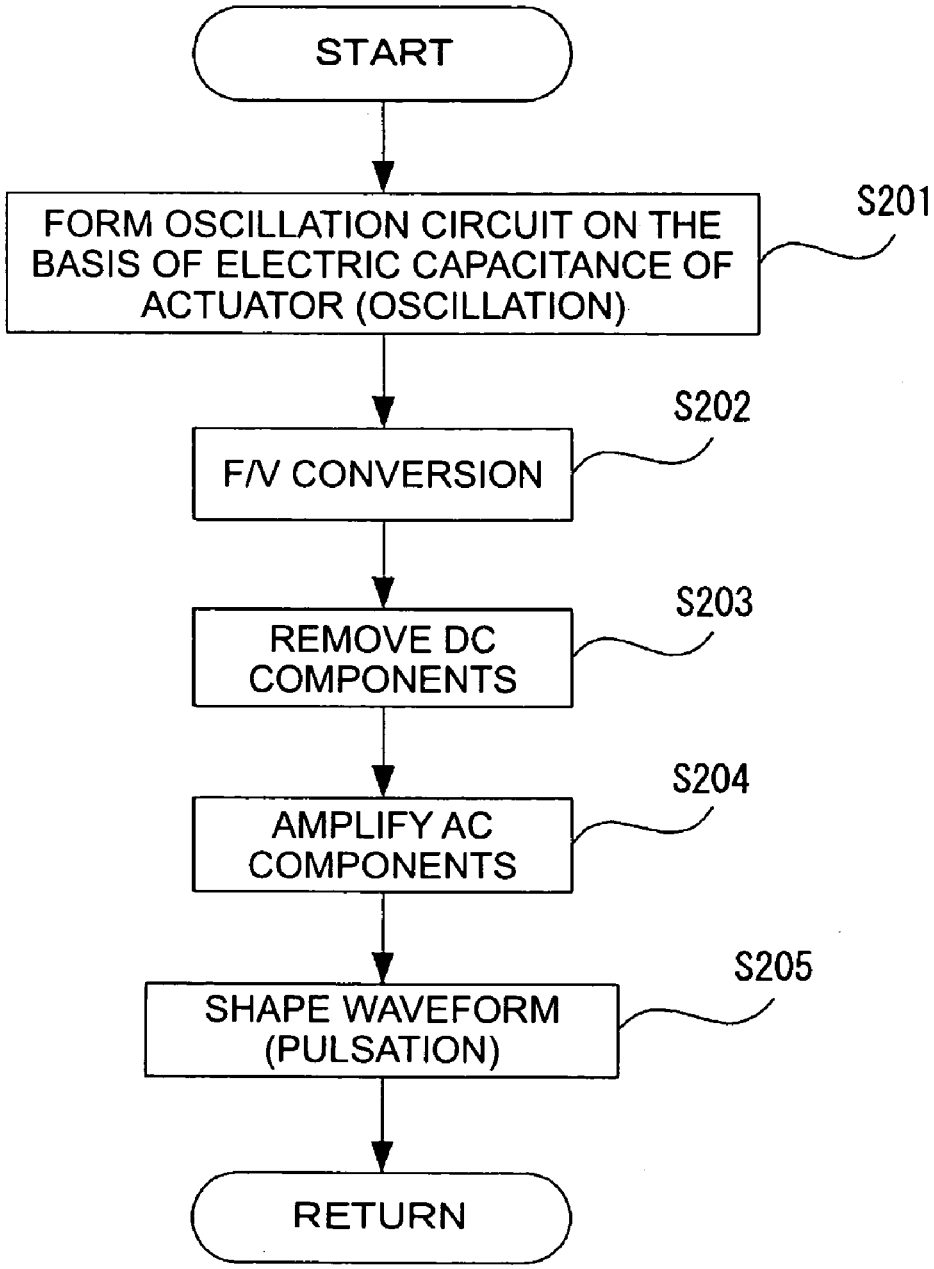
FIG. 25 is a flowchart detailing residual vibration detection processing.

The residual vibration detection processing (sub routine) in Step S104 of the flowchart shown in FIG. 24 will now be described. FIG. 25 is a flowchart detailing the residual vibration detection processing. When the electrostatic actuator 120 and the oscillation circuit 11 are connected to each other by the switching device 23 as described above (Step S103 of FIG. 24), the oscillation circuit 11 forms a CR oscillation circuit, and starts to oscillate in response to the change of the electric capacitance of the electrostatic actuator 120 (residual vibration of the diaphragm 121 of the electrostatic actuator 120) (Step S201).

As is shown in the timing chart described above, the charging signal, the hold signal, and the clear signal are generated in the F/V converting circuit 12 according to the output signal (pulse signal) from the oscillation circuit 11, and the F/V conversion processing is performed according to these signals by the F/V converting circuit 12, by which the frequency of the output signal from the oscillation circuit 11 is converted into a voltage (Step S202), and the residual vibration waveform data of the diaphragm 121 is outputted from the F/V converting circuit 12. The DC components (direct current components) are removed from the residual vibration waveform data outputted from the F/V converting circuit 12 in the capacitor C3 of the waveform shaping circuit 15 (Step S203), and the residual vibration waveform (AC components) from which the DC components have been removed is amplified in the operational amplifier 151 (Step S204).

The residual vibration waveform data after the amplification is subjected to waveform shaping in the predetermined processing and converted into pulses (Step S205). In other words, in this embodiment, the voltage value (predetermined voltage value) set by the direct current voltage source Vref2 is compared with the output voltage from the operational amplifier 151 in the comparator 152. The comparator 152 outputs the binarized waveform (rectangular wave) on the basis of the comparison result. The output signal from the comparator 152 is the output signal from the residual vibration detecting device 16, and is outputted to the measuring device 17 for the ejection failure judgment processing to be performed, upon which the residual vibration detection processing is completed.

Figure 26:
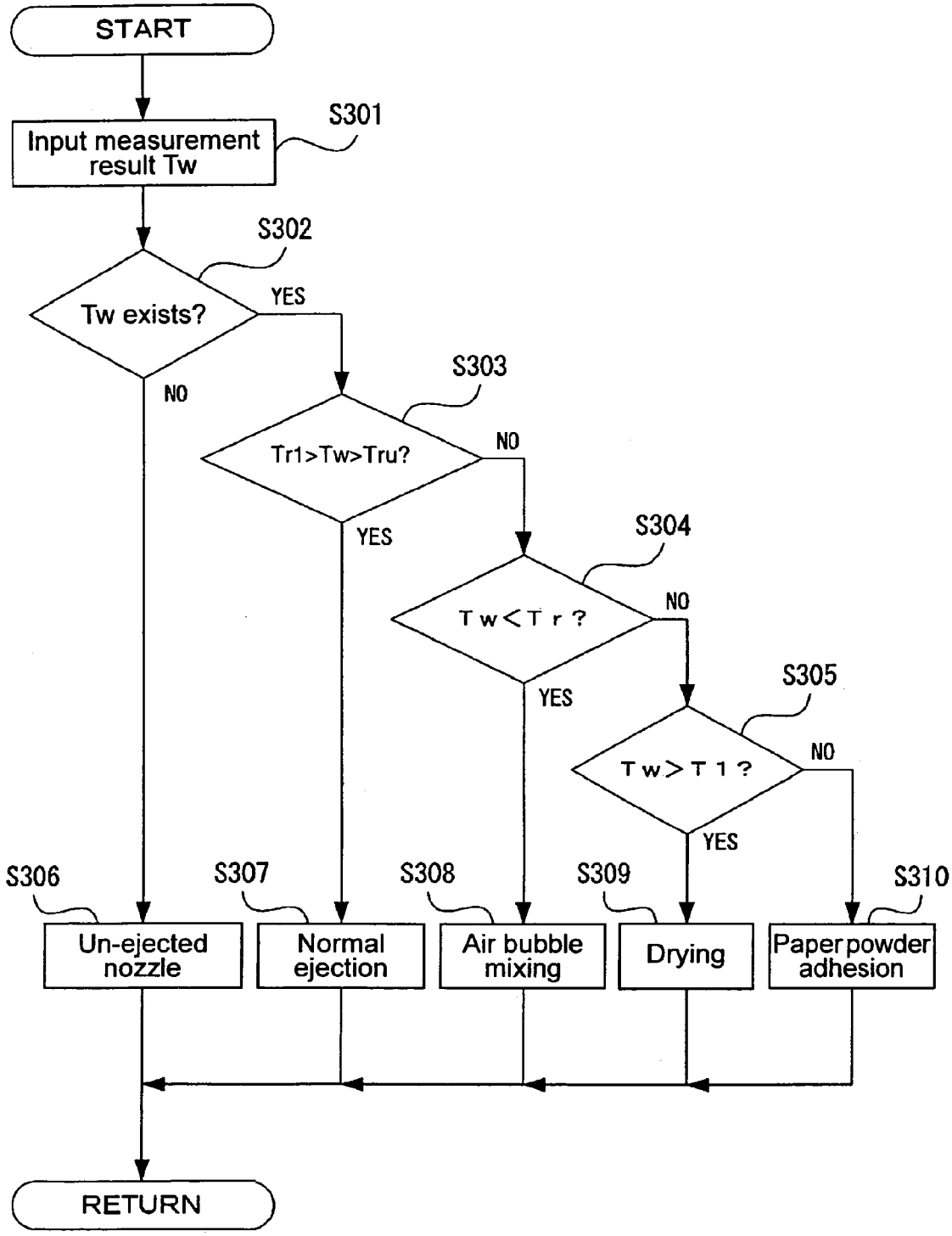
FIG. 26 is a flowchart detailing ejection failure judgment processing.

The ejection failure judgment processing (sub routine) in Step S106 of the flowchart shown in FIG. 24 will now be described. FIG. 26 is a flowchart detailing the ejection failure judgment processing performed by the control portion 6 and the judging device 20. The judging device 20 judges whether ink drops were ejected normally from the corresponding ink jet head 100 on the basis of the measurement data (measurement result), such as the cycle, measured by the measuring device 17 described above, and when ink drops were not ejected normally, that is, in the case of an ejection failure, it further judges the cause thereof.

Initially, the control portion 6 outputs the predetermined range Tr of the cycle of the residual vibration and the predetermined threshold T1 of the cycle of the residual vibration saved in the EEPROM 62 to the judging device 20. The predetermined range Tr of the cycle of residual vibration is the residual vibration cycle in the case of normal ejection given with an allowance (upper limit Tru, lower limit Tr1) for the cycle to be judged as normal. The data is stored in an unillustrated memory of the judging device 20, and the processing as follows is performed.

The measurement result measured in the measuring device 17 in Step S105 of FIG. 24 is inputted into the judging device 20 (Step S301). In this embodiment, the measurement result is the cycle Tw of the residual vibration of the diaphragm 121.

In Step S302, the judging device 20 judges whether the cycle Tw of the residual vibration is present, that is, whether the ejection failure detecting device 10 failed to obtain the residual vibration waveform data. Upon judging the absence of the cycle Tw of the residual vibration, the judging device 20 judges that the nozzle 110 of the ink jet head 100 in question is a not-yet-ejected nozzle that did not eject ink drops in the ejection failure detection processing (Step S306). Also, upon judging the presence of the residual vibration waveform data, the judging device 20 judges, in the following Step S303, whether the cycle Tw is within the predetermined range Tr that can be deemed as the cycle in the case of normal ejection.

When it is judged that the cycle Tw of the residual vibration is within the predetermined range Tr, it means that ink drops were ejected normally from the corresponding ink jet head 100. Hence, the judging device 20 judges that the nozzle 110 of the ink jet head 100 in question normally ejected ink drops (normal ejection) (Step S307). Also, when it is judged that the cycle Tw of the residual vibration is not within the predetermined range Tr, the judging device 20 judges, in the following Step S304, whether the cycle Tw of the residual vibration is shorter than the lower limit Tr1.

When it is judged that the cycle Tw of the residual vibration is shorter than the lower limit Tr1, it means that the frequency of the residual vibration is high and an air bubble is thought to have intruded inside the cavity 141 of the ink jet head 100 as described above. Hence, the judging device 20 judges that an air bubble has intruded inside the cavity 141 of the ink jet head 100 in question (intrusion of an air bubble) (Step S308).

When it is judged that the cycle Tw of the residual vibration is longer than the upper limit Tru, the judging device 20 subsequently judges whether the cycle Tw of the residual vibration is longer than the predetermined threshold T1(Step S305). When it is judged that the cycle Tw of the residual vibration is longer than the predetermined threshold T1, the residual vibration is thought to be over-damped. Hence, the judging device 20 judges that ink has thickened by drying in the vicinity of the nozzle 110 of the ink jet head 100 in question (drying) (Step S309).

When it is judged that the cycle Tw of the residual vibration is shorter than the predetermined threshold T1 in Step S305, the cycle Tw of the residual vibration takes a value that falls within the range satisfying the relation, Tru<Tw<T1, and as has been described above, paper dust is thought to be adhering in the vicinity of the outlet of the nozzle 110, in case of which the frequency is higher than in the case of drying. Hence, the judging device 20 judges that paper dust is adhering in the vicinity of the outlet of the nozzle 110 of the ink jet head 100 in question (adhesion of paper dust) (Step S310).

When normal ejection or the cause of an ejection failure of the target ink jet head 100 is judged by the judging device 20 (Steps S306 through S310) in this manner, the judgment result is outputted to the control portion 6, upon which the ejection failure judgment processing is completed.

On the assumption of the ink jet printer 1 provided with a plurality of ink jet heads (droplet ejection heads) 100, that is, a plurality of nozzles 110, ejection selecting means (nozzle selector) 182 of the ink jet printer 1 and the detection and judgment timing of an ejection failure for the respective ink jet heads 100 will now be described.

In the following, of a plurality of head units 35 provided to the print device 3, one head unit 35 will be described for ease of explanation, and it is assumed that the head unit 35 is provided with five ink jet heads 100*a* through 100*e* (that is, five nozzles 110). However, in the invention, the number of the head units 35 provided to the print device 3 and the number of the ink jet heads 100 (nozzles 110) provided to each head unit 35 are both arbitrary.

FIG. 27 through FIG. 30 are block diagrams showing some examples of the detection and judgment timing of an ejection failure in the ink jet printer 1 provided with the ejection selecting means (device) 182. Examples of the configuration in the respective drawings will now be described one by one.

Figure 27:
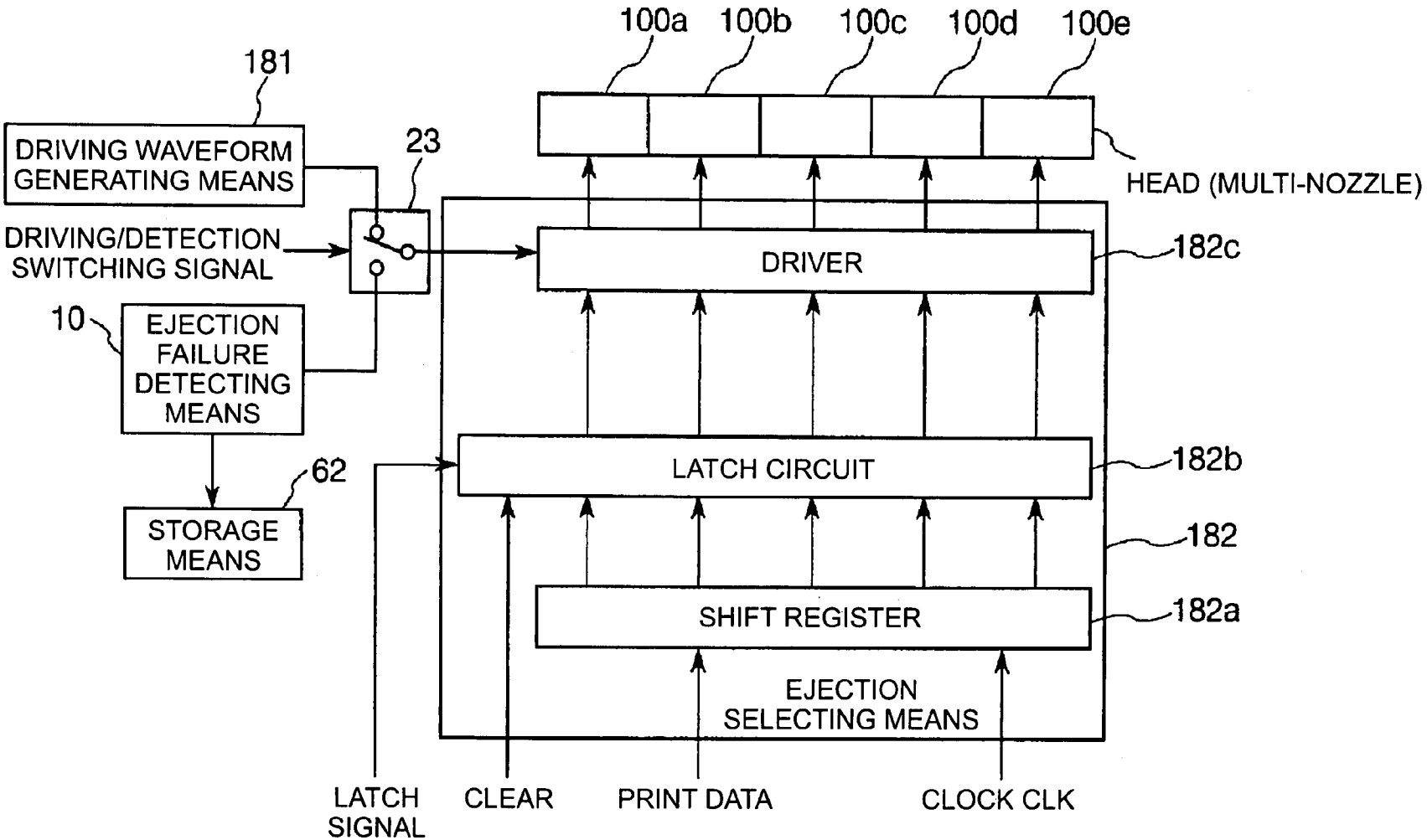
FIG. 27 shows one example of detection timing of an ejection failure for a plurality of ink jet heads (in a case where there is one ejection failure detecting means)

FIG. 27 shows one example of detection timing of an ejection failure for a plurality of (five) ink jet heads 100*a* through 100*e* (in a case where there is one ejection failure detecting device 10). As is shown in FIG. 27, the ink jet printer 1 having a plurality of ink jet heads 100*a* through 100*e* is provided with driving waveform generating means (device) 181 for generating a driving waveform, ejection selecting means 182 capable of selecting from which nozzle 110 ink drops are to be ejected, and a plurality of ink jet heads 100*a* through 100*e* selected by the ejection selecting means 182 and driven by the driving waveform generating means 181. Because the configuration of FIG. 27 is the same as those shown in FIG. 2, FIG. 16, and FIG. 23 except for the aforementioned configuration, the description of the same portion is omitted.

In this example, the driving waveform generating means 181 and the ejection selection means 182 are described as they are included in the driving circuit 18 of the head driver 33 (they are indicated as two blocks via the switching device 23 in FIG. 27; however, both of them are generally formed inside the head driver 33). The invention, however, is not limited to this configuration. For example, the driving waveform generating means 181 may be provided independently of the head driver 33.

As is shown in FIG. 27, the ejection selecting means 182 is provided with a shift register 182*a*, a latch circuit 182*b*, and a driver 182*c*. Print data (ejection data) outputted from the host computer 8 shown in FIG. 2 and underwent the predetermined processing in the control portion 6 as well as a clock signal (CLK) are sequentially inputted into the shift register 182*a*. The print data is shifted and inputted sequentially from the first stage to the latter stages in the shift register 182*a* in response to an input pulse of the clock signal (CLK) (each time the clock signal is inputted), and is then outputted to the latch circuit 182*b* as print data corresponding to the respective ink jet heads 100*a* through 100*e*. In the ejection failure detection processing described below, ejection data used at the time of flushing (preliminary ejection) is inputted instead of the print data. However, the ejection data referred to herein means print data for all the ink jet heads 100*a* through 100*e*. Alternatively, a value such that all the outputs from the latch circuit 182*b* will trigger ejection may be set by hardware at the time of flushing.

The latch circuit 182*b* latches the respective output signals from the shift register 182*a* by the latch signal inputted therein after print data corresponding to the number of the nozzles 110 of the head unit 35, that is, the number of the ink jet heads 100, is stored into the shift register 182*a*. In a case where a CLEAR signal is inputted, the latch state is released, and the output signal from the shift register 182*a* being latched becomes 0 (output of the latch is stopped), upon which the print operation is stopped. In a case where no CLEAR signal is inputted, the print data from the shift register 182*a* being latched is outputted to the driver 182*c*. After the print data outputted from the shift register 182*a* is latched in the latch circuit 182*b*, the following print data is inputted into the shift register 182*a*, so that the latch signal in the latch circuit 182*b* is successively updated at the print timing.

The driver 182*c* connects the driving waveform generating means 181 to the electrostatic actuators 120 of the respective ink jet heads 100, and inputs the output signal (driving signal) from the driving waveform generating means 181 to the respective actuators 120 specified (identified) by the latch signal outputted from the latch circuit 182*b* (any or all of the electrostatic actuators 120 of the ink jet heads 100*a* through 100*e*). The driving signal (voltage signal) is thus applied between both electrodes of the electrostatic actuator 120.

The ink jet printer 1 shown in FIG. 27 is provided with one driving waveform generating means 181 for driving a plurality of ink jet heads 100*a* through 100*e*, ejection failure detecting device 10 for detecting an ejection failure (ink drops non-ejection) for the ink jet head 100 in any of the respective ink jet heads 100*a* through 100*e*, storage device 62 for saving (storing) the judgment result, such as the cause of the ejection failure, obtained by the ejection failure detecting device 10, and one switching device 23 for switching between the driving waveform generating means 181 and the ejection failure detecting device 10. Hence, in this ink jet printer 1, one or more of the ink jet heads 100*a* through 100*e* selected by the driver 182*c* is driven according to the driving signal inputted from the driving waveform generating means 181, and the switching device 23 switches the connection of the electrostatic actuator 120 of the ink jet head 100 from the driving waveform generating means 181 to the ejection failure detecting device 10 when the driving/detection switching signal is inputted into the switching device 23 after the ejection driving operation. Then, the ejection failure detecting device 10 detects whether an ejection failure (ink drops non-ejection) exists in the nozzle 110 of the ink jet head 100 in question as well as judges the cause thereof in the event of ejection failure, on the basis of the residual vibration waveform of the diaphragm 121.

Also, in the ink jet printer 1, when an ejection failure is detected and judged for the nozzle 110 of one ink jet head 100, an ejection failure is detected and judged for the nozzle 110 of the ink jet head 100 specified next, according to the driving signal subsequently inputted from the driving waveform generating means 181. Thereafter, an ejection failure is detected and judged sequentially for the nozzles 110 of the ink jet heads 100 to be driven by an output signal from the driving waveform generating means 181 in the same manner. Then, as has been described above, when the residual vibration detecting device 16 detects the residual vibration waveform of the diaphragm 121, the measuring device 17 measures the cycle or the like of the residual vibration waveform on the basis of the waveform data thereof. The judging device 20 then judges normal ejection or an ejection failure on the basis of the measurement result in the measuring device 17, judges the cause of the ejection failure in the event of ejection failure (head failure), and outputs the judgment result to the storage device 62.

In this manner, because the ink jet printer 1 shown in FIG. 27 is configured in such a manner that an ejection failure is detected and judged sequentially for the respective nozzles 110 of a plurality of ink jet heads 100*a* through 100*e* during the ink drop ejection driving operation, it is sufficient to provide one ejection failure detecting device 10 and one switching device 23. Also, not only can the circuitry of the ink jet printer 1 capable of detecting and judging an ejection failure be scaled down, but also an increase of the manufacturing costs can be prevented.

Figure 28:
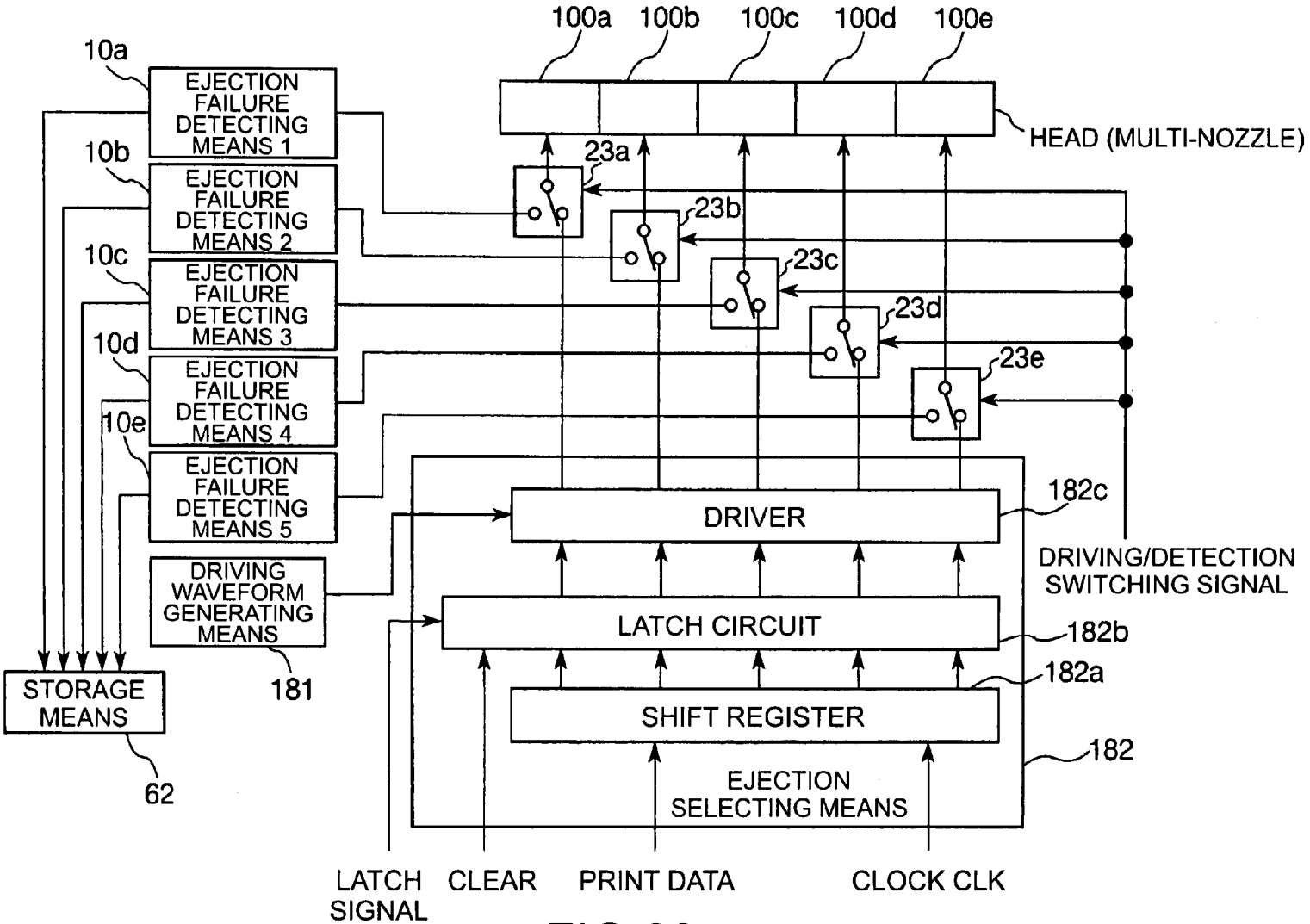
FIG. 28 shows one example of detection timing of an ejection failure for a plurality of ink jet heads (in a case where the number of the ejection failure detecting means is equal to the number of ink jet heads)

FIG. 28 shows one example of detection timing of an ejection failure for a plurality of ink jet heads 100 (in a case where the number of the ejection failure detecting device 10 is equal to the number of the ink jet heads 100). The ink jet printer 1 shown in FIG. 28 is provided with one ejection selecting means 182, five ejection failure detecting devices 10*a* through 10*e*, five switching devices 23*a* through 23*e*, one driving waveform generating means 181 common for five ink jet heads 100*a* through 100*e*, and one storage device 62. Because the respective components have been described with reference to FIG. 27, the description of these components is omitted and only the connections of these components will be described.

As with the case shown in FIG. 27, the ejection selecting means 182 latches print data corresponding to the respective ink jet heads 100*a* through 100*e* in the latch circuit 182*b* on the basis of the print data (ejection data) and the clock signal CLK inputted from the host computer 8, and drives the electrostatic actuators 120 of the ink jet heads 100*a* through 100*e* corresponding to the print data in response to the driving signal (voltage signal) inputted from the driving waveform generating means 181 into the driver 182*c*. The driving/detection switching signal is inputted into the respective switching device 23*a* through 23*e* corresponding to all the ink jet heads 100*a* through 100*e*. The switching devices 23*a* through 23*e* then input the driving signal into the electrostatic actuators 120 of the ink jet heads 100 according to the driving/detection switching signal regardless of the presence or absence of the corresponding print data (ejection data), after which they switch the connection of the ink jet heads 100 from the driving waveform generating means 181 to the ejection failure detecting devices 10*a* through 10*e*.

After an ejection failure is detected and judged for the respective ink jet heads 100*a* through 100*e* by all the ejection failure detecting devices 10*a* through 10*e*, the judgment results for all the ink jet heads 100*a* through 100*e* obtained in the detection processing are outputted to the storage device 62. The storage device 62 stores the presence or absence of an ejection failure and the cause of the ejection failure for the respective ink jet heads 100*a* through 100*e* into the predetermined saving region.

In this manner, in the ink jet printer 1 shown in FIG. 28, a plurality of ejection failure detecting devices 10*a* through 10*e* are provided for the respective nozzles 110 of a plurality of ink jet heads 100*a* through 100*e*, and an ejection failure is detected and the cause thereof is judged by performing the switching operation with the use of a plurality of switching devices 23*a* through 23*e* corresponding to the ejection failure detecting devices 10*a* through 10*e*. It is thus possible to detect an ejection failure and judge the cause thereof in a short time for all the nozzles 110 at a time.

Figure 29:
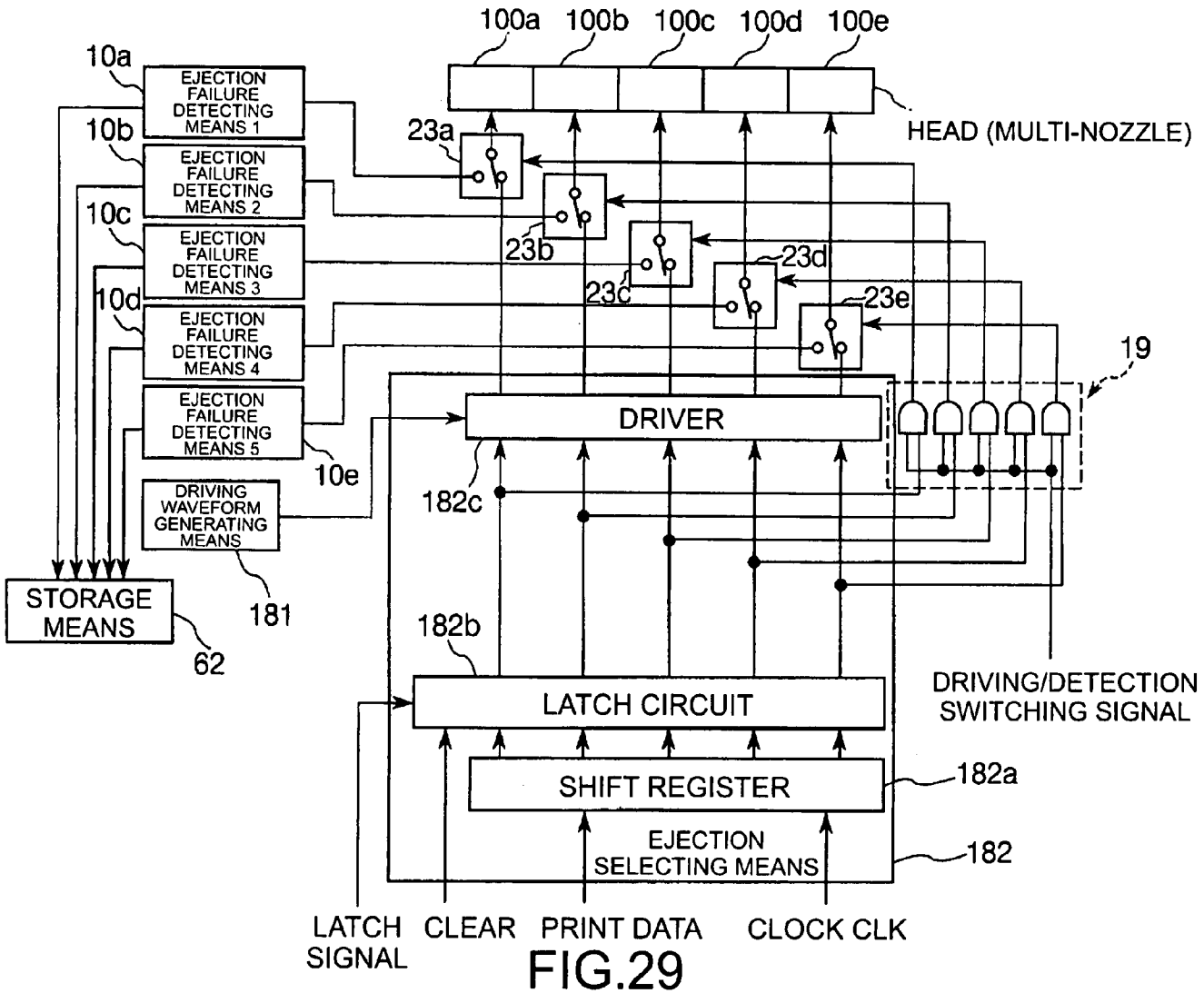
FIG. 29 shows one example of detection timing of an ejection failure for a plurality of ink jet heads (in a case where the number of the ejection failure detecting means is equal to the number of ink jet heads, and detection of an ejection failure is performed in the presence of print data)

FIG. 29 shows an example of detection timing of an ejection failure for a plurality of ink jet heads 100 (in a case where the number of the ejection failure detecting device 10 is equal to the number of the ink jet heads 100, and detection of an ejection failure is performed in the presence of print data). The ink jet printer 1 shown in FIG. 29 is of the same configuration as that of the ink jet printer 1 shown in FIG. 28 except that switching control means (device) 19 is added (appended). In this example, the switching control device 19 comprises a plurality of AND circuits (logical conjunction circuits) ANDa through ANDe, and upon input of the print data to be inputted into the respective ink jet heads 100*a* through 100*e* and the driving/detection switching signal, it outputs an output signal in the high level to the corresponding switching devices 23*a* through 23*e*. The switching control device 19 is not limited to AND circuits (logical conjunction circuits), and it only has to be formed in such a manner that it selects the switching device 23 that corresponds to an output from the latch circuit 182*b* selecting the ink jet head 100 to be driven.

The respective switching devices 23*a* through 23*e* switch the connection of the electrostatic actuators 120 of the corresponding ink jet heads 100*a* through 100*e* from the driving waveform generating means 181 to the corresponding ejection failure detecting devices 10*a* through 10*e*, according to the output signals from the corresponding AND circuits ANDa through ANDe of the switching control device 19. To be more specific, when the output signals from the corresponding AND circuits ANDa through ANDe are in the high level, in other words, in a case where print data to be inputted into the corresponding ink jet heads 100*a* through 100*e* is outputted from the latch circuit 182*b* to the driver 182*c* while the driving/detection switching signal remains in the high level, the switching devices 23*a* through 23*e* corresponding to the AND circuits in question switch the connections of the corresponding ink jet heads 100*a* through 100*e* from the driving waveform generating means 181 to the ejection failure detecting devices 10*a* through 10*e*.

After the presence or absence of an ejection failure for the respective ink jet heads 100 and the cause thereof in the event of ejection failure are detected by the ejection failure detecting devices 10*a* through 10*e* corresponding to the ink jet heads 100 into which the print data has been inputted, the corresponding ejection failure detecting device 10 output the judgment results obtained in the detection processing to the storage device 62. The storage device 62 stores one or more than one judgment result inputted (obtained) in this manner into the predetermined saving region.

In this manner, in the ink jet printer 1 shown in FIG. 29, a plurality of ejection failure detecting devices 10*a* through 10*e* are provided to correspond to the respective nozzles 110 of a plurality of ink jet heads 100*a* through 100*e*, and when print data corresponding to the respective ink jet heads 100*a* through 100*e* is inputted into the ejection selecting means 182 from the host computer 8 via the control portion 6, an ejection failure of the ink jet head 100 is detected and the cause thereof is judged by allowing any of the switching devices 23*a* through 23*e* specified by the switching control device 19 alone to perform the predetermined switching operation. Hence, the detection and judgment processing is not performed for the ink jet heads 100 that have not performed the ejection driving operation. It is thus possible to avoid useless detection and judgment processing in this ink jet printer 1.

Figure 30:
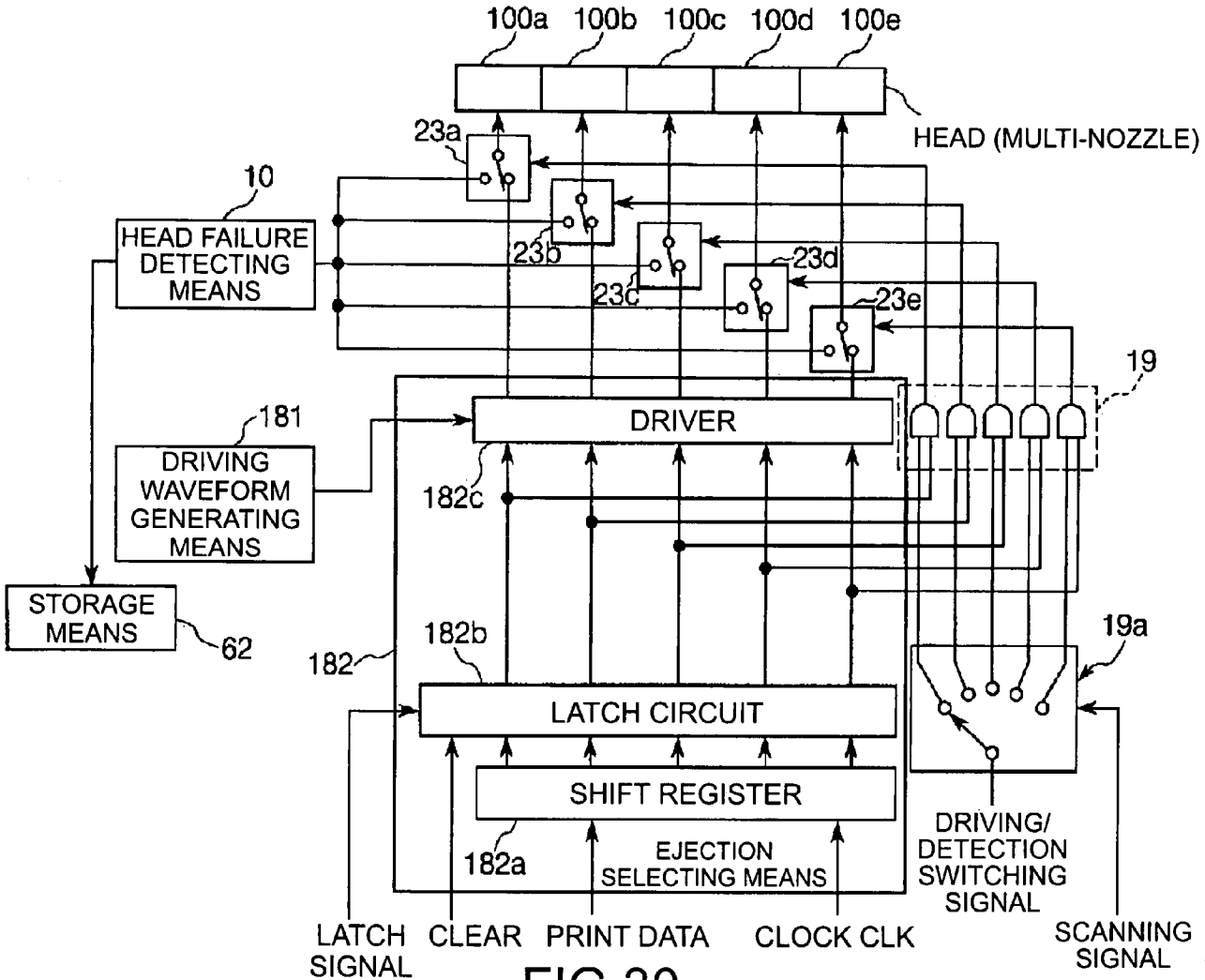
FIG. 30 shows one example of detection timing of an ejection failure for a plurality of ink jet heads (in a case where the number of the ejection failure detecting means is equal to the number of ink jet heads, and detection of an ejection failure is performed by making rounds at the respective ink jet heads)

FIG. 30 shows one example of the detection timing of an ejection failure for a plurality of ink jet heads 100 (in a case where the number of the ejection failure detecting devices 10 is equal to the number of the ink jet heads 100, and detection of an ejection failure is performed by making rounds at the respective ink jet heads 100). The ink jet printer 1 shown in FIG. 30 is of the same configuration as that of the ink jet printer 1 shown in FIG. 29 except that there is one ejection failure detecting device 10 and switching selecting device 19*a* for scanning the driving/detection switching signal (identifying the ink jet heads 100 one by one for which the detection and judgment processing is to be performed).

The switching selecting device 19*a* is connected to the switching control device 19 shown in FIG. 29, and is a selector that scans (selects and switches) the input of the driving/detection switching signal into the AND circuits ANDa through ANDe corresponding to a plurality of ink jet heads 100*a* through 100*e*, according to a scanning signal (selection signal) inputted from the control portion 6. The scanning (selection) order of the switching selecting device 19*a* may be the same as the order of print data inputted into the shift register 182*a*, that is, the order of ejection by a plurality of ink jet heads 100; however, it may simply be the order of a plurality of ink jet heads 100*a* through 100*e*.

In a case where the scanning order is the order of print data inputted into the shift register 182*a*, when the print data is inputted into the shift register 182*a* of the ejection selecting means 182, the print data is latched in the latch circuit 182*b*, and outputted to the driver 182*c* upon the input of the latch signal. The scanning signal to identify the ink jet head 100 corresponding to the print data is inputted into the switching selecting device 19*a* in sync with the input of the print data into the shift register 182*a* or the input of the latch signal into the latch circuit 182*b*, and the driving/detection switching signal is outputted to the corresponding AND circuit. The output terminal of the switching selecting device 19*a* outputs a low level when no selection is made.

The corresponding AND circuit (switching control device (means) 19) performs the logical operation AND of the print data inputted from the latch circuit 182*b* and the driving/detection switching signal inputted from the switching selecting device 19*a*, and thereby outputs an output signal in the high level to the corresponding switching device 23. Upon input of the output signal in the high level from the switching control device 19, the switching device 23 switches the connection of the electrostatic actuator 120 of the corresponding ink jet head 100 from the driving waveform generating means 181 to the ejection failure detecting device 10.

The ejection failure detecting device 10 then detects an ejection failure of the ink jet head 100 into which the print data has been inputted, and judges the cause thereof in the event of ejection failure, after which it outputs the judgment result to the storage device 62. The storage device 62 stores the judgment result inputted (obtained) in this manner into the predetermined saving region.

In a case where the scanning order is simply the order of the ink jet heads 100*a* through 100*e*, when the print data is inputted into the shift register 182*a* of the ejection selecting means 182, the print data is latched in the latch circuit 182*b*, and outputted to the driver 182*c* upon the input of the latch signal. The scanning (selection) signal to identify the ink jet head 100 corresponding to the print data is inputted into the switching selecting device 19*a* in sync with the input of the print data into the shift register 182*a* or the input of the latch signal into the latch circuit 182*b*, and the driving/detection switching signal is outputted to the corresponding AND circuit of the switching control device 19.

When the print data corresponding to the ink jet head 100 determined by the scanning signal inputted into the switching selecting device 19*a* is inputted into the shift register 182*a*, the output signal from the corresponding AND circuit (switching control device (means) 19) shifts to the high level, and the switching device 23 switches the connection of the corresponding ink jet head 100 from the driving waveform generating means 181 to the ejection failure detecting device 10. However, when no print data is inputted into the shift register 182*a*, the output signal from the AND circuit remains in the low level, and the corresponding switching device 23 does not perform the predetermined switching operation. Hence, the ejection failure detection processing of the ink jet head 100 is performed on the basis of the AND of the selection result by the switching selecting device 19*a* and the result specified by the switching control device 19.

When the switching operation is performed by the switching device 23, the ejection failure detecting device 10 detects an ejection failure of the ink jet head 100 into which the print data has been inputted and judges the cause thereof in the event of ejection failure in the same manner as above, after which it outputs the judgment result to the storage device 62. The storage device 62 stores the judgment result inputted (obtained) in this manner into the predetermined saving region.

When there is no print data corresponding to the ink jet head 100 specified by the switching selecting device 19*a*, the corresponding switching device 23 does not perform the switching operation as described above, and for this reason, it is not necessary for the ejection failure detecting device 10 to perform the ejection failure detection processing; however, such processing may be performed as well. In a case where the ejection failure detection processing is performed without performing the switching operation, as is detailed in the flowchart of FIG. 26, the judging device 20 of the ejection failure detecting device 10 judges that the nozzle 110 of the corresponding ink jet head 100 as being a not-yet ejected nozzle (Step S306), and stores the judgment result into the predetermined saving region of the storage device 62.

In this manner, the ink jet printer 1 shown in FIG. 30 is different from the ink jet printer 1 shown in FIG. 28 or FIG. 29 in that only one ejection failure detecting device 10 is provided for the respective nozzles 110 of a plurality of ink jet heads 100*a* through 100*e*, and because the print data corresponding to the respective ink jet heads 100*a* through 100*e* is inputted into the ejection selecting means 182 from the host computer 8 via the control portion 6 while only the switching device 23, corresponding to the ink jet head 100 identified by the scanning (selection) signal to perform the ejection driving operation in response to the print data, performs the switching operation, so that an ejection failure is detected and the cause thereof is judged only for the corresponding ink jet head 100. This eliminates the need to process a large volume of detection results at one time, and thereby reduces the load on the CPU 61 of the control portion 6. Also, because the ejection failure detecting device 10 makes rounds at nozzle states other than the ejection operation, it is possible to keep track of an ejection failure of each nozzle while being driven for printing, and the state of the nozzles 110 in the entire head unit 35 can be known. Because an ejection failure is detected periodically, this can reduce, for example, the steps of detecting an ejection failure nozzle by nozzle while the printing is halted. In view of the foregoing, it is possible to efficiently detect an ejection failure of the ink jet head 100 and judge the cause thereof.

Also, in contrast to the ink jet printer 1 shown in FIG. 28 or FIG. 29, the ink jet printer 1 shown in FIG. 30 only has to be provided with one ejection failure detecting device 10, and in comparison with the ink jet printers 1 shown in FIG. 28 and FIG. 29, not only can the circuitry of the ink jet printer 1 be scaled down, but also an increase of the manufacturing costs can be prevented.

The operations of the ink jet printers 1 shown in FIG. 27 through FIG. 30, that is, the ejection failure detection processing (chiefly, detection timing) in the ink jet printer 1 provided with a plurality of ink jet heads 100, will now be described. In the ejection failure detection and judgment processing (multi-nozzle processing), the residual vibration of the diaphragm 121 when the electrostatic actuators 120 of the respective ink jet heads 100 perform the ink drop ejection operation is detected, and the occurrence of an ejection failure (missing dot, ink drop non-ejection) is judged for the ink jet head 100 in question on the basis of the cycle of the residual vibration; moreover, in the event of a missing dot (ink drop non-ejection), the cause thereof is judged. In this manner, in the invention, when the ejection operation of ink drops (droplets) by the ink jet heads 100 is performed, the detection and judgment processing for the ink jet heads 100 can be performed. However, the ink jet heads 100 eject ink drops not only when the printing (print) is actually performed on a recording sheet P, but also when the flushing operation (preliminary ejection or preparatory ejection) is performed. Hereinafter, the ejection failure detection and judgment processing (multi-nozzle) in these two cases will be described.

The flushing (preliminary ejection) processing referred to herein is defined as a head cleaning operation by which ink drops are ejected through all or only target nozzles 110 of the head unit 35 while a cap not shown in FIG. 1 is attached or in a place where ink drops (droplets) do not reach the recording sheet P (media). The flushing process (flushing operation) is performed, for example, when ink within the cavities 141 is discharged periodically to maintain the viscosity of ink in the nozzles 110 at a value within an adequate range, or as a recovery operation when ink has thickened. Further, the flushing process is also performed when the respective cavities 141 are initially filled with ink after the ink cartridges 31 are attached to the print device 3.

A wiping process (processing by which build-ups (paper dust or dust) adhering on the head surface of the print device 3 are wiped off by a wiper not shown in FIG. 1) may be performed to clean the nozzle plate (nozzle surface) 150. In this instance, however, a negative pressure may be produced inside the nozzles 110 and ink of other colors (droplets of other kinds) may be sucked therein. Hence, the flushing operation is performed after the wiping process in order to force a predetermined quantity of ink drops to be ejected through all the nozzles 110 of the head unit 35. Further, the flushing process may be performed from time to time in order to ensure satisfactory printing by maintaining the meniscus of the nozzles 110 in a normal state.

Figure 31:
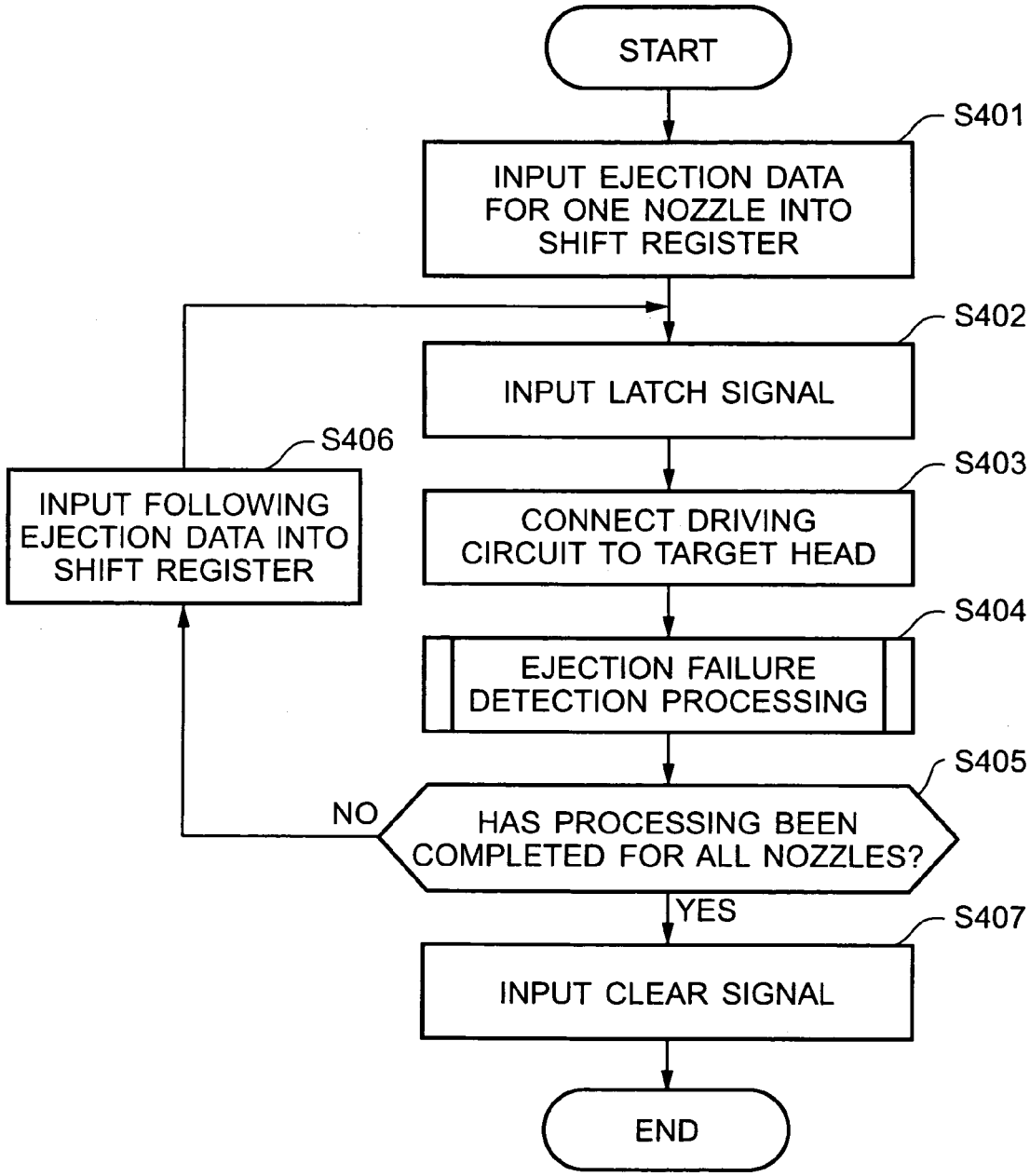
FIG. 31 is a flowchart detailing the detection timing of an ejection failure during a flushing operation by the ink jet printer shown in FIG. 27.

First, the ejection failure detection and judgment processing during the flushing process will be described with reference to flowcharts shown in FIG. 31 through FIG. 33. These flowcharts will be explained with reference to the block diagrams of FIG. 27 through FIG. 30 (the same can be said in the print operations below). FIG. 31 is a flowchart detailing the detection timing of an ejection failure during the flushing operation by the ink jet printer 1 shown in FIG. 27.

When the flushing process of the ink jet printer 1 is performed at the predetermined timing, the ejection failure detection and judgment processing shown in FIG. 31 is performed. The control portion 6 inputs ejection data for one nozzle into the shift register 182*a* of the ejection selecting means 182 (Step S401), then the latch signal is inputted into the latch circuit 182*b* (Step S402), and the ejection data is thus latched. In this instance, the switching device 23 connects the electrostatic actuator 120 of the ink jet head 100, the target of the ejection data, to the driving waveform generating means 181 (Step S403).

Subsequently, the ejection failure detection and judgment processing detailed in the flowchart of FIG. 24 is performed for the ink jet head 100 that has performed the ink ejection operation, by the ejection failure detecting device 10 (Step S404). In Step S405, the control portion 6 judges whether the ejection failure detection and judgment processing has been completed for all the nozzles 110 of the ink jet heads 100*a* through 100*e* in the ink jet printer 1 shown in FIG. 27, on the basis of the ejection data outputted to the ejection selecting means 182. Upon judging that the processing is not completed for all the nozzles 110, the control portion 6 inputs the ejection data corresponding to the nozzle 110 of the following ink jet head 100 into the shift register 182*a* (Step S406). The control portion 6 then returns to Step S402 and repeats the processing in the same manner.

Also, upon judging in Step S405 that the ejection failure detection and judgment processing described above is completed for all the nozzles 110, the control portion 6 releases the latch circuit 182*b* from the latch state by inputting a CLEAR signal into the latch circuit 182*b*, and ends the ejection failure detecting and judgment processing in the ink jet printer 1 shown in FIG. 27.

As has been described, because the detection circuit comprises one ejection failure detecting device 10 and one switching device 23 for the ejection failure detection and judgment processing in the printer 1 shown in FIG. 27, the ejection failure detection processing and judgment processing is repeated as many times as the number of the ink jet heads 100; however, there is an advantage that the circuit forming the ejection failure detecting device 10 is increased little in size.

Figure 32:
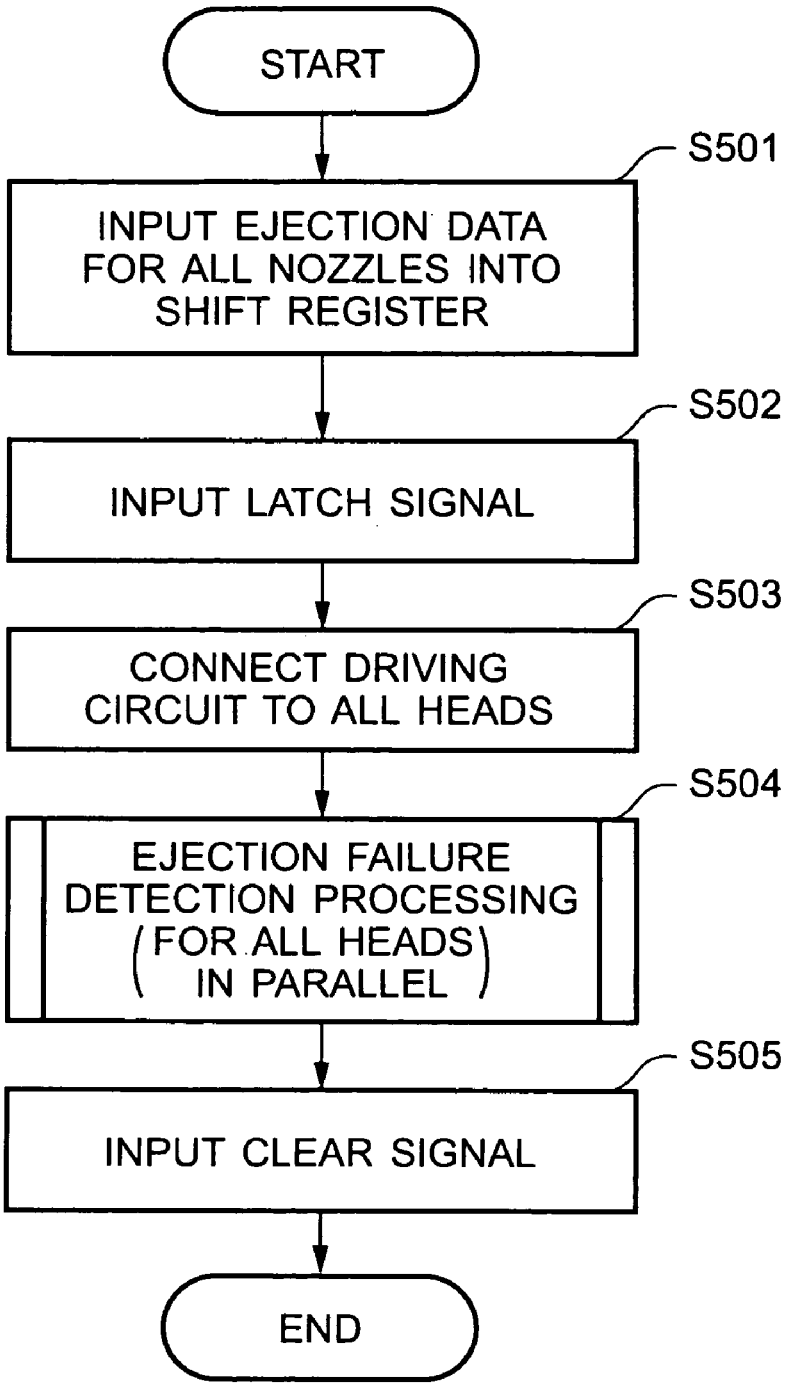
FIG. 32 is a flowchart detailing the detection timing of an ejection failure during the flushing operation by the ink jet printers shown in FIG. 28 and FIG. 29.

FIG. 32 is a flowchart detailing the detection timing of an ejection failure during the flushing operation by the ink jet printers 1 shown in FIG. 28 and FIG. 29. The ink jet printer 1 shown in FIG. 28 and the ink jet printer 1 shown in FIG. 29 are slightly different in terms of the circuitry, but the same in that the number of the ejection failure detecting device 10 and the switching device 23 correspond to (are equal to) the number of ink jet heads 100. For this reason, the ejection failure detection and judgment processing during the flushing operation comprises the same steps.

When the flushing process in the ink jet printer 1 is performed at the predetermined time, the control portion 6 inputs ejection data for all the nozzles into the shift register 182*a* of the ejection selecting means 182 (Step S501), then the latch signal is inputted into the latch circuit 182*b* (Step S502), and the ejection data is thus latched. In this instance, the switching devices 23*a* through 23*e* connect all the ink jet heads 100*a* through 100*e* to the driving waveform generating means 181 respectively (Step S503).

The ejection failure detection and judgment processing detailed in the flowchart of FIG. 24 is performed in parallel for all the ink jet heads 100 that have performed the ink ejection operation, by the ejection failure detecting devices 10*a* through 10*e* corresponding to the respective ink jet heads 100*a* through 100*e* (Step S504). In this case, the judgment results corresponding to all the ink jet heads 100*a* through 100*e* are correlated with the ink jet heads 100 as the targets of processing, and stored into the predetermined storage region of the storage device 62 (Step S107 of FIG. 24).

In order to clear the ejection data latched in the latch circuit 182*b* of the ejection selecting means 182, the control portion 6 releases the latch circuit 182*b* from the latch state by inputting a CLEAR signal into the latch circuit 182*b* (Step S505), and ends the ejection failure detection processing and judgment processing in the ink jet printers 1 shown in FIG. 28 and FIG. 29.

As has been described, according to the processing in the printers 1 shown in FIG. 28 and FIG. 29, the detection and judgment circuit comprises a plurality of (five, in this embodiment) ejection failure detecting devices 10 and a plurality of switching devices 23 corresponding to the ink jet heads 100*a* through 100*e*. Hence, there can be provided an advantage that the ejection failure detection and judgment processing can be performed in a short time for all the nozzles 110 at a time.

Figure 33:
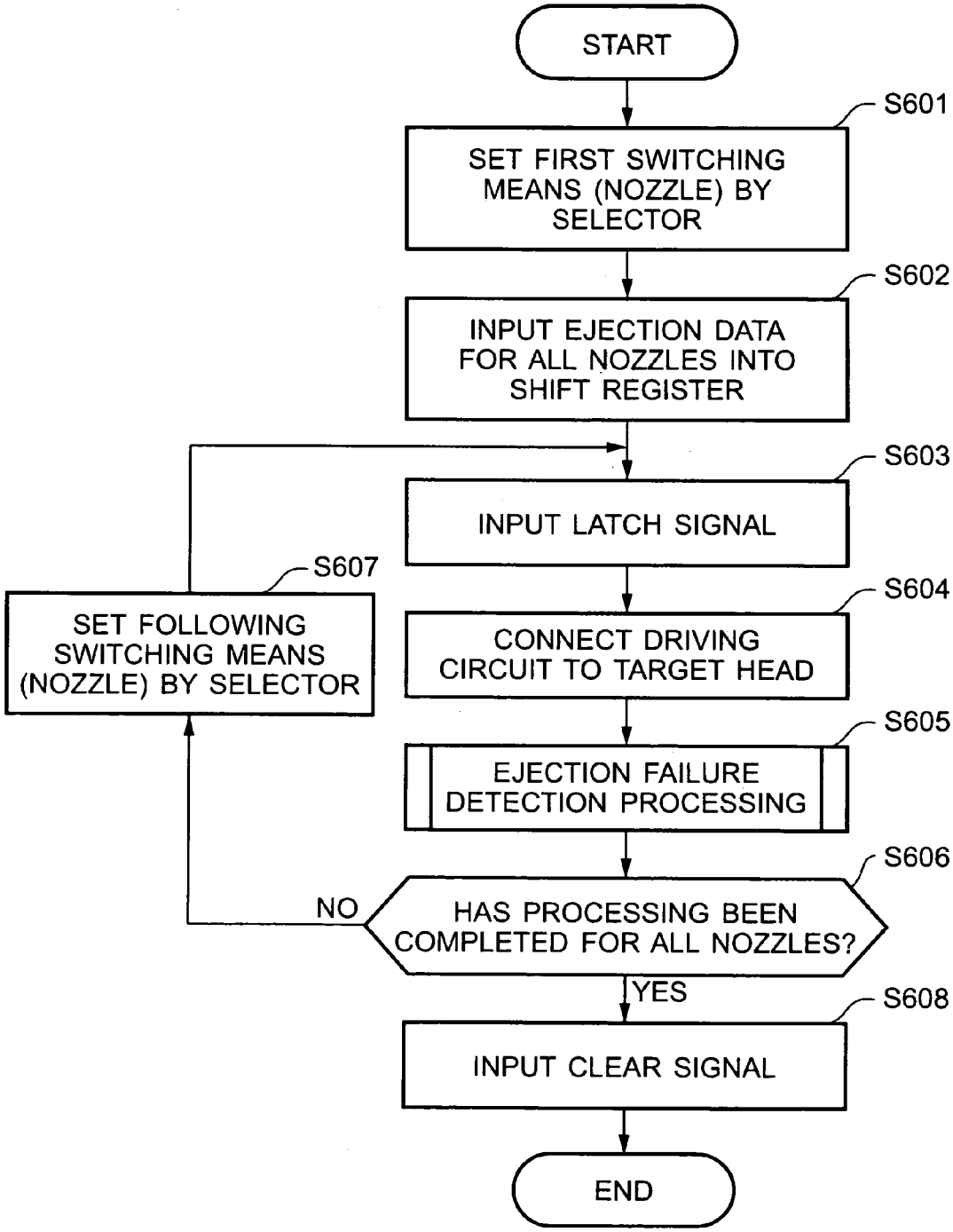
FIG. 33 is a flowchart detailing the detection timing of an ejection failure during the flushing operation by the ink jet printer shown in FIG. 30.

FIG. 33 is a flowchart detailing the detection timing of an ejection failure during the flushing operation by the ink jet printer 1 shown in FIG. 30. The ejection failure detection processing and the cause judgment processing during the flushing operation will now be described with the use of the circuitry of the ink jet printer 1 shown in FIG. 30.

When the flushing process in the ink jet printer 1 is performed at the predetermined timing, the control portion 6 first outputs a scanning signal to the switching selecting device (selector) 19*a*, and sets (identifies) first switching device 23*a* and ink jet head 100*a* by the switching selecting device 19*a* and the switching control device 19 (Step S601). The control portion 6 then inputs ejection data for all the nozzles into the shift register 182*a* of the ejection selecting means 182 (Step S602), then the latch signal is inputted into the latch circuit 182*b* (Step S603), and the ejection data is thus latched. In this instance, the switching device 23*a* connects the electrostatic actuator 120 of the ink jet head 100*a* to the driving waveform generating means 181 (Step S604).

Subsequently, the ejection failure detection and judgment processing detailed in the flowchart of FIG. 24 is performed for the ink jet head 100*a* that has performed the ink ejection operation (Step S605). In this case, the driving/detection switching signal as the output signal from the switching selecting device 19*a* and the ejection data outputted from the latch circuit 182*b* are inputted into the AND circuit ANDa and the output signal from the AND circuit ANDa shifts to the high level in Step S103 of FIG. 24, in response to which the switching device 23*a* connects the electrostatic actuator 120 of the ink jet head 100*a* to the ejection failure detecting device 10. The judgment result in the ejection failure judgment processing performed in Step S106 of FIG. 24 is correlated with the ink jet head 100 as the target of processing (100*a* herein), and is saved in the predetermined storage region of the storage device 62 (Step S107 of FIG. 24).

In Step S606, the control portion 6 judges whether the ejection failure detection and judgment processing has been completed for all the nozzles. Upon judging that the ejection failure detection and the judgment processing is not completed for all the nozzles 110, the control portion 6 outputs a scanning signal to the switching selecting device (selector) 19*a*, and sets (identifies) the following switching device 23*b* and ink jet head 100*b* by the switching selecting device 19*a* and the switching control device 19 (Step S607), after which the control portions 6 returns to Step S603 and repeats the processing in the same manner. Thereafter, this loop is repeated until the ejection failure detection and judgment processing is completed for all the ink jet heads 100.

Upon judging that the ejection failure detection processing and judgment processing is completed for all the nozzles 110 in Step S606, the control portion 6 releases the latch circuit 182*b* from the latch state by inputting a CLEAR signal into the latch circuit 182*b* (Step S609) in order to clear the ejection data latched in the latch circuit 182*b* of the ejection selecting means 182, and ends the ejection failure detection processing and judgment processing in the ink jet printer 1 shown in FIG. 30.

As has been described, according to the processing in the ink jet printer 1 shown in FIG. 30, the detection circuit comprises a plurality of switching devices 23 and one ejection failure detecting device 10, and the ejection failure of the corresponding ink jet head 100 is detected and the cause thereof is judged by allowing only the switching device 23, identified by the scanning signal from the switching selecting device (selector) 19*a* and corresponding to the ink jet head 100 to perform ejection driving in response to the ejection data, to perform the switching operation. It is thus possible to detect an ejection failure of the ink jet head 100 and to judge the cause thereof more efficiently.

In Step S602 of this flowchart, the ejection data corresponding to all the nozzles 110 is inputted into the shift register 182*b*. However, as in the flowchart shown in FIG. 31, the ejection failure detection and judgment processing may be performed for the nozzles 110 one by one by inputting the ejection data to be inputted into the shift register 182*a* into one corresponding ink jet head 100 in the scanning order of the ink jet heads 100 by the switching selecting device 19*a*.

The ejection failure detection and judgment processing in the ink jet printer 1 during the print operation will now be described with reference to the flowcharts shown in FIG. 34 and FIG. 35. Because the ink jet printer 1 shown in FIG. 27 is chiefly suitable for the ejection failure detection processing and judgment processing during the flushing operation, the description of the flowchart and the operation thereof during the print operation is omitted. However, the ejection failure detection and judgment processing may be performed during the print operation as well in the ink jet printer 1 shown in FIG. 27.

Figure 34:
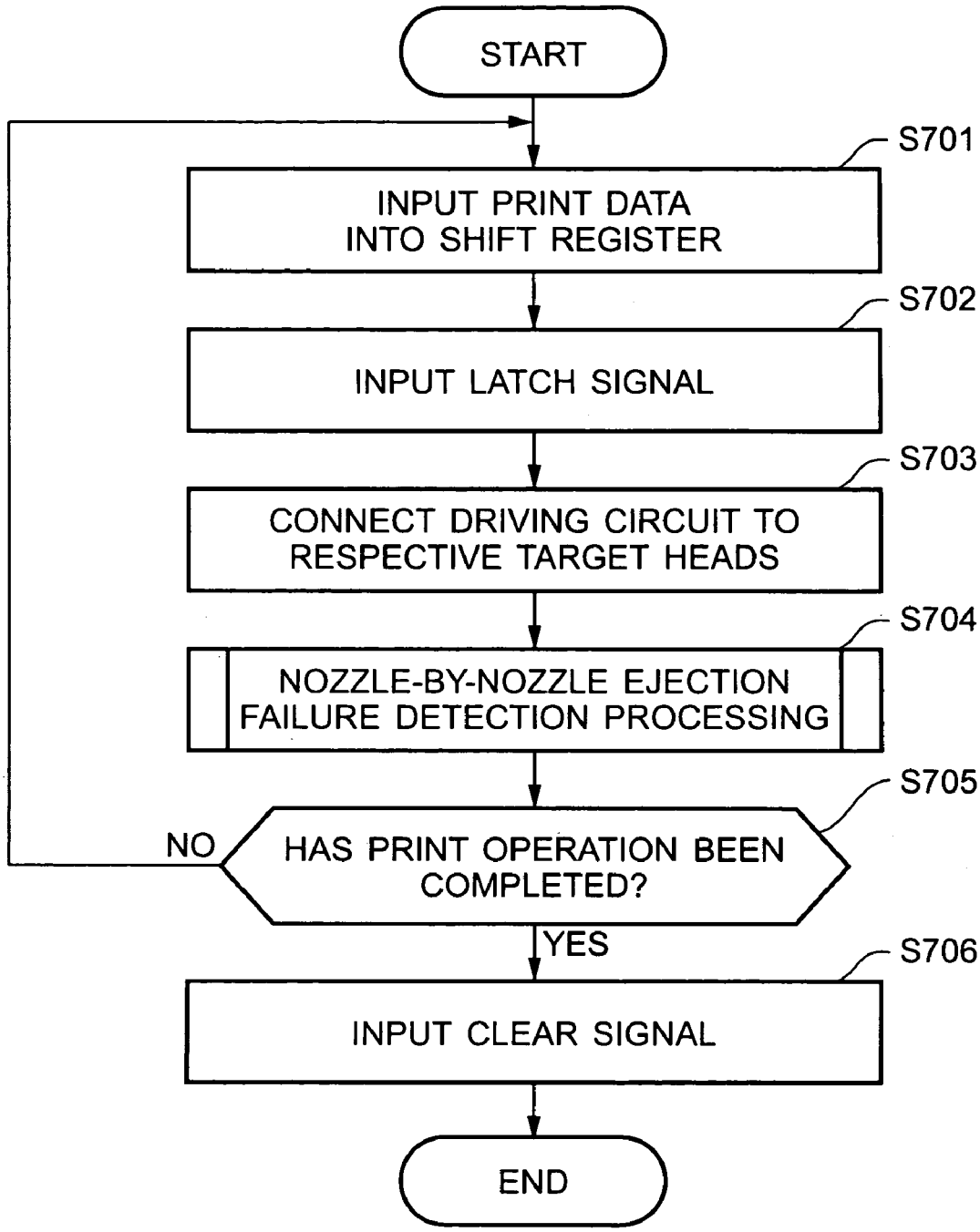
FIG. 34 is a flowchart detailing the detection timing of an ejection failure during a print operation by the ink jet-printers shown in FIG. 28 and FIG. 29.

FIG. 34 is a flowchart detailing the detection timing of an ejection failure during the print operation by the ink jet printers 1 shown in FIG. 28 and FIG. 29. The processing according to this flowchart is performed (started) at a printing (print) command from the host computer 8. When the print data is inputted to the shift register 182*a* of the ejection selecting means 182 from the host computer 8 via the control portion 6 (Step S701), then the latch signal is inputted into the latch circuit 182*b* (Step S702), and the print data is thus latched. In this instance, the switching devices 23*a* through 23*e* connect all the ink jet heads 100*a* through 100*e* to the driving waveform generating means 181 (Step S703).

The ejection failure detecting device 10 corresponding to the ink jet heads 100 that have performed the ink ejection operation then perform the ejection failure detection and judgment processing detailed in the flowchart of FIG. 24 (Step S704). In this case, the judgment results corresponding to the respective ink jet heads 100 are correlated with the ink jet heads 100 as the targets of processing, and saved in the predetermined storage region of the storage device 62.

In the case of the ink jet printer 1 shown in FIG. 28, the switching devices 23*a* through 23*e* connect the ink jet heads 100*a* through 100*e* to the ejection failure detecting devices 10*a* through 10*e* according to the driving/detection switching signal outputted from the control portion 6 (Step S103 of FIG. 24). Hence, the electrostatic actuator 120 is not driven in the ink jet head 100 in which the print data is absent, and the residual vibration detecting device 16 of the ejection failure detecting device 10 therefore does not detect the residual vibration waveform of the diaphragm 121. On the other hand, in the case of the ink jet printer 1 shown in FIG. 29, the switching devices 23*a* through 23*e* connect the ink jet head 100 in which the print data is present to the ejection failure detecting device 10 according to the output signal from the AND circuit into which the driving/detection switching signal outputted from the control portion 6 and the print data outputted from the latch circuit 182*b* are inputted (Step S103 of FIG. 24).

In Step S705, the control portion 6 judges whether the print operation by the ink jet printer 1 has been completed. Upon judging that the print operation is not completed, the control portion 6 returns to Step S701, and inputs the following print data into the shift register 182*a* to repeat the processing in the same manner. Upon judging that the printing operation is completed, the control portion 6 releases the latch circuit 182*b* from the latch state by inputting a CLEAR signal into the latch circuit 182*b* (Step S707) in order to clear the ejection data latched in the latch circuit 182*b* of the ejection selecting means 182, and ends the ejection failure detection processing and judgment processing in the ink jet printers 1 shown in FIG. 28 and FIG. 29.

As has been described, in the ink jet printers 1 shown in FIG. 28 and FIG. 29, a plurality of switching devices 23*a* through 23*e* and a plurality of ejection failure detecting devices 10*a* through 10*e* are provided, so that the ejection failure detection and judgment processing is performed for all the ink jet heads 100 at a time. Hence, the processing can be performed in a short time. Also, the ink jet printer 1 shown in FIG. 29 is further provided with the switching control device 19, that is, the AND circuits ANDa through ANDe performing the logical operation AND of the driving/detection switching signal and the print data, so that the switching operation is performed by the switching device 23 for only the ink jet head 100 that will perform the print operation. Hence, the ejection failure detection processing and judgment processing can be performed by omitting useless detection.

Figure 35:
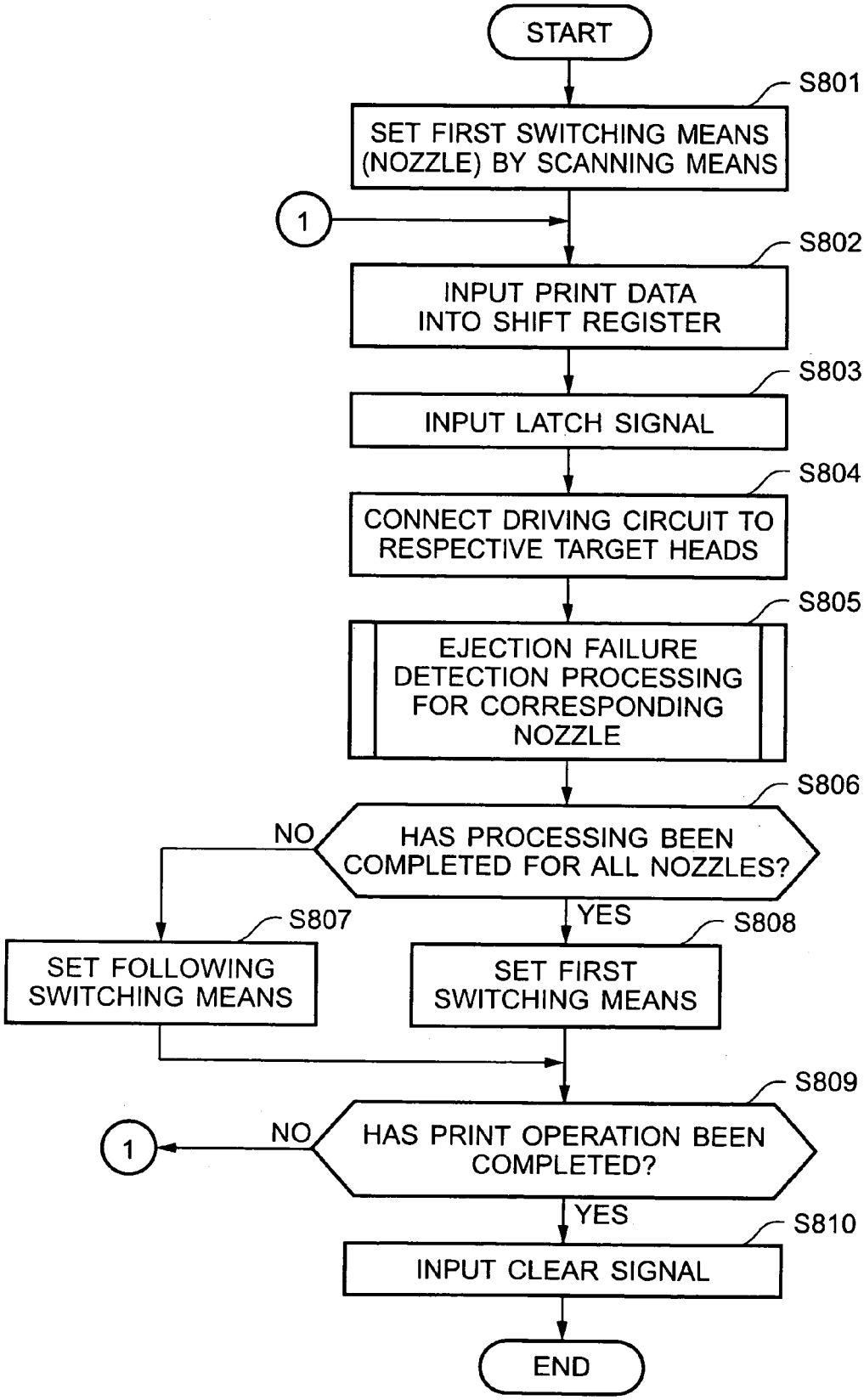
FIG. 35 is a flowchart detailing the detection timing of an ejection failure during the print operation by the ink jet printer shown in FIG. 30.

FIG. 35 is a flowchart detailing the detection timing of an ejection failure during the print operation by the ink jet printer 1 shown in FIG. 30. The processing according to this flowchart is performed by the ink jet printer 1 shown in FIG. 30 at a printing command from the host computer 8. The switching selecting device 19*a* sets (identifies) in advance first switching device 23*a* and ink jet head 100*a* (Step S801).

When the print data is inputted into the shift register 182*a* of the ejection selecting means 182 from the host computer 8 via the control portion 6 (Step S802), the latch signal is inputted into the latch circuit 182*b* (Step S803), and the print data is thus latched. At this stage, the switching devices 23*a* through 23*e* connect all the ink jet heads 100*a* through 100*e* to the driving waveform generating means 181 (the driver 182*c* of the ejection selecting means 182) (Step S804).

In a case where the print data is present in the ink jet head 100*a*, the control portion 6 controls the switching selecting device 19*a* to connect the electrostatic actuator 120 to the ejection failure detecting device 10 after the ejection operation (Step S103 of FIG. 24), and performs the ejection failure detection and judgment processing detailed in the flowchart of FIG. 24 (FIG. 25) (Step S805). The judgment result in the ejection failure judgment processing performed in Step S106 of FIG. 24 is correlated with the ink jet head 100 as the target of processing (100*a*, herein), and saved in the predetermined storage region of the storage device 62 (Step S107 of FIG. 24).

In Step S806, the control portion 6 judges whether the ejection failure detection and judgment processing described above has been completed for all the nozzles 110 (all the ink jet heads 100). Upon judging that the above processing is completed for all the nozzles 110, the control portion 6 sets the switching device 23*a* corresponding to the first nozzle 110 according to the scanning signal (Step S808). Upon judging that the above processing is not completed for all the nozzles 110, the control portion 6 sets the switching device 23*b* corresponding to the following nozzle 110 (Step S807).

In Step S809, the control portion 6 judges whether the predetermined print operation specified by the host computer 8 has been completed. Upon judging that the print operation is not completed, the control portion 6 inputs the following print data into the shift register 182*a* (Step S802), and repeats processing in the same manner. Upon judging that the print operation is completed, the control portion 6 releases the latch circuit 182*b* from the latch state by inputting a CLEAR signal into the latch circuit 182*b* (Step S811) in order to clear the ejection data latched in the latch circuit 182*b* of the ejection selecting means 182, and ends the ejection failure detection and judgment processing in the ink jet printer 1 shown in FIG. 30.

As has been described, the droplet ejection apparatus (ink jet printer 1) of the invention is provided with a plurality of ink jet heads (droplet ejection heads) 100 each having the diaphragm 121, the electrostatic actuator 120 that displaces the diaphragm 121, the cavity 141 filled with liquid and the internal pressure thereof varies (increases or decreases) with the displacement of the diaphragm 121, and the nozzle 110 communicating with the cavity 141 and through which the liquid within the cavity 141 is ejected in the form of droplets due to a change (increase and decrease) in internal pressure of the cavity 141. The apparatus is further provided with the driving waveform generating means 181 for driving the electrostatic actuators 120, the ejection selecting means 182 for selecting from which nozzle 110 out of a plurality of nozzles 110 the droplets are to be ejected, one or more than one ejection failure detecting device 10 for detecting the residual vibration of the diaphragm 121 and detecting an ejection failure of the droplets on the basis of the residual vibration of the diaphragm 121 thus detected, and one or more than one switching device 23 for switching the electrostatic actuator 120 to the ejection failure detecting device 10 from the driving waveform generating means 181 after the ejection operation of the droplets by driving the electrostatic actuator 120, according to the driving/detection switching signal or on the basis of the print data, or alternatively according to the scanning signal. Hence, an ejection failure of a plurality of nozzles 110 can be detected either at one time (in parallel) or sequentially.

Thus, an ejection failure can be detected and the cause thereof can be judged in a short time by the droplet ejection apparatus of the invention. Meanwhile, the circuitry of the detection circuit including the ejection failure detecting device 10 can be scaled down, which makes it possible to prevent an increase of the manufacturing costs of the droplet ejection apparatus. Also, because an ejection failure is detected and the cause thereof is judged by switching to the ejection failure detecting device 10 after the electrostatic actuators 120 are driven, the driving of the actuators is not influenced at all, and therefore the throughput of the droplet ejection apparatus of the invention will be neither reduced nor deteriorated. Also, it is possible to provide the ejection failure detecting device 10 to an existing droplet ejection apparatus (ink jet printer 1) provided with predetermined components.

In contrast to the configuration described above, another droplet ejection apparatus of the invention is provided with a plurality of switching device 23, the switching control device 19, and one or as many as ejection failure detecting device 10 as nozzles 110, and an ejection failure is detected and the cause thereof is judged by switching the corresponding electrostatic actuator 120 from the driving waveform generating means 181 or the ejection selecting means 182 to the ejection failure detecting device 10, according to the driving/detection switching signal and on the basis of the ejection data (print data) or according to the scanning signal and the driving/detection switching signal and on the basis of the ejection data (print data).

Hence, the switching means corresponding to the electrostatic actuator 120 into which the ejection data (print data) has not been inputted, that is, the one that has not performed the ejection driving operation, does not perform the switching operation. The droplet ejection apparatus of the invention is thus able to avoid useless detection and judgment processing. Also, in the case of using the switching selecting device 19*a*, because the droplet ejection apparatus only has to be provided with one ejection failure detecting device 10, not only can the circuitry of the droplet ejection apparatus be scaled down, but also an increase of the manufacturing costs of the droplet ejection apparatus can be prevented.

In the first embodiment, the ink jet printers 1 shown in FIG. 27 through FIG. 30 used to explain the detection timing of an ejection failure are of the configuration including five ink jet heads 100 (nozzles 110) in the head unit 35 and such configuration was described for ease of explanation. The number of the ink jet heads (droplet ejection heads) 100, however, is not limited to five in the droplet ejection apparatus of the invention, and an ejection failure can be detected and judged for any number of the nozzles 110 actually mounted.

Figure 36:
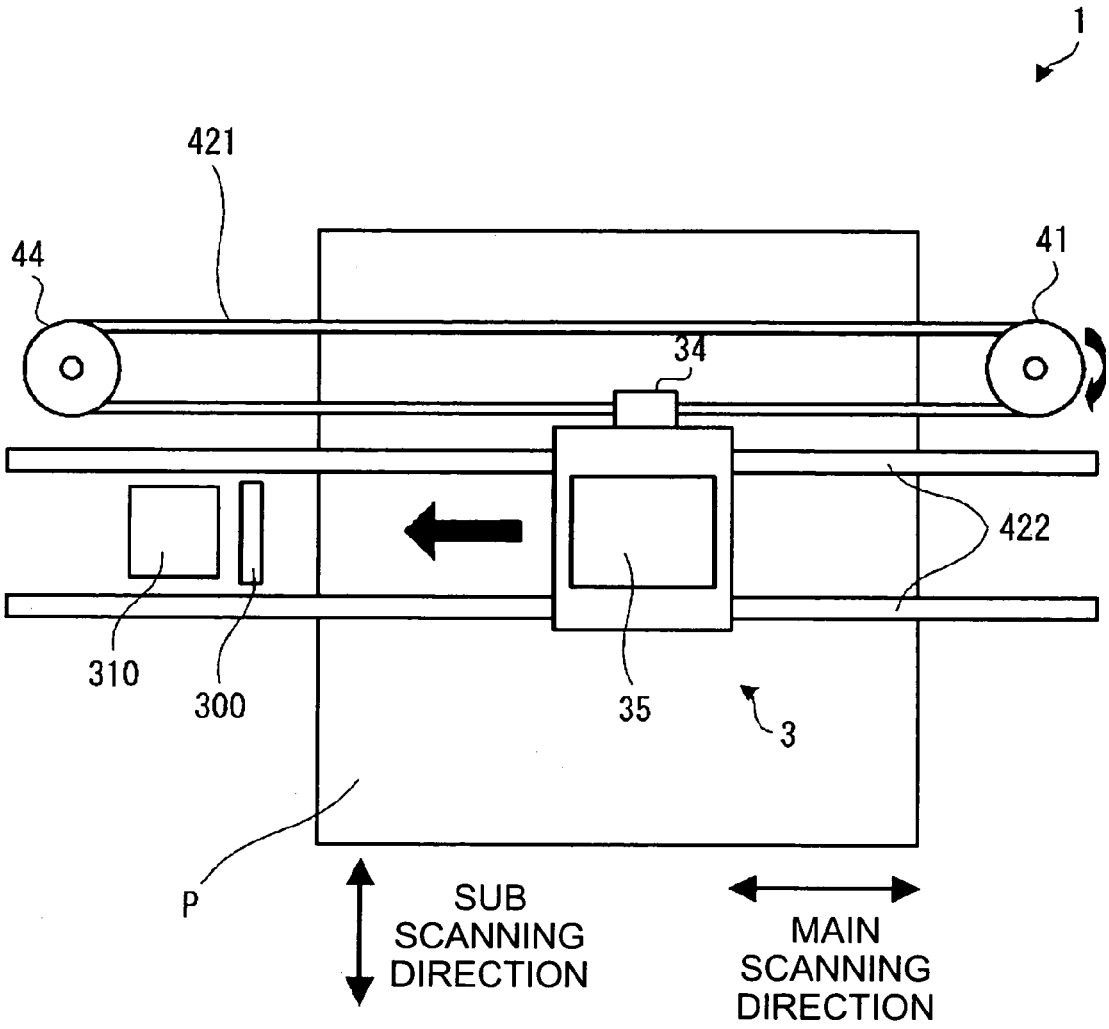
FIG. 36 is a view schematically showing the structure (part of which is omitted) when viewed from the top of the ink jet printer shown in FIG. 1.

The configuration (recovery means (device) 24) to perform recovery processing by which the cause of an ejection failure (head failure) is eliminated for the ink jet head 100 (head unit 35) in the droplet ejection apparatus of the invention will now be described. FIG. 36 is a view schematically showing the structure (part of which is omitted) when viewed from the top of the ink jet printer 1 shown in FIG. 1. The ink jet printer 1 shown in FIG. 36 is provided with a wiper 300 and a cap 310 used to perform the recovery processing of ink drop non-ejection (head failure) in addition to the configuration shown in the perspective view of FIG. 1.

The recovery processing performed by the recovery device 24 includes the flushing process by which droplets are ejected preliminarily through the nozzles 110 of the respective ink jet heads 100, the wiping process by the wiper 300 described below (see FIG. 37), and a pumping process (pump-suction processing) by a tube pump 320 described below. In other words, the recovery device 24 is provided with the tube pump 320, a pulse motor driving the same, the wiper 300 and a vertical driving mechanism of the wiper 300, and a vertical driving mechanism (not shown) of the cap 310, and the head driver 33, the head unit 35, etc., and the carriage motor 41 and the like function as part of the recovery device 24 in the flushing process and in the wiping process, respectively. Because the flushing process is already described above, the wiping process and the pumping process will be described below.

The wiping process referred to herein is defined as the processing by which foreign substances, such as paper dust, adhering to the nozzle plate 150 (nozzle surface) of the head unit 35 is wiped off with the wiper 300. The pumping process (pump-suction processing) referred to herein is defined as processing by which ink inside the cavities 141 is sucked (removed by a vacuum) and discharged through the respective nozzles 110 of the head unit 35 by driving the tube pump 320 described below. As has been described, the wiping process is adequate processing as the recovery processing for a state of adhesion of paper dust, which is one of the causes of an ejection failure of droplets of the ink jet head 100 described above. Also, the pump-suction process is adequate processing as the recovery processing for removing air bubbles inside the cavities 141 which cannot be removed by the flushing process described above, or for removing thickened ink when ink has thickened by drying in the vicinity of the nozzles 110 or when ink inside the cavities 141 has thickened by aged deterioration. The recovery processing may be performed by the flushing process described above in a case where ink has thickened slightly and the viscosity is not noticeably high. In this case, because a quantity of ink to be discharged is small, adequate recovery processing can be performed without deteriorating the throughput or the running costs.

The head unit 35 provided with a plurality of ink jet heads (droplet ejection heads) 100 is mounted on the carriage 32, guided by the two carriage guide shafts 422, and moved by the carriage motor 41 as it is coupled to the timing belt 421 via a coupling portion 34 provided at the top edge in the drawing. The head unit 35 mounted on the carriage 32 is allowed to move in the main scanning direction via the timing belt 421 (in association with the timing belt 421) that moves when driven by the carriage motor 41. The carriage motor 41 plays a role of a pulley for continuously turning the timing belt 421, and a pulley 44 is provided at the other end as well.

The cap 310 is used to cap the nozzle plate 150 (see FIG. 5) of the head unit 35. The cap 310 is provided with a hole on the side surface of the bottom portion, and as will be described below, a flexible tube 321, one component of the tube pump 320, is connected to the bottom portion. The tube pump 320 will be described below with reference to FIG. 39.

During the recording (print) operation, a recording sheet P moves in the sub scanning direction, that is, downward in FIG. 36, and the print device 3 moves in the main scanning direction, that is, the horizontal direction in FIG. 36 while the electrostatic actuator 120 of the predetermined ink jet head 100 (droplet ejection head) is being driven, so that the ink jet printer (droplet ejection apparatus) 1 prints (records) a predetermined image or the like on the recording sheet P on the basis of the printing data (print data) inputted from the host computer 8.

Figure 37A:
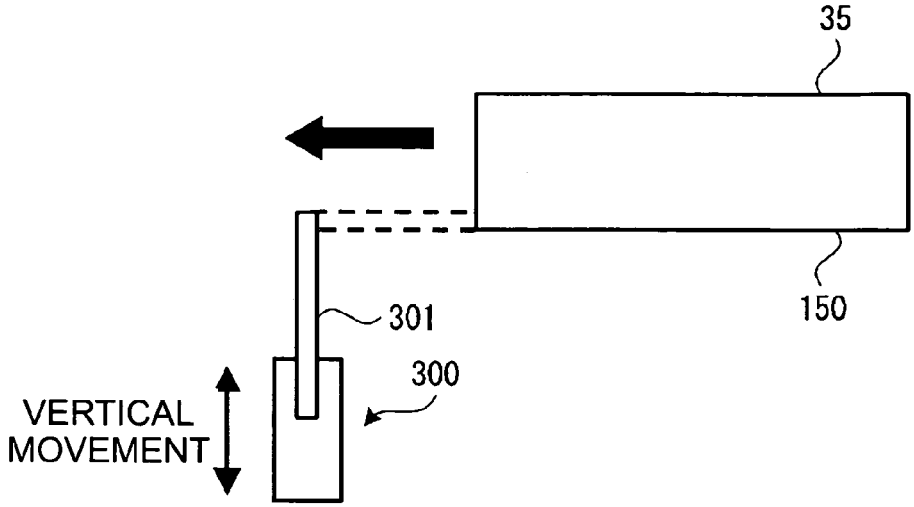
FIG. 37 is a view showing the positional relation between a wiper and the head unit shown in FIG. 36.
Figure 37B:
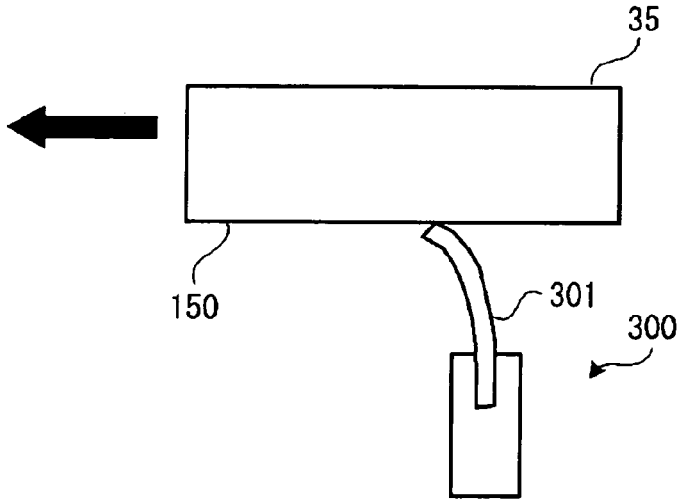

FIG. 37 is a view showing the positional relation between the wiper 300 and the print device 3 (head unit 35) shown in FIG. 36. Referring to FIG. 37, the head unit 35 and the wiper 300 are shown as part of the side view of the ink jet printer 1 shown in FIG. 36 when viewed from bottom to top in the drawing. As is shown in FIG. 37(*a*), the wiper 300 is provided so that it is allowed to move vertically to abut the nozzle surface of the print device 3, that is, the nozzle plate 150 of the head unit 35.

The wiping process as the recovery processing using the wiper 300 will now be described. When the wiping process is performed, as is shown in FIG. 37(*a*), the wiper 300 is moved upward by an unillustrated driving device, so that the tip end of the wiper 300 is positioned above the nozzle surface (nozzle plate 150). In this case, when the print device 3 (head unit 35) is moved to the left of the drawing (a direction indicated by an arrow) by driving the carriage motor 41, a wiping member 301 abuts the nozzle plate 150 (nozzle surface).

Because the wiping member 301 comprises a flexible rubber member or the like, as is shown in FIG. 37(*b*), the tip end portion of the wiping member 301 abutting the nozzle plate 150 is bent, and the wiping member 301 thereby cleans (wipes off) the surface of the nozzle plate 150 (nozzle surface) by the tip end portion thereof. This removes foreign substances, such as paper dust (for example, paper dust, dust afloat in air, pieces of rubber), adhering to the nozzle plate 150 (nozzle surface). The wiping process may be performed more than once depending on the adhesion state of such foreign substances (when a large quantity of foreign substances are adhering) by allowing the print device 3 to reciprocate above the wiper 300.

Figure 38:
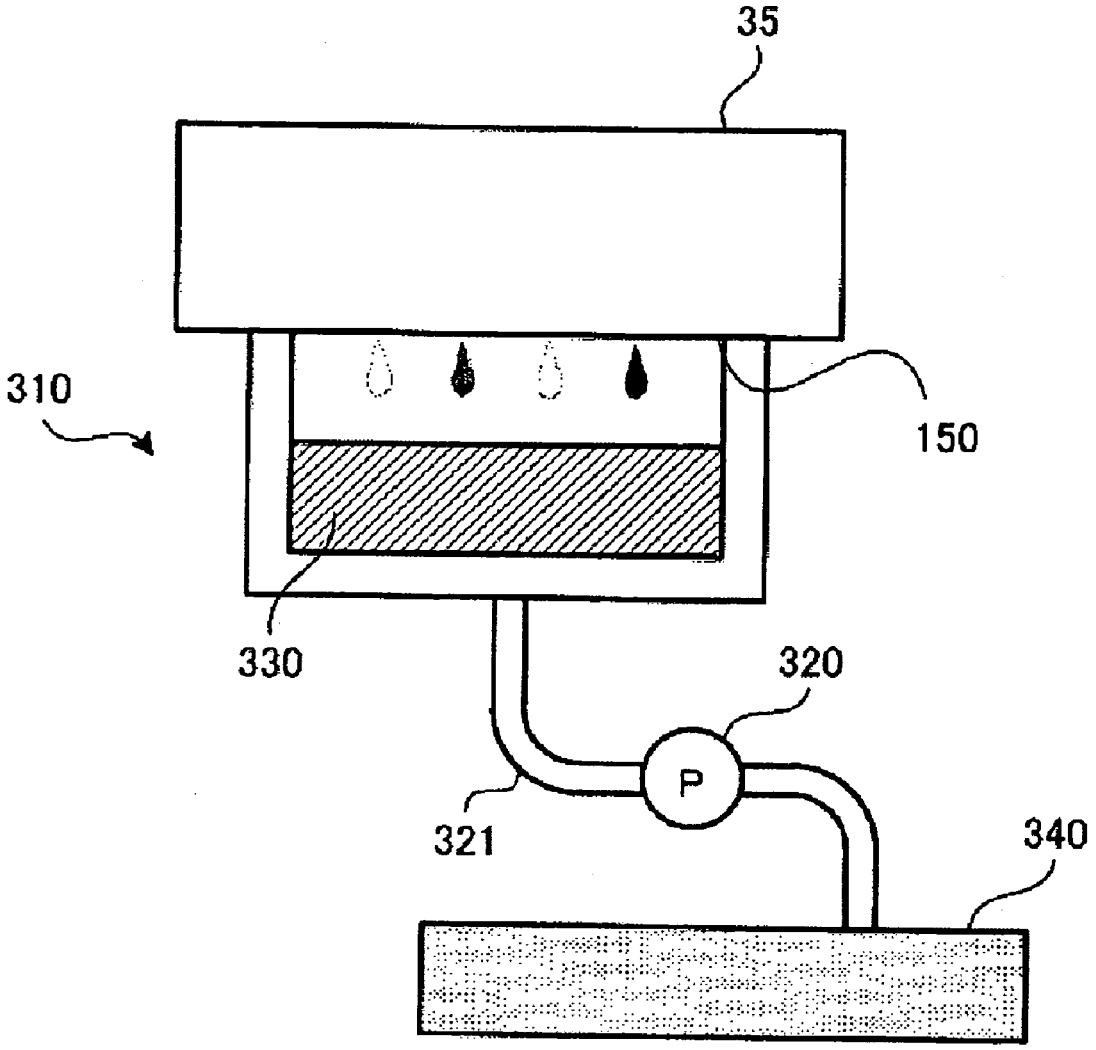
FIG. 38 is a view showing the relation among the head unit, a cap, and a pump during a pump-suction process.

FIG. 38 is a view showing the relation among the head unit 35, the cap 310, and the pump 320 during the pump-suction process. The tube 321 forms an ink discharge path used in the pumping process (pump-suction processing), and is connected to the bottom portion of the cap 310 at one end as described above, and connected to a discharged ink cartridge 340 at the other end via the tube pump 320.

An ink absorber 330 is placed on the inner bottom surface of the cap 310. The ink absorber 330 absorbs and temporarily preserves ink ejected through the nozzles 110 of the ink jet heads 100 during the pump-suction process or the flushing process. The ink absorber 330 prevents ejected droplets from splashing back and thereby smearing the nozzle plate 150 during the flushing operation inside the cap 310.

Figure 39B:
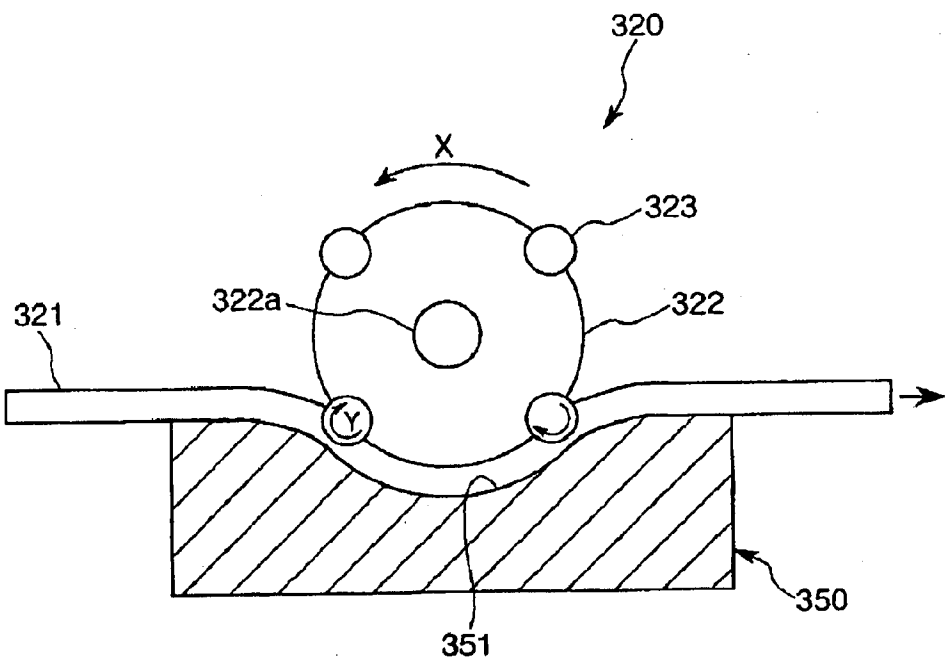
FIG. 39 is a schematic view showing the configuration of a tube pump shown in FIG. 38.
Figure 39A:
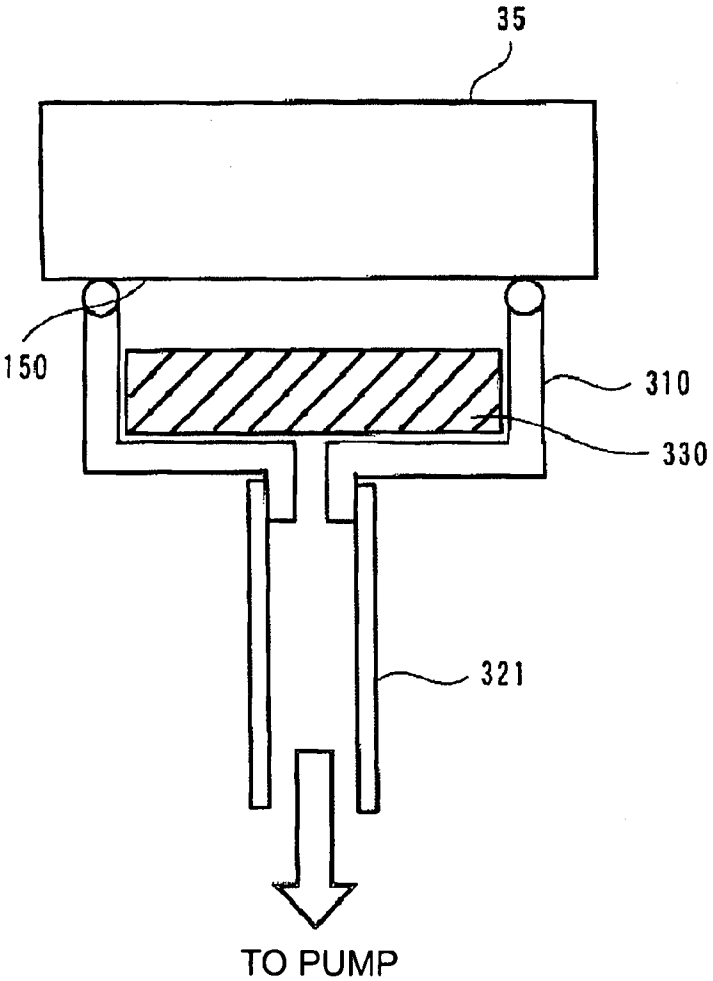

FIG. 39 is a schematic view showing the configuration of the tube pump 320 shown in FIG. 38. As is shown in FIG. 39(B), the tube pump 320 is a rotary pump, and is provided with a rotor 322, four rollers 323 placed to the circumferential portion of the rotor 322, and a guiding member 350. The rollers 323 are supported by the rotor 322, and apply a pressure to the flexible tube 321 placed arc-wise along a guide 351 of the guiding member 350.

In this tube pump 320, the rotor 322 is rotated about the shaft 322*a* in a direction X indicated by an arrow of FIG. 39, which allows one or two rollers 323 abutting on the tube 321 to sequentially apply pressure to the tube 321 placed on the arc-shaped guide 351 of the guiding member 350 while rotating in the Y direction. The tube 321 thereby undergoes deformation, and ink (liquid material) within the cavities 141 of the respective ink jet heads 100 is sucked via the cap 310 due to a negative pressure generated in the tube 321. Then, unwanted ink intruded with air bubbles or having thickened by drying is discharged into the ink absorber 330 through the nozzles 110, and the discharged ink absorbed in the ink absorber 330 is then discharged to the discharged ink cartridge 340 (see FIG. 38) via the tube pump 320.

The tube pump 320 is driven by an unillustrated motor, such as a pulse motor. The pulse motor is controlled by the control portion 6. Driving information as to the rotational control of the tube pump 320, including, for example, a look-up table written with the rotational speed and the number of rotations, a control program written with sequence control, etc., is stored in the PROM 64 of the control portion 6. The tube pump 320 is controlled by the CPU 61 of the control portion 6 according to the driving information specified above.

Figure 40:
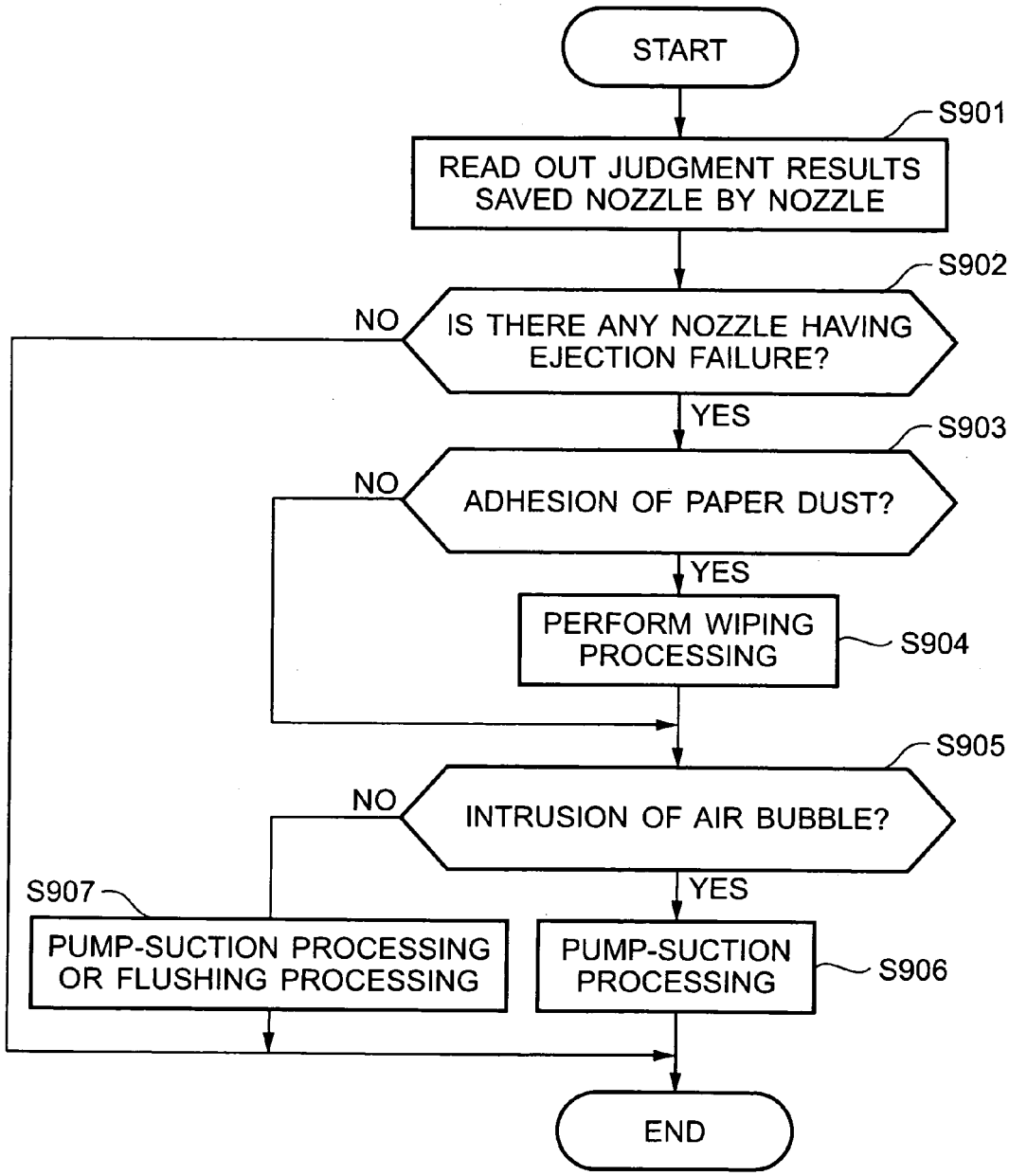
FIG. 40 is a flowchart detailing ejection failure recovery processing in an ink jet printer of the invention.

The operation (ejection failure recovery processing) of the recovery device 24 will now be described. FIG. 40 is a flowchart detailing the ejection failure recovery processing in the ink jet printer 1 (droplet ejection apparatus) of the invention. When an ejection failure of the nozzle 110 is detected and the cause thereof is judged in the ejection failure detection and judgment processing described above (see the flowchart of FIG. 24), the print device 3 is moved to the predetermined stand-by region (for example, the position at which the nozzle plate 150 of the print device 3 is covered with the cap 310 or a position at which the wiping process by the wiper 300 can be performed in FIG. 36) at the predetermined time while the printing operation (print operation) or the like is not performed, and the ejection failure recovery processing is performed.

The control portion 6 first reads out the judgment results corresponding to the respective nozzles 110, which are saved in the EEPROM 62 of the control portion 6 in Step S107 of FIG. 24 (it should be noted that the judgment results to be read out are not the judgment results whose contents are limited to the respective nozzles 110, but those for the respective ink jet heads 100. Hence, hereinafter, the nozzles 110 having an ejection failure also means the ink jet head 100 in which an ejection failure is occurring) (Step S901). In Step S902, the control portion 6 judges whether the judgment results thus read out include those for a nozzle 110 having an ejection failure. Upon judging the absence of the nozzle 110 having an ejection failure, that is, in a case where droplets were ejected normally through all the nozzles 110, the control portion 6 simply ends the ejection failure recovery processing.

On the other hand, upon judging the presence of a nozzle 110 having an ejection failure, the control portion 6 judges in Step S903 whether paper dust is adhering in the nozzle 110 judged as having an ejection failure. Upon judging that no paper dust is adhering in the vicinity of the outlet of the nozzle 110, the control portion 6 proceeds to Step S905. Upon judging that paper dust is adhering, the control portion 6 performs the wiping process to the nozzle plate 150 by the wiper 300 as described above (Step S904).

In Step S905, the control portion 6 subsequently judges whether an air bubble has intruded inside the nozzle 110 judged as having an ejection failure. Upon judging that an air bubble has intruded, the control portion 6 performs the pump-suction process by the tube pump 320 for all the nozzles 110 (Step S906), and ends the ejection failure recovery processing. On the other hand, upon judging that an air bubble has not intruded, the control portion 6 performs the pump-suction process by the tube pump 320 or the flushing process for the nozzle 110 judged as having an ejection failure alone or for all the nozzles 110, on the basis of the length of the cycle of the residual vibration of the diaphragm 121 measured by the measuring means (device) 17 (Step S907), and ends the ejection failure recovery processing.

Figure 41A:
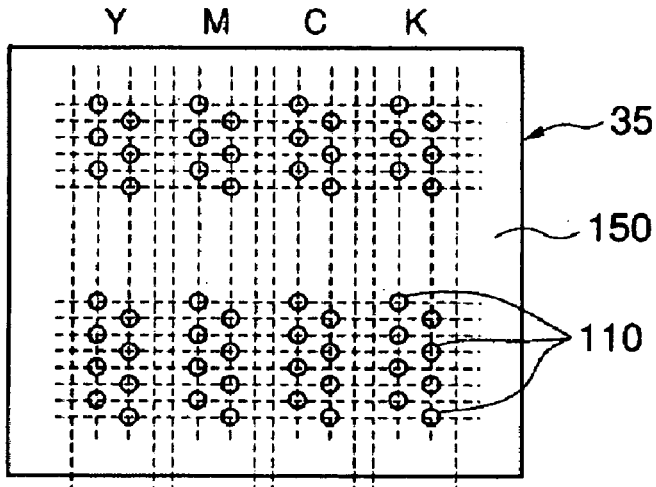
FIG. 41 shows views used to explain an example of another configuration of the wiper (wiping means), (a) being a view showing a nozzle surface of the print means (head unit), and (b) being a view showing the wiper.
Figure 41B:
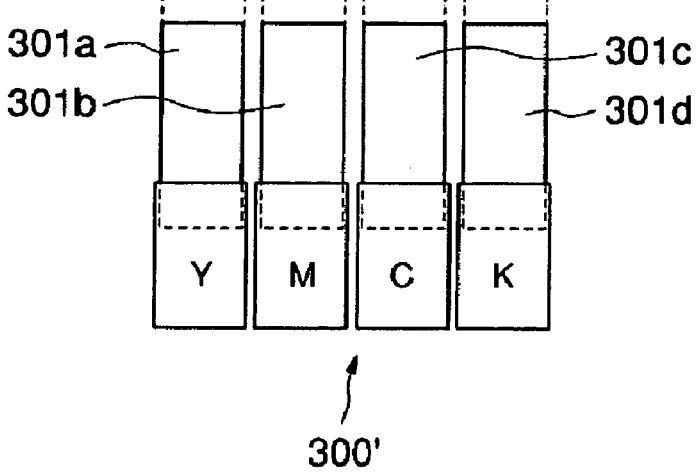
Figure 42:
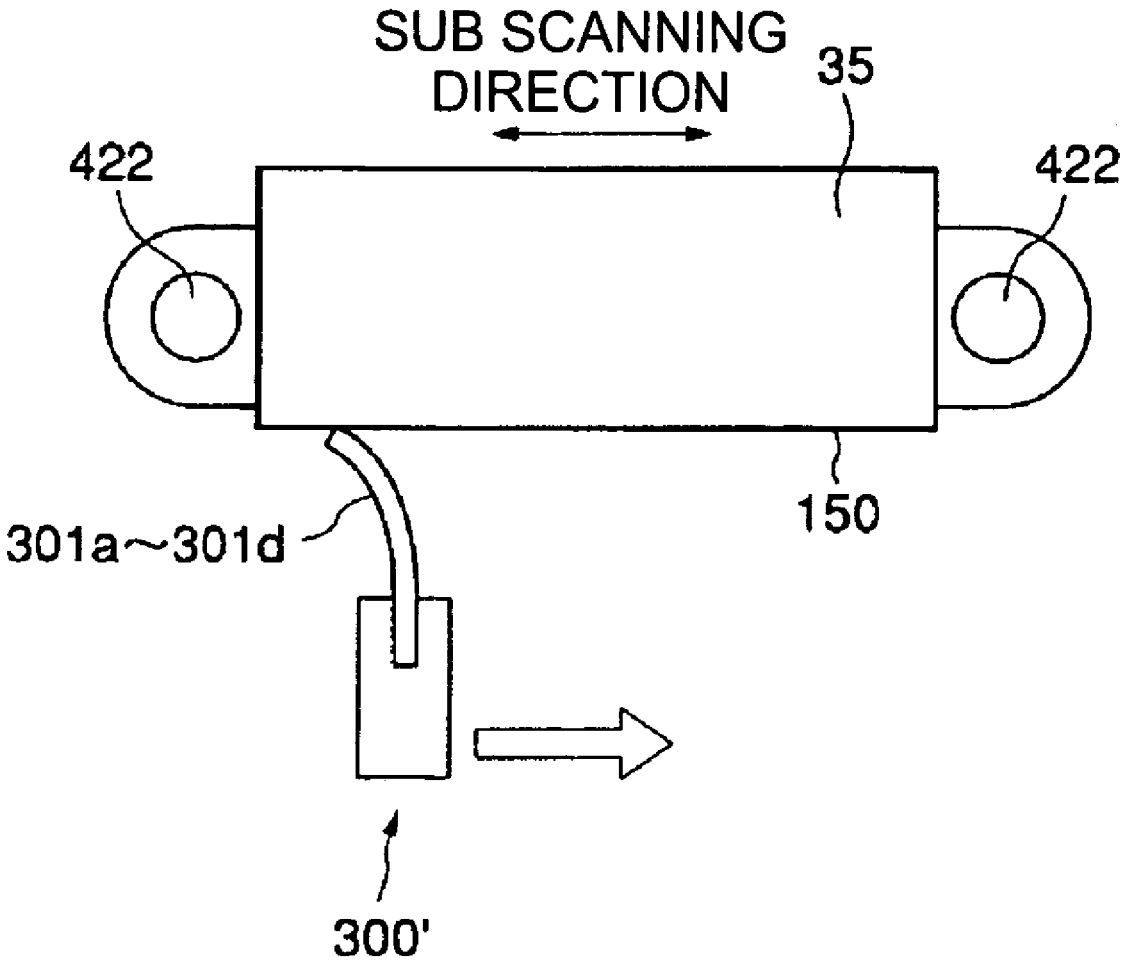
FIG. 42 is a view showing an operation state of the wiper shown in FIG. 41.

FIG. 41 is a view used to explain an example of another configuration (wiper 300') of the wiper (wiping means). FIG. 41(*a*) is a view showing the nozzle surface (nozzle plate 150) of the print device 3 (head unit 35), and FIG. 41(*b*) is a view showing a wiper 300'. FIG. 42 is a view showing an operation state of the wiper 300' shown in FIG. 41.

The wiper 300' as an example of another configuration of the wiper will now be described with reference to these drawings; however, the difference from the wiper 300 described above will be chiefly described, and the description of similar portions is omitted.

As is shown in FIG. 41(*a*), a plurality of nozzles 110 are divided into four sets of nozzle groups in correspondence with respective colors of ink, including yellow (Y), magenta (M), cyan (C), and black (K), on the nozzle surface of the print device 3. The wiper 300' of this example is able to perform the wiping process separately for the four sets of nozzle groups for the respective colors of nozzle groups due to the configuration described below.

As is shown in FIG. 41(*b*), the wiper 300' includes a wiping member 301*a* for a nozzle group of yellow, a wiping member 301*b* for a nozzle group of magenta, a wiping member 301*c* for a nozzle group of cyan, and a wiping member 301*d* for a nozzle group of black. As is shown in FIG. 42, the respective wiping members 301*a* through 301*d* are allowed to move independently in the sub scanning direction by an unillustrated moving mechanism.

The wiper 300 described above is of a type that performs a wiping process on the nozzle surfaces of all the nozzles 110 at one time. According to the wiper 300' of this example, however, it is possible to wipe only a nozzle group that needs the wiping process, and waste-less recovery processing can be thus performed.

Figure 43:
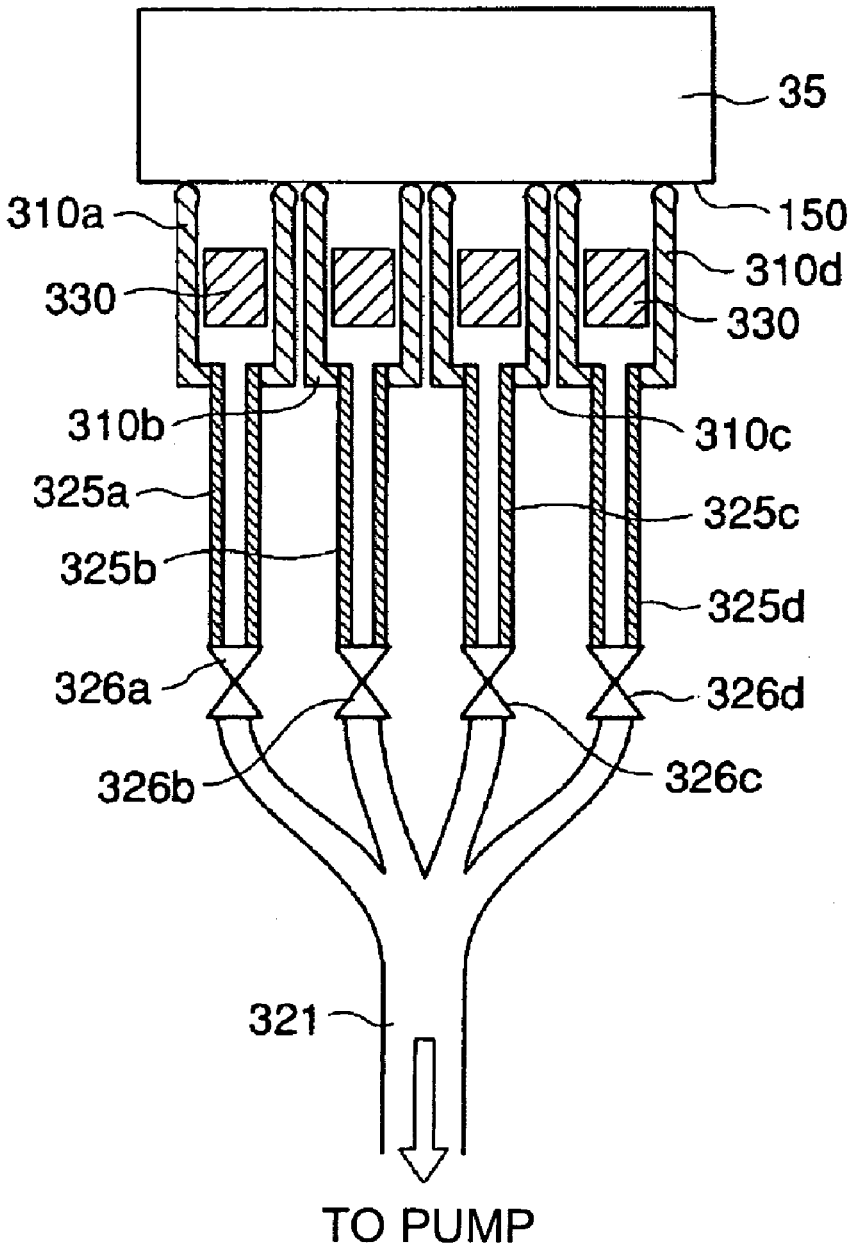
FIG. 43 is a view used to explain an example of another configuration of the pumping means.

FIG. 43 is a view used to explain an example of another configuration of the pumping means (device). The example of another configuration of the pumping means will now be described with reference to the drawing; however, the difference from the pumping means described above will be chiefly described, and the description of similar portions is omitted.

As is shown in FIG. 43, the pumping means of this example includes a cap 310*a* for the nozzle group of yellow, a cap 310*b* for the nozzle group of magenta, a cap 310*c* for the nozzle group of cyan, and a cap 310*d* for the nozzle group of black.

The tube 321 of the tube pump 320 is branched into four branched tubes 325*a* through 325*d*, and the caps 310*a* through 310*d* are connected to the branched tubes 325*a* through 325*d*, respectively. Valves 326*a* through 326*d* are provided at some mid points in the branched tubes 325*a* through 325*d*, respectively.

The pumping means of this example as described above is able to perform the pump-suction process separately for the four sets of nozzle groups of the print device 3 for the respective colors of nozzle groups by selecting the OPEN/CLOSE states of the respective valves 326*a* through 326*d*. This makes it possible to suck (vacuum) only the nozzle group that needs the pump-suction process, and waste-less recovery processing can be thus performed. FIG. 43 shows a case where tube pump 320 sucks four colors of ink by the same tube 321; however, the tube pump 320 may include tubes for respective four colors.

The ink jet printer 1 of the invention as described above operates along the flow described below when detection by the ejection failure detecting device 10 is performed for all the nozzles 110. The following description will describe sequentially two patterns of the flow of the operation by the ink jet printer 1 of the invention after detection by the ejection failure detecting device 10 is performed. To begin with, a first pattern will be described.

1A. The ink jet printer 1 performs detection by the ejection failure detecting device 10 for all the nozzles 110 during the flushing process (flushing operation) or the printing operation as described above.

When the result of the detection shows the presence of a nozzle 110 in which an ejection failure is occurring (hereinafter, referred to as the failing nozzle), it is preferable that the ink jet printer 1 informs the user of such detection. Informing means (method) is not particularly limited, and any means can be used, for example, a display on the operation panel 7, a sound, an alarming sound, illumination of the lamp, transmission of ejection failure information to the host computer 8 via the IF 9 or to a print server over a network, etc.

2A. When the result of the detection in 1A shows the presence of a nozzle 110 in which an ejection failure is occurring (failing nozzle), the recovery processing is performed by the recovery device 24 (the printing operation is suspended when the printer 1 is performing the printing operation). In this case, the recovery device 24 performs the recovery processing of the type corresponding to the cause of an ejection failure of the failing nozzle according to the flowchart of FIG. 40 described above. This prevents, for example, the pump-suction process from being performed even in a case where the cause of an ejection failure of the failing nozzle is adhesion of paper dust, that is, in a case where the pump-suction process need not to be performed. It is thus possible to prevent ink from being wastefully discharged, which can in turn reduce ink consumption. Also, because the recovery processing of the types that need not to be performed will not be performed, a time needed for the recovery processing can be shortened, and the throughput (the number of printed sheets per unit time) of the inkjet printer 1 can be improved.

The recovery processing may be performed for all the nozzles 110; however, it is sufficient to perform the recovery processing at least for the failing nozzle. For example, in a case where the flushing process is performed as the recovery processing, only the failing nozzle may be forced to perform the flushing operation. In a case where the wiping means and the pumping means are configured to perform the recovery processing separately for the nozzle groups of respective colors as shown in FIG. 41 through FIG. 43, the wiping process or the pump-suction process may be performed only for the nozzle group including the failing nozzle detected in 1A.

In a case where a plurality of failing nozzles each having a different cause of an ejection failure are detected in 1A, it is preferable to perform the recovery processing of several types in order to eliminate the causes of all the ejection failures.

3A. When the recovery processing in 2A ends, the failing nozzle detected in 1A alone is forced to perform the droplet ejection operation, so that detection by the ejection failure detecting device 10 is performed again for this failing nozzle alone. This makes it possible to confirm whether the failing nozzle detected in 1A has been restored to a normal state, and the occurrence of an ejection failure during the printing operation performed later can be prevented in a more reliable manner.

Also, because the detection by the ejection failure detecting device 10 is performed by forcing the failing nozzle alone to perform the droplet ejection operation, the nozzles 110 judged as being normal in 1A do not have to eject ink drops. Hence, wasteful ejection of ink can be avoided, and ink consumption can be reduced. Further, the load on the ejection failure detecting device 10 and the control portion 6 can be reduced.

In a case where the detection in 3A still shows the presence of a nozzle 110 having an ejection failure, it is preferable to perform the recovery processing by the recovery device 24 again.

The following description will describe a second pattern of the flow of the operation after detection by the ejection failure detecting device 10 is performed in the ink jet printer 1 of the invention. In other words, in the invention, the control may be effected according to the flow including 1 B through 5B below instead of 1A through 3A described above.

1B. As with the above 1A, detection by the ejection failure detecting device 10 is performed for all the nozzles 110.

2B. When the result of the detection in 1B shows the presence of a nozzle 110 in which an ejection failure is occurring (hereinafter, referred to as the failing nozzle), the flushing process is performed for this failing nozzle alone (the printing operation is suspended when the printer 1 is performing the printing operation). In a case where the cause of an ejection failure of the failing nozzle is minor, the failing nozzle can be restored to the normal state by this flushing process. In this case, because ink drops are not ejected through the normal nozzles 110, ink is not consumed wastefully. When detection by the ejection failure detecting device 10 is performed frequently, the causes of ejection failures are often minor. Hence, by performing the flushing process first for the failing nozzle regardless of the cause of an ejection failure in this manner, the recovery processing can be performed efficiently and quickly.

3B. When the flushing process in 2B ends, the failing nozzle detected in 1B alone is forced to perform the droplet ejection operation, so that detection by the ejection failure detecting device 10 is performed again for this failing nozzle alone. This makes it possible to confirm whether the failing nozzle detected in 1B has been restored to the normal state, and the occurrence of an ejection failure during the printing operation performed later can be prevented in a more reliable manner.

Also, because detection by the ejection failure detecting device 10 is performed by forcing the failing nozzle alone to perform the droplet ejection operation, the nozzles 110 judged as being normal in 1B do not have to eject ink drops. Hence, wasteful ejection of ink can be avoided, and ink consumption can be reduced. Further, the load on the ejection failure detecting device 10 and the control portion 6 can be reduced.

4B. When the result of the detection in 3B shows the presence of a nozzle 110 in which an ejection failure has not been eliminated (hereinafter, referred to as the re-failing nozzle), the recovery processing by the recovery device 24 is performed. In this case, the recovery device 24 performs the recovery processing of the type corresponding to the cause of an ejection failure of the re-failing nozzle according to the flowchart of FIG. 40 described above. This prevents, for example, the pump-suction process from being performed even in a case where the cause of an ejection failure of the re-failing nozzle is adhesion of paper dust, that is, in a case where the pump-suction process need not be performed. It is thus possible to prevent ink from being wastefully discharged, which can in turn reduce ink consumption. Also, because the recovery processing of the types that need not to be performed will not be performed, a time needed for the recovery processing can be shortened, and the throughput (the number of printed sheets per unit time) of the ink jet printer 1 can be improved.

Because the flushing process is already performed in 2B, it is preferable to perform other types of the recovery processing in 4B. In other words, in a case where the cause of an ejection failure of the re-failing nozzle is intrusion of an air bubble or thickening caused by drying, it is preferable to perform the pump-suction process, and in a case where the cause is adhesion of paper dust, it is preferable to perform the wiping process by the wiper 300 or 300'.

It should be noted that 4B is the same as the above 2A other than the points described above.

5B. When the recovery processing in 4B ends, the re-failing nozzle detected in 3B alone is forced to perform the droplet ejection operation, so that detection by the ejection failure detecting device 10 is performed once again for this re-failing nozzle alone. This makes it possible to confirm whether the re-failing nozzle detected in 3B has been restored to the normal state, and the occurrence of an ejection failure during the printing operation performed later can be prevented in a more reliable manner.

Also, because detection by the ejection failure detecting device 10 is performed by forcing the re-failing nozzle alone to perform the droplet ejection operation, the nozzles 110 judged as being normal in 1B or 3B do not have to eject ink drops. Hence, wasteful ejection of ink can be avoided, and ink consumption can be reduced. Further, the load on the ejection failure detecting device 10 and the control portion 6 can be reduced.

In 1A through 3A and 1B through 5B described above, it is preferable to perform the flushing process for the respective nozzles 110 (all the nozzles 110) after the recovery processing of the type corresponding to the cause of an ejection failure is performed. This makes it possible to prevent mixing of ink of respective colors by forestalling ink of respective colors remaining on the nozzle surface (nozzle plate 150) from being mixed.

As has been described, the droplet ejection apparatus (ink jet printer 1) and the ejection failure recovery method for the droplet ejection apparatus in this embodiment include: the ejection failure detecting device 10 for detecting an ejection failure and the cause thereof for a plurality of droplet ejection heads (a plurality of ink jet heads 100 of the head unit 35); and the recovery means (for example, the tube pump 320 used in the pump-suction process, the wiper 300 used in the wiping process, etc.) for performing the recovery processing depending on the cause of an ejection failure in a case where an ejection failure is detected for a nozzle 110 by the ejection failure detecting device 10 when the nozzles 110 of the droplet ejection heads 100 performed the ejection operation of the droplets.

Hence, because adequate recovery processing (one or two of the flushing process, pump-suction process, and wiping process) corresponding to the cause of an ejection failure can be performed by the droplet ejection apparatus and the ejection failure recovery method of the invention, different from the sequential recovery processing performed in the conventional droplet ejection apparatus, it is possible to reduce wastefully discharged ink generated when the recovery processing is performed, which can in turn prevent a reduction or deterioration of the throughput of the entire droplet ejection apparatus.

Also, the droplet ejection apparatus (ink jet printer 1) of the invention is configured in such a manner that the diaphragm 121, which is displaced when the electrostatic actuator 120 is driven, is provided to the droplet ejection head (ink jet head 100), and the ejection failure detecting device 10 detects an ejection failure of the droplets on the basis of the vibration pattern (for example, the cycle of the residual vibration) of the residual vibration of the diaphragm 121 during the droplet ejection operation.

Hence, compared with the conventional droplet ejection apparatus capable of detecting an ejection failure, the invention does not need other parts (for example, optical missing dot detecting device or the like). As a result, not only can an ejection failure of the droplets be detected without increasing the size of the droplet ejection head, but also the manufacturing costs of the droplet ejection apparatus capable of performing ejection failure (missing dot) detection can be reduced. Also, because the droplet ejection apparatus of the invention detects an ejection failure of the droplets through the use of the residual vibration of the diaphragm after the droplet ejection operation, an ejection failure of the droplets can be detected even during the print operation.

Second Embodiment

Examples of other configurations of the ink jet head of the invention will now be described. FIG. 44 through FIG. 47 are cross sections schematically showing examples of other configurations of the ink jet head (head unit). Hereinafter, an explanation will be given with reference to these drawings; however, differences from the embodiment described above are chiefly described, and the description of the similar portions is omitted.

Figure 44:
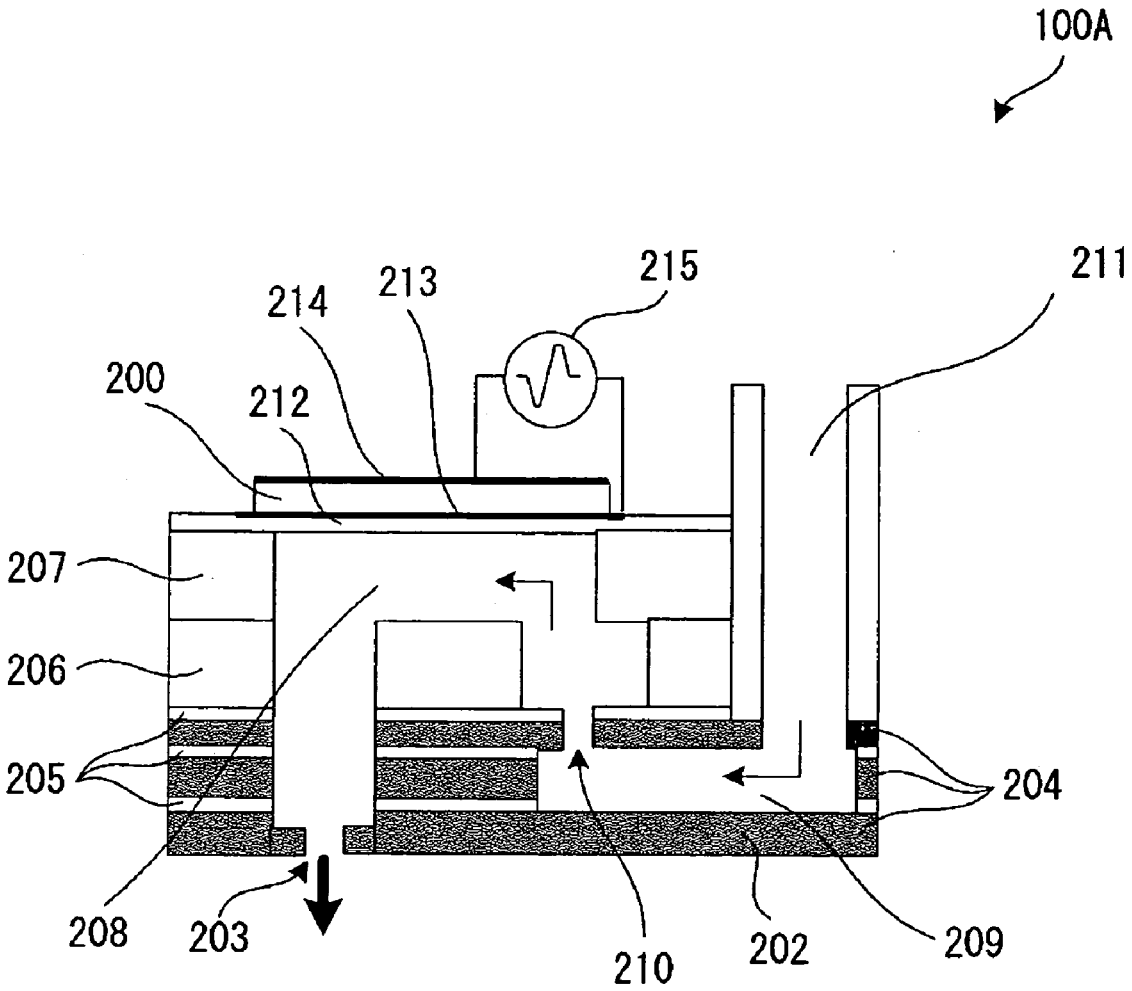
FIG. 44 is a cross section schematically showing an example of another configuration of the ink jet head of the invention.

An ink jet head 100A shown in FIG. 44 is of a type that ejects ink (liquid) within a cavity 208 through a nozzle 203 as a diaphragm 212 vibrates when a piezoelectric element 200 is driven. A metal plate 204 made of stainless steel is bonded to a nozzle plate 202 made of stainless steel in which the nozzle (hole) 203 is formed, via an adhesive film 205, and another metal plate 204 made of stainless steel is further bonded to the first-mentioned metal plate 204 via an adhesive film 205. Further, a communication port forming plate 206 and a cavity plate 207 are sequentially bonded to the second-mentioned metal plate 204.

The nozzle plate 202, the metal plates 204, the adhesive films 205, the communication port forming plate 206, and the cavity plate 207 are molded into their respective predetermined shapes (a shape in which a concave portion is formed), and the cavity 208 and a reservoir 209 are defined by laminating these components. The cavity 208 and the reservoir 209 communicate with each other via an ink supply port 210. Also, the reservoir 209 communicates with an ink intake port 211.

The diaphragm 212 is placed at the upper surface opening portion of the cavity plate 207, and a piezoelectric element 200 is bonded to the diaphragm 212 via a lower electrode 213. Also, an upper electrode 214 is bonded to the piezoelectric element 200 on the opposite side of the lower electrode 213. A head drive 215 is provided with a driving circuit that generates a driving voltage waveform. The piezoelectric element 200 starts to vibrate when a driving voltage waveform is applied (supplied) between the upper electrode 214 and the lower electrode 213, and so does the diaphragm 212 bonded to the piezoelectric element 200. The volume (internal pressure of the cavity) of the cavity 208 varies with the vibration of the diaphragm 212, and ink (liquid) filled in the cavity 208 is thereby ejected through the nozzle 203 in the form of droplets.

A reduced quantity of liquid in the cavity 208 due to the ejection of droplets is replenished as ink is supplied from the reservoir 209. Also, ink is supplied to the reservoir 209 through the ink intake port 211.

Figure 45:
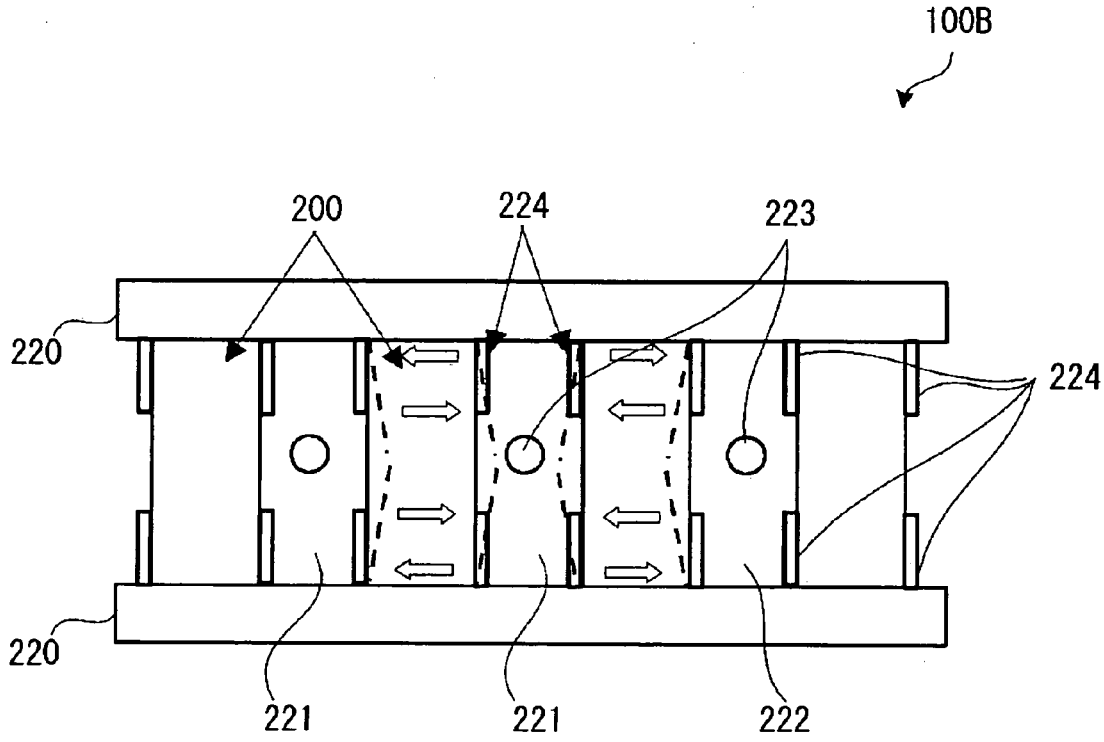
FIG. 45 is a cross section schematically showing an example of still another configuration of the ink jet head of the invention.

Likewise, an ink jet head 100B shown in FIG. 45 is of a type that ejects ink (liquid) within a cavity 221 through a nozzle when the piezoelectric element 200 is driven. The ink jet head 100B includes a pair of opposing substrates 220, and a plurality of piezoelectric elements 200 are placed intermittently at predetermined intervals between both substrates 220.

Cavities 221 are formed between adjacent piezoelectric elements 200. A plate (not shown) and a nozzle plate 222 are placed in front and behind the cavities 221 of FIG. 45, respectively, and nozzles. (holes) 223 are formed in the nozzle plate 222 at positions corresponding to the respective cavities 221.

A pair of electrodes 224 is placed on one surface and also on the other surface of each piezoelectric element 200. That is to say, four electrodes 224 are bonded to one piezoelectric element 200. When a predetermined driving voltage waveform is applied between predetermined electrodes of these electrodes 224, the piezoelectric element 200 undergoes share-mode deformation and starts to vibrate (indicated by arrows in FIG. 45). The volume of the cavities 221 (internal pressure of cavity) varies with the vibration, and ink (liquid) filled in the cavities 221 is thereby ejected through nozzles 223 in the form of droplets. In other words, the piezoelectric elements 200 per se function as the diaphragms in the ink jet head 100B.

Figure 46:
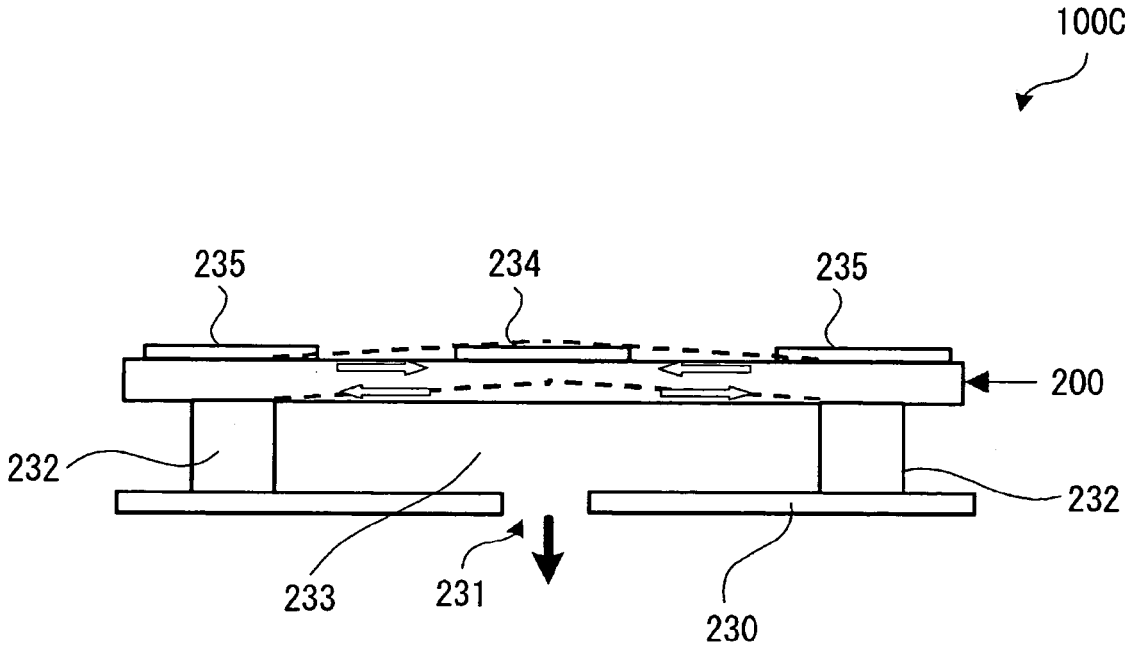
FIG. 46 is a cross section schematically showing an example of still another configuration of the ink jet head of the invention.

Likewise, an ink jet head 100C shown in FIG. 46 is of a type that ejects ink (liquid) within a cavity 233 through a nozzle 231 when the piezoelectric element 200 is driven. The ink jet head 100C is provided with a nozzle plate 230 in which the nozzle 231 is formed, spacers 232, and the piezoelectric element 200. The piezoelectric element 200 is placed to be spaced apart from the nozzle plate 230 by a predetermined distance with the spacers 232 in between, and the cavity 233 is defined by a space surrounded by the nozzle plate 230, the piezoelectric element 200, and the spacers 232.

A plurality of electrodes are bonded to the top surface of the piezoelectric element 200 of FIG. 46. To be more specific, a first electrode 234 is bonded to nearly the center portion of the piezoelectric element 200, and a second electrode 235 is bonded on either side thereof. When a predetermined driving voltage waveform is applied between the first electrode 234 and the second electrodes 235, the piezoelectric element 200 undergoes share-mode deformation and starts to vibrate (indicated by arrows of FIG. 46). The volume of the cavity 233 (internal pressure of cavity) varies with the vibration, and ink (liquid) filled in the cavity 233 is thereby ejected through nozzle 231 in the form of droplets. In other words, the piezoelectric element 200 per se functions as the diaphragm in the ink jet head 100C.

Figure 47:
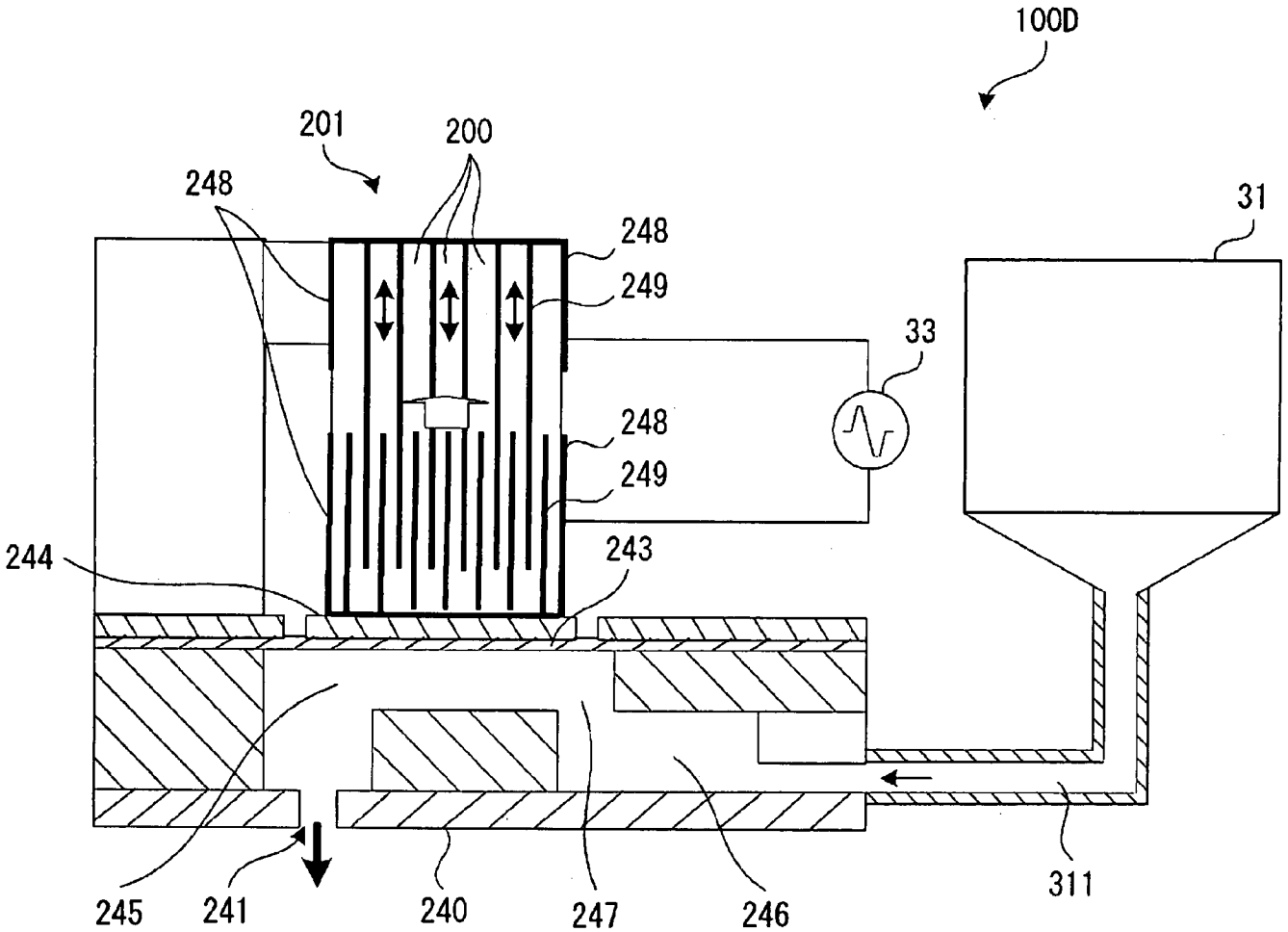
FIG. 47 is a cross section schematically showing an example of still another configuration of the ink jet head of the invention.

Likewise, an ink jet head 100D shown in FIG. 47 is of a type that ejects ink (liquid) within a cavity 245 through a nozzle 241 when the piezoelectric element 200 is driven. The ink jet head 100D is provided with a nozzle plate 240 in which the nozzle 241 is formed, a cavity plate 242, a diaphragm 243, and a layered piezoelectric element 201 comprising a plurality of layered piezoelectric elements 200.

The cavity plate 242 is molded into a predetermined shape (a shape in which a concave portion is formed), by which the cavity 245 and a reservoir 246 are defined. The cavity 245 and the reservoir 246 communicate with each other via an ink supply port 247. Also, the reservoir 246 communicates with an ink cartridge 31 via an ink supply tube 311.

The lower end of the layered piezoelectric element 201 of FIG. 47 is bonded to the diaphragm 243 via an intermediate layer 244. A plurality of external electrodes 248 and internal electrodes 249 are bonded to the layered piezoelectric element 201. To be more specific, the external electrodes 248 are bonded to the outer surface of the layered piezoelectric element 201 and the internal electrodes 249 are provided in spaces (or inside each piezoelectric element) between piezoelectric elements 200 that together form the layered piezoelectric element 201. In this case, the external electrodes 248 and the internal electrodes 249 are placed so that parts of them are layered alternatively in the thickness direction of the piezoelectric element 200.

By applying a driving voltage waveform between the external electrodes 248 and the internal electrodes 249 by the head driver 33, the layered piezoelectric element 201 undergoes deformation (contracts in the vertical direction of FIG. 47) and starts to vibrate as is indicated by arrows of FIG. 47, and so do the diaphragms 243 due to this vibration. The volume of the cavity 245 (internal pressure of cavity) varies with the vibration of the diaphragm 243, and ink (liquid) filled in the cavity 245 is thereby ejected through the nozzle 241 in the form of droplets.

A reduced quantity of liquid in the cavity 245 due to the ejection of droplets is replenished as ink is supplied from the reservoir 246. Also, ink is supplied to the reservoir 246 from the ink cartridge 31 through the ink supply tube 311.

As with the ink jet head 100 of the electric capacitance type as described above, the ink jet heads 100A through 100D provided with piezoelectric elements are also able to detect an ejection failure of droplets and identify the cause of the failure on the basis of the residual vibration of the diaphragm or the piezoelectric element functioning as the diaphragm. Alternatively, for the ink jet heads 100B and 100C, a diaphragm (diaphragm used to detect the residual vibration) serving as a sensor may be provided at a position facing the cavity, so that the residual vibration of this diaphragm is detected.

Third Embodiment

Figure 48:
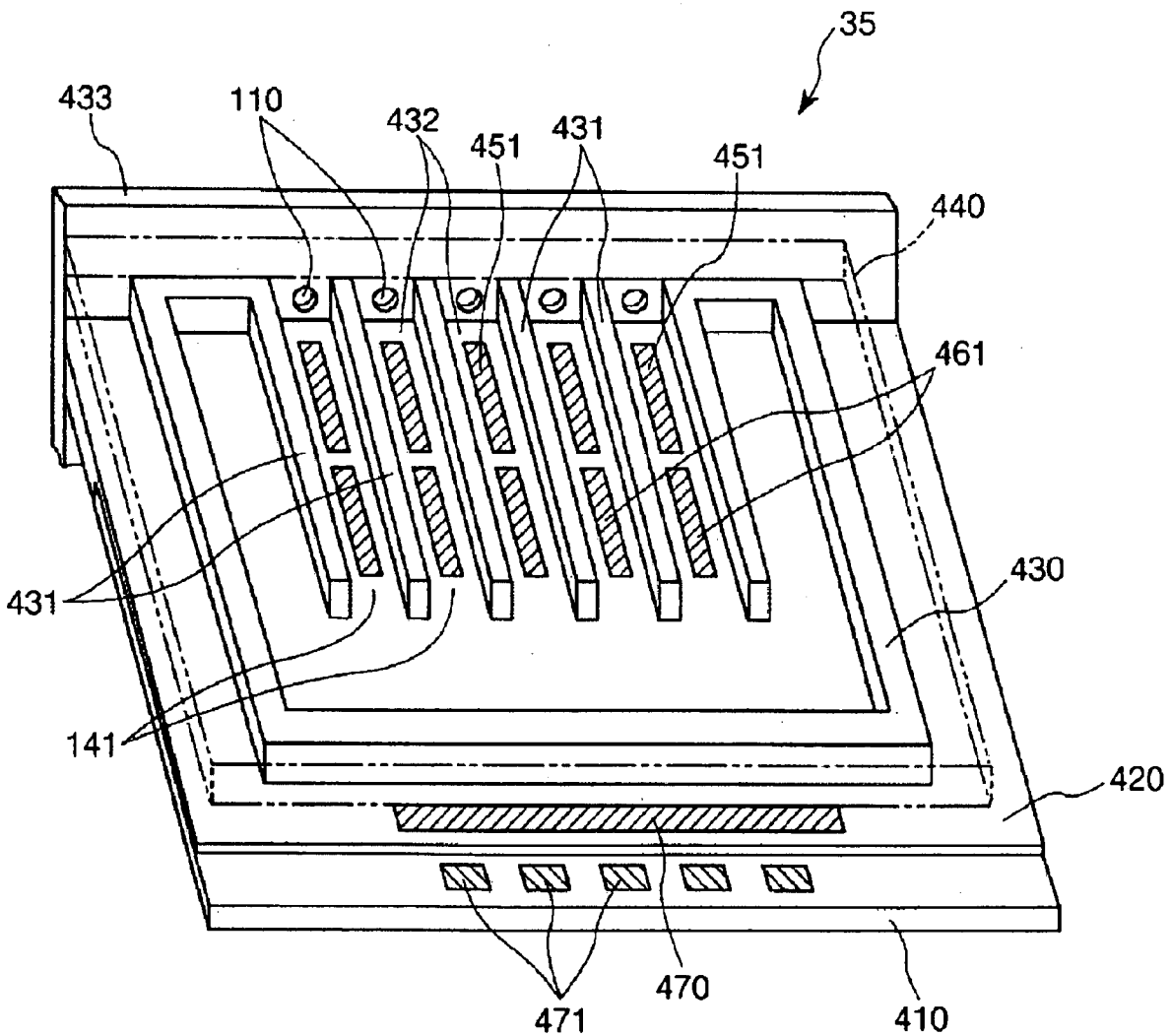
FIG. 48 is a perspective view showing the configuration of a head unit according to a third embodiment.
Figure 49:
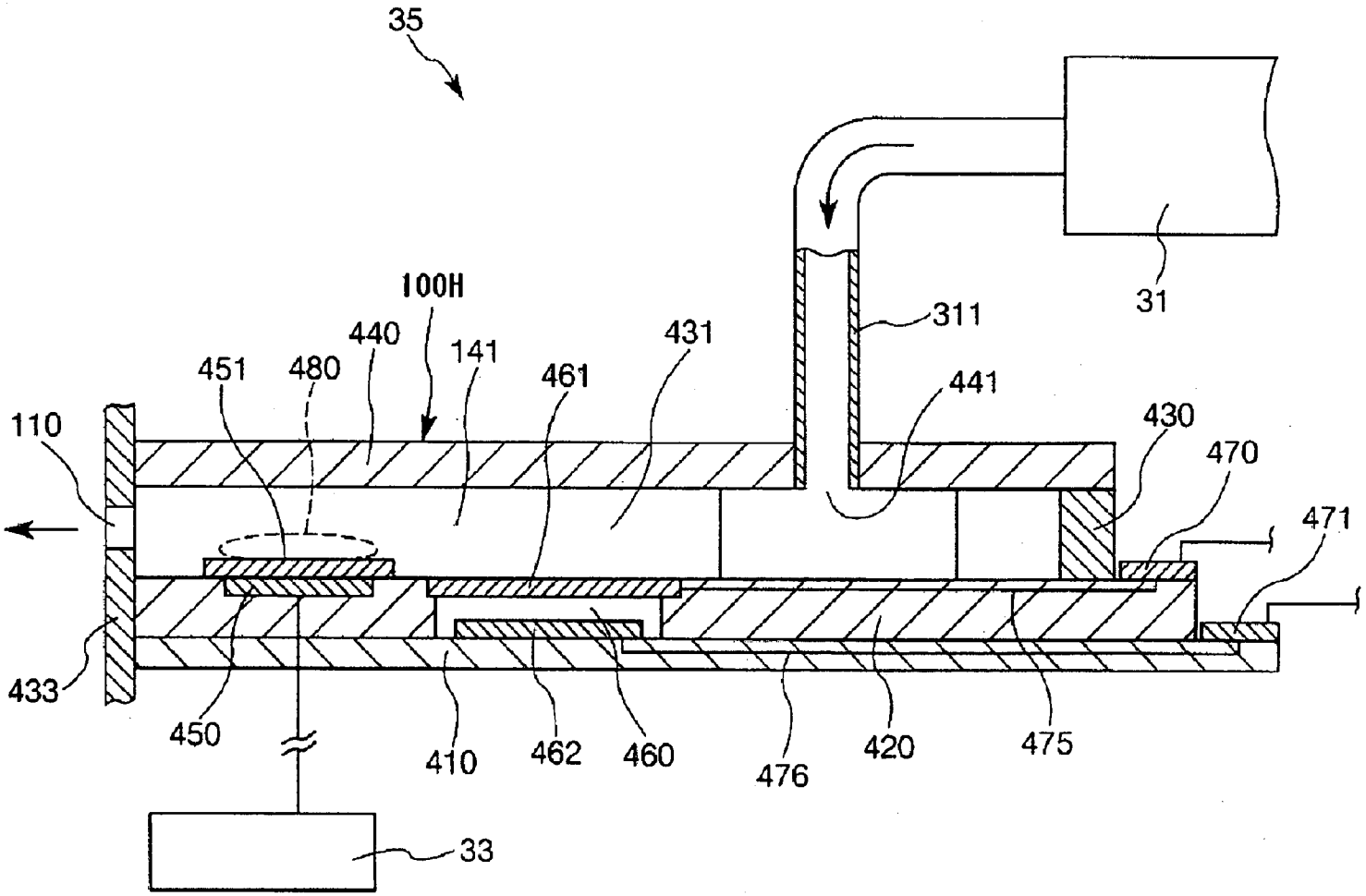
FIG. 49 is a cross section of the head unit (ink jet head) shown in FIG. 48.

An example of still another configuration of the ink jet head of the invention will now be described. FIG. 48 is a perspective view showing the configuration of a head unit 35 of this embodiment. FIG. 49 is a cross section of the head unit 35 (ink jet head 100H) shown in FIG. 48. Hereinafter, an explanation will be given with reference to these drawings; however, differences from the embodiments above will be chiefly described, and the description of the similar portions is omitted.

The head unit 35 (ink jet head 100H) shown in FIG. 48 and FIG. 49 is of a so-called film boiling ink jet type (thermal jet type), and is provided with a supporting plate 410, a substrate 420, an outer wall 430, partition walls 431, and a top plate 440, which are bonded to each other in this order from bottom to top of FIG. 48 and FIG. 49.

The substrate 420 and the top plate 440 are placed so that they are spaced apart by a predetermined interval with having in between the outer wall 430 and a plurality of (six in the case of the drawings) partition walls 431 aligned in parallel at regular intervals. A plurality of (five in the case of the drawings) cavities (pressure chambers: ink chambers) 141 are defined in a space between the substrate 420 and the top plate 440 by the partition walls 431. Each cavity 141 is shaped like a strip (rectangular prism).

Also, as is shown in FIG. 48 and FIG. 49, the left ends of the respective cavities 141 of FIG. 49 (top ends of FIG. 48) are covered with a nozzle plate (front plate) 433. The nozzle plate 433 is provided with nozzles (holes) 110 communicating with the respective cavities 141, and ink (liquid material) is ejected through these nozzles 110.

In FIG. 48, the nozzles 110 are aligned linearly, that is, in a row, with respect to the nozzle plate 433. It goes without saying, however, that the alignment pattern of the nozzles is not limited to this pattern.

The nozzle plate 433 may be omitted, and instead, it may be configured in such a manner that the top ends of the respective cavities 141 of FIG. 48 (left ends of FIG. 49) are open, and these opened openings are used as the nozzles.

Also, an ink intake port 441 is formed in the top plate 440, and an ink cartridge 31 is connected to the ink intake port 441 via an ink supply tube 311.

Heating elements 450 are provided (buried) in the substrate 420 at positions corresponding to the respective cavities 141. The heating elements 450 electrically conduct and heat separately with the use a head driver (electrically conducting means) 33 including a driving circuit 18. The head driver 33 outputs, for example, a pulsed signal, as a driving signal of the heating elements 450 in response to the printing signal (print data) inputted from the control portion 6.

The surface of each heating element 450 on the cavity 141 side is covered with a protection film (cavitation-proof film) 451. The protection film 451 is provided to prevent the heating elements 450 from coming into direct contact with ink within the cavities 141. By providing the protection film 451, it is possible to prevent degeneration, deterioration, etc. caused when the heating elements 450 come into contact with ink.

Concave portions 460 are formed in the substrate 420 at the positions in the vicinity of the respective heating elements 450 and corresponding to the respective cavities 141. The concave portions 460 can be formed, for example, by etching, stamping, etc.

A diaphragm 461 is provided to shield each concave portion 460 on the cavity 141 side. The diaphragm 461 undergoes elastic deformation (displaces elastically) in the vertical direction of FIG. 49 in association with a change in internal pressure (liquid pressure) of the cavity 141.

The diaphragm 461 also functions as an electrode. The diaphragm 461 may comprise an electrical conductive material as a whole or a lamination of an electrical conductive layer and a dielectric layer.

On the other hand, the other side of the concave portion 460 is covered with the supporting plate 410, and electrodes (segment electrodes) 462 are provided on the supporting plate 410 on the top surface of FIG. 49 at positions corresponding to the respective diaphragms 461.

The diaphragm 461 and the electrode 462 are provided oppositely in approximately parallel to be spaced apart by a predetermined distance.

A parallel plate capacitor can be formed by placing the diaphragm 461 and the electrode 462 to be spaced apart by a slight distance in this manner. When the diaphragm 461 displaces (deforms) elastically in the vertical direction of FIG. 49 in association with an internal pressure of the cavity 141, a distance of the space between the diaphragm 461 and the electrode 462 varies as well, which causes the electric capacitance of the parallel plate capacitor to vary. In the ink jet head 100H, the diaphragm 461 and the electrode 462 function as a sensor that detects a failure of the ink jet head 100H on the basis of variance with time of the electric capacitance associated with the vibration (residual vibration (damped vibration)) of the diaphragm 461.

A common electrode 470 is formed on the substrate 420 outside of the cavities 141. Also, segment electrodes 471 are formed on the supporting plate 410 outside of the cavities 141. Each of the electrodes 462, the common electrode 470, and the segment electrodes 471 can be formed, for example, by bonding of metal foil, plating, vapor deposition, sputtering, etc.

The respective diaphragms 461 and the common electrode 470 are electrically connected to each other by a conductor 475. The respective electrodes 462 and the respective segment electrodes 471 are electrically connected to each other by a conductor 476.

The conductors 475 and 476 may comprise (1) installation of conducting wire, such as a metal wire, (2) a thin film-made on the surface of the substrate 420 or the supporting plate 410 out of an electrical conductive material, such as gold and copper, (3) a conductor forming site in the substrate 420 or the like provided with electrical conduction by doping ions therein, etc.

The function (operation principle) of the ink jet head 100H will now be described.

When the heating elements 450 electrically conduct as a driving signal (pulse signal) is outputted from the head driver 33, the heating elements 450 heat instantaneously to a temperature as high as or higher than 300° C. This generates an air bubble (different from the aforementioned air bubble that is generated and intrudes inside the cavity to cause an ejection failure) 480 on the protection film 451 due to film boiling, and the air bubble 480 swells instantaneously. This raises the liquid pressure of ink (liquid material) filled in the cavity 141, and part of ink is thereby ejected through the nozzle 110 in the form of droplets.

A reduced quantity of liquid within the cavity 141 due to the ejection of the ink drops is replenished as new ink is supplied through the ink intake port 441 to the cavity 141. This ink is supplied from the ink cartridge 31 by flowing through the ink supply tube 311.

The air bubble 480 contracts abruptly immediately after the droplets of ink are ejected, and restores to the original state. The diaphragm 461 displaces (deforms) elastically with a change in internal pressure of the cavity 141 in this instance, which gives rise to damped vibration (residual vibration) that lasts until ink drops are ejected again upon input of the following driving signal. Once the diaphragm 461 starts the damped vibration, the electric capacitance of the capacitor comprising the diaphragm 461 and the opposing electrode 462 starts to vary. The ink jet head 100H of this embodiment is able to detect an ejection failure in the same manner as the ink jet head 100 of the first embodiment described above, by using variance with time of the electric capacitance.

While the droplet ejection apparatus and the ejection failure recovery method for the droplet ejection apparatus of the invention have been described by way of embodiments shown in the drawings, it is to be understood that the invention is not limited to these embodiments, and respective portions forming the droplet ejection head or the droplet ejection apparatus can be replaced with an arbitrary arrangement capable of functioning in the same manner. Also, another arbitrary component may be added to the droplet ejection head or the droplet ejection apparatus of the invention.

Liquid to be ejected (droplets) ejected through a droplet ejection head (ink jet head 100 in the embodiments above) in the droplet ejection apparatus of the invention is not particularly limited, and for example, it may be liquid (including dispersion liquid, such as suspension and emulsion) containing various materials as follows. That is, a filter material (ink) for a color filter, a light-emitting material forming an EL (Electroluminescence) light-emitting layer in an organic EL apparatus, a fluorescent material forming a fluorescent body on an electrode in an electron emitting device, a fluorescent material forming a fluorescent body in a PDP (Plasma Display Panel), a migration material forming a migration body in an electrophoresis display device, a bank material forming a bank on the surface of a substrate W, coating materials of various kinds, a liquid electrode material forming an electrode, a particle material forming a spacer to provide a minute cell gap between two substrates, a liquid metal material forming metal wiring, a lens material forming a micro lens, a resist material, a light-scattering material for forming a light-scattering body, liquid materials for various tests used in a bio-sensor, such as a DNA chip and a protein chip, etc.

Also, in the invention, a droplet receptor to which droplets are ejected is not limited to paper, such as a recording sheet, and it may be other media, such as a film, a woven cloth, and a non-woven cloth, or a workpiece, such as various substrates including a glass substrate and a silicon substrate.

Also, in the droplet ejection apparatus and the ejection failure recovery method for the droplet ejection apparatus of the invention, the means and method of detecting an ejection failure and the cause thereof are not limited to the method of detecting and analyzing the vibration pattern of the residual vibration of the diaphragm 121 as described above, and adequate recovery processing can be selected by using any detecting method, as long as the cause of an ejection failure is identified. As an ejection failure (missing dot) detecting method, for example, methods as follows are conceivable. That is, a method in which a beam of light from an optical sensor, such as a laser, is directly irradiated to and reflected from the ink meniscus inside the nozzle, and the vibration state of the meniscus is detected by a light-reception element, so that the cause of blocking is identified from the vibration state; a method in which the presence or absence of the droplets is detected with the use of a typical optical missing dot detecting device (detecting whether flight droplets fall within a detectable range of the sensor) and from the measurement result of an elapsed time after the ejection operation, and a phenomenon occurring within a drying time is assumed as drying, and a phenomenon occurring outside the drying time is assumed as paper dust or air bubbles on the basis of the elapsed time data of the ink jet head in the event of a missing dot; and a method in which a vibration sensor is added to the above configuration, and whether vibration that allows intrusion of air bubbles is added before the occurrence of the missing dot is judged, so that an air bubble is assumed to have intruded when such vibration was added (in this case, the missing dot detecting means is not limited to an optical type, and for example, the detecting means may be of a heat sensitive type that detects a change in temperature of a heat sensor portion upon ejection of ink, a method of detecting a change in quantity of charges in a detection electrode onto which charged ink drops are ejected and land, or of an electric capacitance type in which a change is caused when ink droplets pass through a space between the electrodes). Also, as a detecting method of the adhesion of paper dust, a method of detecting a state of the head surface by a camera or the like as image information, or a method of detecting the presence or absence of adhesion of paper dust by scanning the vicinity of the head surface with the use of an optical sensor, such as a laser, are conceivable.

The pump-suction recovery process, one type of recovery processing performed by the recovery device 24, is the process effective in the case of serious thickening caused by drying and in the case of intrusion of an air bubble, and a similar recovery process can be performed for each cause. Hence, when ink jet heads 100 failing due to the intrusion of an air bubble and thickening caused by drying that need the pump-suction process are detected in the head unit 35, the processing may not be determined separately as in Steps S905 through S907 in the flowchart of FIG. 40, and instead, the pump-suction process may be performed at one time for both the ink jet head 100 failing due to intrusion of an air bubble and the ink jet head 100 failing due to thickening caused by drying. In other words, after the judgment is made as to whether paper dust is adhering in the vicinity of the nozzle 110, the pump-suction process may be performed without judging whether the cause is intrusion of an air bubble or thickening caused by drying.

What is claimed is:

1. A droplet ejection apparatus having a head unit including a plurality of droplet ejection heads each ejecting liquid within a cavity through a nozzle in the form of droplets by driving an actuator by way of a driving circuit, said apparatus comprising:

ejection failure detecting means for detecting an ejection failure of said droplet ejection heads and a cause thereof; and recovery means for performing recovery processing depending on the cause of the ejection failure if said ejection failure detecting means detects the ejection failure;

wherein each of said droplet ejection heads includes a diaphragm that is displaced when the actuator is driven and said ejection failure detecting means detects a residual vibration of said diaphragm and determines an ejection failure of said droplets based on a vibration pattern of the detected residual vibration of said diaphragm;

wherein said ejection failure detecting means includes judging means for judging at least one of a presence and an absence of an ejection failure of the droplets in the corresponding droplet ejection head based on the vibration pattern of the residual vibration of said diaphragm, and judging the cause of the ejection failure upon judging the presence of the ejection failure of the droplets in said droplet ejection head, said vibration pattern of the residual vibration of said diaphragm including a cycle of the residual vibration; and wherein said judging means judges that:

an air bubble has intruded inside said cavity when the cycle of the residual vibration of said diaphragm is shorter than a predetermined first period;

the liquid has thickened in the vicinity of said nozzle when the cycle of the residual vibration of said diaphragm is longer than a predetermined second period; and dust is adhering in the vicinity of the outlet of said nozzle when the cycle of the residual vibration of said diaphragm is longer than said first period and shorter than said second period.

2. The droplet ejection apparatus according to claim 1, wherein said recovery means includes:

wiping means for performing, with the use of a wiper, a wiping process on nozzle surfaces of said droplet ejection heads where said nozzles are aligned;

flushing means for performing a flushing process by which the droplets are preliminarily ejected through said nozzles by driving said actuators; and pumping means for performing a pump-suction process with the use of a pump connected to a cap covering the nozzle surfaces of said droplet ejection heads.

3. The droplet ejection apparatus according to claim 2, wherein:

the cause of an ejection failure detectable by said ejection failure detecting means includes:

intrusion of an air bubble inside said cavity;

thickening of the liquid in a vicinity of said nozzle; and adhesion of dust in a vicinity of an outlet of said nozzle; and said recovery means performs the pump-suction process by said pumping means in a case of the intrusion of an air bubble, at least one of the flushing process by said flushing means and the pump-suction process by said pumping means in a case of the thickening of the liquid, and at least the wiping process by said wiper in a case of the adhesion of dust.

4. The droplet ejection apparatus according to claim 3, wherein:

when said ejection failure detecting means detects the intrusion of an air bubble and the thickening of the liquid that need said pump-suction process in more than one droplet ejection head of said head unit, said recovery means performs the pump-suction process for the droplet ejection heads where the intrusion of an air bubble and the thickening of the liquid are detected.

5. The droplet ejection apparatus according to claim 1, wherein:

said ejection failure detecting means includes an oscillation circuit and said oscillation circuit oscillates based on an electric capacitance component of said actuator that varies with the residual vibration of said diaphragm.

6. The droplet ejection apparatus according to claim 5, wherein:

said oscillation circuit forms a CR oscillation circuit from the electric capacitance component of said actuator and a resistance component of a resistor element connected to said actuator.

7. The droplet ejection apparatus according to claim 5, wherein:

said ejection failure detecting means includes an F/V converting circuit that generates a voltage waveform of the residual vibration of said diaphragm from a predetermined signal group generated based on a change of an oscillation frequency in an output signal from said oscillation circuit.

8. The droplet ejection apparatus according to claim 7, wherein:

said ejection failure detecting means includes a waveform shaping circuit that shapes the voltage waveform of the residual vibration of said diaphragm generated in said F/V converting circuit into a predetermined waveform.

9. The droplet ejection apparatus according to claim 8, wherein said waveform shaping circuit includes:

DC component removing means for removing a direct current component from the voltage waveform of the residual vibration of said diaphragm generated in said F/V converting circuit; and a comparator that compares the voltage waveform, from which the direct current component has been removed by said DC component removing means with a predetermined voltage value, said comparator generating and outputting a rectangular wave based on the voltage comparison.

10. The droplet ejection apparatus according to claim 9, wherein:

said ejection failure detecting means includes measuring means for measuring a cycle of the residual vibration of said diaphragm from said rectangular wave generated in said waveform shaping circuit.

11. The droplet ejection apparatus according to claim 10, wherein:

said measuring means has a counter, and measures at least one of a time between rising edges and a time between a rising edge and a falling edge of said rectangular wave by counting pulses of a reference signal with said counter.

12. The droplet ejection apparatus according to claim 1, further comprising:

switching means for switching a connection of said actuator from said driving circuit to said ejection failure detecting means after an ejection operation of the droplets is performed by driving said actuator.

13. The droplet ejection apparatus according to claim 12, wherein:

said droplet ejection apparatus comprises more than one ejection failure detecting means and more than one switching means; and the switching means corresponding to said droplet ejection head that has performed the droplet ejection operation switches the connection of said actuator from said driving circuit to a corresponding ejection failure detecting means, and said switched ejection failure detecting means detects an ejection failure of said droplets.

14. The droplet ejection apparatus according to claim 12, wherein:

said switching means comprises more than one unit switching means corresponding to said droplet ejection heads, respectively;

said ejection failure detecting means further includes detection determining means for determining for which nozzle among said nozzles detection of an ejection failure of said droplets is to be performed; and said switching means switches a connection of said actuator from said driving circuit to said ejection failure detecting means after the ejection operation of said droplets is performed by driving said actuator corresponding to the nozzle of said droplet ejection head determined by said detection determining means.

15. The droplet ejection apparatus according to claim 1, wherein:

said ejection failure detecting means detects an ejection failure of said droplets at a time of at least one of the droplet ejection operation during the flushing process and the droplet ejection operation during a print operation by said nozzle as a target of detection.

16. The droplet ejection apparatus according to claim 1, wherein:

said actuator comprises an electrostatic actuator.

17. The droplet ejection apparatus according to claim 1, wherein:

said actuator comprises a piezoelectric actuator using a piezoelectric effect of a piezoelectric element.

18. The droplet ejection apparatus according to claim 1, further comprising:

storage means for storing the cause of an ejection failure of said droplets detected by said ejection failure detecting means, in connection with said nozzle as the target of detection.

19. A droplet ejection apparatus, provided with a plurality of droplet ejection heads each ejecting a liquid through a nozzle communicating with a cavity in the form of droplets by changing an internal pressure of said cavity filled with the liquid by driving an actuator with a driving circuit, for ejecting the droplets through said nozzles while scanning said droplet ejection heads relatively with respect to a droplet receptor so that the droplets land on said droplet receptor, said apparatus comprising:

ejection failure detecting means for detecting an ejection failure of the droplets through said nozzles and a cause thereof;

recovery means for performing recovery processing for said droplet ejection heads to eliminate the cause of the ejection failure of the droplets; and storage means for storing a nozzle where the ejection failure is detected by said ejection failure detecting means, in connection with the cause thereof, wherein if detection by said ejection failure detecting means is performed for all of said nozzles and the presence of a failing nozzle in which an ejection failure is occurring is detected, recovery processing depending on the cause of the ejection failure is performed by said recovery means at least for said failing nozzle, after which detection by said ejection failure detecting means is performed again by forcing said failing nozzle alone to perform a droplet ejection operation.

20. The droplet ejection apparatus according to claim 19, wherein said recovery means includes:

wiping means for performing a wiping process by which nozzle surfaces of said droplet ejection heads, where said nozzles are aligned, are wiped with a wiper;

flushing means for performing a flushing process by which the droplets are preliminarily ejected through said nozzles by driving said actuators; and pumping means for performing a pump-suction process with the use of a pump connected to a cap covering the nozzle surfaces of said droplet ejection heads.

21. The droplet ejection apparatus according to claim 20, wherein:

the cause of an ejection failure detectable by said ejection failure detecting means includes:

intrusion of an air bubble inside said cavity;

thickening of the liquid in a vicinity of said nozzle; and adhesion of dust in a vicinity of an outlet of said nozzle; and said recovery means performs the pump-suction process by said pumping means if the cause of the ejection failure of said failing nozzle is the intrusion of an air bubble, at least one of the flushing process by said flushing means and the pump-suction process by said pumping means if the cause of the ejection failure of said failing nozzle is the thickening of the liquid, and at least the wiping process by said wiper if the cause of the ejection failure of said failing nozzle is the adhesion of dust.

22. The droplet ejection apparatus according to claim 20, wherein:

said recovery means performs the flushing process for each of said nozzles after the recovery processing depending on the cause of the ejection failure is performed.

23. The droplet ejection apparatus according to claim 20, wherein:

said wiping means is adapted to perform the wiping process separately for plural sets of nozzle groups, so that when performing the wiping process depending on the cause of the ejection failure of said failing nozzle or said re-failing nozzle, said wiping means performs the wiping process only for a nozzle group including said failing nozzle or said re-failing nozzle.

24. The droplet ejection apparatus according to claim 23, wherein:

said plural sets of nozzle groups have different droplets to be ejected.

25. The droplet ejection apparatus according to claim 20, wherein:

said pumping means is adapted to perform the pump-suction process separately for plural sets of nozzle groups, so that when performing the pump-suction process depending on the cause of the ejection failure of said failing nozzle or said re-failing nozzle, said pumping means performs the pump-suction process only for a nozzle group including said failing nozzle or said re-failing nozzle.

26. The droplet ejection apparatus according to claim 25, wherein:

said plural sets of nozzle groups have different droplets to be ejected.

27. The droplet ejection apparatus according to claim 19, further comprising:

informing means for informing a detection result when a result of detection by said ejection failure detecting means detects a nozzle with an ejection failure.

28. The droplet ejection apparatus according to claim 19, wherein:

the actuator of each of said droplet ejection heads has a diaphragm that can be displaced so as to change an internal pressure of said cavity; and said ejection failure detecting means detects residual vibration of said diaphragm and detects an ejection failure based on a vibration pattern of the detected residual vibration of said diaphragm.

29. The droplet ejection apparatus according to claim 28, wherein:

said actuator comprises an electrostatic actuator.

30. The droplet ejection apparatus according to claim 28, wherein:

said actuator comprises a piezoelectric actuator using a piezoelectric effect of a piezoelectric element.

31. The droplet ejection apparatus according to claim 28, wherein:

said ejection failure detecting means includes an oscillation circuit and said oscillation circuit oscillates based on an electric capacitance component of said actuator that varies with the residual vibration of said diaphragm.

32. The droplet ejection apparatus according to claim 31, wherein:

said oscillation circuit forms a CR oscillation circuit from the electric capacitance component of said actuator and a resistance component of a resistor element connected to said actuator.

33. The droplet ejection apparatus according to claim 31, wherein:

said ejection failure detecting means includes an F/V converting circuit that generates a voltage waveform of the residual vibration of said diaphragm from a predetermined signal group generated based on a change of an oscillation frequency in an output signal from said oscillation circuit.

34. The droplet ejection apparatus according to claim 33, wherein:

said ejection failure detecting means includes a waveform shaping circuit that shapes the voltage waveform of the residual vibration of said diaphragm generated in said F/V converting circuit into a predetermined waveform.

35. The droplet ejection apparatus according to claim 34, wherein said waveform shaping circuit includes:

DC component removing means for removing a direct current component from the voltage waveform of the residual vibration of said diaphragm generated in said F/V converting circuit; and a comparator that compares the voltage waveform, from which the direct current component has been removed by said DC component removing means, with a predetermined voltage value, said comparator generating and outputting a rectangular wave based on the voltage comparison.

36. The droplet ejection apparatus according to claim 35, wherein:

said ejection failure detecting means includes measuring means for measuring a cycle of the residual vibration of said diaphragm from said rectangular wave generated in said waveform shaping circuit.

37. The droplet ejection apparatus according to claim 36, wherein:

said measuring means has a counter, and measures at least one of a time between rising edges and a time between a rising edge and a falling edge of said rectangular wave by counting pulses of a reference signal with said counter.

38. The droplet ejection apparatus according to claim 28, wherein:

the vibration pattern of the residual vibration of said diaphragm includes a cycle of said residual vibration.

39. The droplet ejection apparatus according to claim 28, wherein:

said ejection failure detecting means includes judging means for judging at least one of a presence and an absence of an ejection failure of the droplets in said droplet ejection head based on the vibration pattern of the residual vibration of said diaphragm, and judging the cause of the ejection failure upon judging the presence of the ejection failure of the droplets in said droplet ejection head.

40. The droplet ejection apparatus according to claim 39, wherein:

said judging means judges that:

an air bubble has intruded inside said cavity when the cycle of the residual vibration of said diaphragm is shorter than a first predetermined period;

the liquid has thickened in the vicinity of said nozzle when the cycle of the residual vibration of said diaphragm is longer than a second predetermined period; and dust is adhering in the vicinity of the outlet of said nozzle when the cycle of the residual vibration of said diaphragm is longer than said first predetermined period and shorter than said second predetermined period.

41. The droplet ejection apparatus according to claim 19, wherein:

the actuator of each of said droplet ejection heads has a heating element that can film boil the liquid filled in said cavity;

each of said droplet ejection heads further includes a diaphragm that is displaced elastically in association with a change in internal pressure of said cavity, and an electrode provided opposite said diaphragm; and said ejection failure detecting means detects residual vibration of said diaphragm and detects an ejection failure based on a vibration pattern of the detected residual vibration of said diaphragm.

42. The droplet ejection apparatus according to claim 41, wherein:

said ejection failure detecting means includes an oscillation circuit, and said oscillation circuit oscillates based on a variance with time of an electric capacitance of a capacitor comprising said diaphragm and said electrode, associated with the residual vibration of said diaphragm.

43. The droplet ejection apparatus according to claim 42, wherein:

said oscillation circuit forms a CR oscillation circuit from an electric capacitance component of said capacitor and a resistance component of a resistor element.

44. The droplet ejection apparatus according to claim 42, wherein:

said ejection failure detecting means includes an F/V converting circuit that generates a voltage waveform of the residual vibration of said diaphragm from a predetermined signal group generated based on a change of an oscillation frequency in an output signal from said oscillation circuit.

45. The droplet ejection apparatus according to claim 44, wherein:

said ejection failure detecting means includes a waveform shaping circuit that shapes the voltage waveform of the residual vibration of said diaphragm generated in said F/V converting circuit into a predetermined waveform.

46. The droplet ejection apparatus according to claim 45, wherein: said waveform shaping circuit includes:

DC component removing means for removing a direct current component from the voltage waveform of the residual vibration of said diaphragm generated in said F/V converting circuit; and a comparator that compares the voltage waveform, from which the direct current component has been removed by said DC component removing means, with a predetermined voltage value, said comparator generating and outputting a rectangular wave based on the voltage comparison.

47. The droplet ejection apparatus according to claim 46, wherein:

said ejection failure detecting means includes measuring means for measuring a cycle of the residual vibration of said diaphragm from said rectangular wave generated in said waveform shaping circuit.

48. The droplet ejection apparatus according to claim 46, wherein:

said measuring means has a counter and measures at least on of a time between rising edges and a time between a rising edge and a falling edge of said rectangular wave by counting pulses of a reference signal with said counter.

49. A droplet ejection apparatus, provided with a plurality of droplet ejection heads each ejecting a liquid through a nozzle communicating with said-a_cavity in the form of droplets by changing an internal pressure of said cavity filled with the liquid by driving an actuator with a driving circuit, for ejecting the droplets through said nozzles while scanning said droplet ejection heads relatively with respect to a droplet receptor so that the droplets land on said droplet receptor, said apparatus comprising:

ejection failure detecting means for detecting an ejection failure of the droplets through said nozzles and a cause thereof;

recovery means for performing recovery processing for said droplet ejection heads to eliminate the cause of the ejection failure of the droplets; and storage means for storing a nozzle where the ejection failure is detected by said ejection failure detecting means, in connection with the cause thereof, wherein:

said recovery means includes flushing means for performing a flushing process by which the droplets are preliminarily ejected through said nozzles by driving said actuators; and if the presence of a failing nozzle in which an ejection failure is occurring is detected when detection by said ejection failure detecting means is performed for all of said nozzles, the flushing process is performed for said failing nozzle alone, after which detection by said ejection failure detecting means is performed again by forcing said failing nozzle alone to perform a droplet ejection operation, and when the presence of a re-failing nozzle in which the ejection failure has not been eliminated is detected, recovery processing depending on the cause of the ejection failure of said re-failing nozzle is performed by said recovery means at least for said re-failing nozzle, after which detection by said ejection failure detecting means is performed once again by forcing said re-failing nozzle alone to perform the droplet ejection operation.

50. The droplet ejection apparatus according to claim 49, wherein said recovery means further includes:

wiping means for performing a wiping process by which nozzle surfaces of said droplet ejection heads, where said nozzles are aligned, are wiped off by a wiper; and pumping means for performing a pump-suction process with the use of a pump connected to a cap covering the nozzle surfaces of said droplet ejection heads.

51. The droplet ejection apparatus according to claim 50, wherein:

the cause of an ejection failure detectable by said ejection failure detecting means includes:

intrusion of an air bubble inside said cavity;

thickening of the liquid in a vicinity of said nozzle; and adhesion of dust in a vicinity of an outlet of said nozzle; and said recovery means performs the pump-suction process by said pumping means if the cause of the ejection failure of said re-failing nozzle is at least one of the intrusion of an air bubble and the thickening of the liquid, and at least the wiping process by said wiper if the cause of the ejection failure of said re-failing nozzle is the adhesion of dust.

52. The droplet ejection apparatus according to claim 50, wherein:

said recovery means performs the flushing process for each of said nozzles after the recovery processing depending on the cause of the ejection failure is performed.

53. The droplet ejection apparatus according to claim 50, wherein:

said wiping means is adapted to perform the wiping process separately for plural sets of nozzle groups, so that when performing the wiping process depending on the cause of the ejection failure of said failing nozzle or said re-failing nozzle, said wiping means performs the wiping process only for a nozzle group including said failing nozzle or said re-failing nozzle.

54. The droplet ejection apparatus according to claim 50, wherein:

said pumping means is adapted to perform the pump-suction process separately for plural sets of nozzle groups, so that when performing the pump-suction process depending on the cause of the ejection failure of said failing nozzle or said re-failing nozzle, said pumping means performs the pump-suction process only for a nozzle group including said failing nozzle or said re-failing nozzle.

55. The droplet ejection apparatus according to claim 49, further comprising:

informing means for informing a detection result when a result of detection by said ejection failure detecting means detects a nozzle with an ejection failure.

56. The droplet ejection apparatus according to claim 49, wherein:

the actuator of each of said droplet ejection heads has a diaphragm that can be displaced so as to change an internal pressure of said cavity; and said ejection failure detecting means detects residual vibration of said diaphragm and detects an ejection failure based on a vibration pattern of the detected residual vibration of said diaphragm.

57. The droplet ejection apparatus according to claim 56, wherein:

said actuator comprises an electrostatic actuator.

58. The droplet ejection apparatus according to claim 56, wherein:

said actuator comprises a piezoelectric actuator using a piezoelectric effect of a piezoelectric element.

59. The droplet ejection apparatus according to claim 56, wherein:

said ejection failure detecting means includes an oscillation circuit and said oscillation circuit oscillates based on an electric capacitance component of said actuator that varies with the residual vibration of said diaphragm.

60. The droplet ejection apparatus according to claim 59, wherein:

said oscillation circuit forms a CR oscillation circuit from the electric capacitance component of said actuator and a resistance component of a resistor element connected to said actuator.

61. The droplet ejection apparatus according to claim 56, wherein:

the vibration pattern of the residual vibration of said diaphragm includes a cycle of said residual vibration.

62. The droplet ejection apparatus according to claim 56, wherein:

said ejection failure detecting means includes judging means for judging at least one of a presence and an absence of an ejection failure of the droplets in said droplet ejection head based on the vibration pattern of the residual vibration of said diaphragm, and judging the cause of the ejection failure upon judging the presence of the ejection failure of the droplets in said droplet ejection head.

63. The droplet ejection apparatus according to claim 62, wherein:

said judging means judges that:

an air bubble has intruded inside said cavity when the cycle of the residual vibration of said diaphragm is shorter than a first predetermined period;

the liquid has thickened in the vicinity of said nozzle when the cycle of the residual vibration of said diaphragm is longer than a second predetermined period; and dust is adhering in the vicinity of the outlet of said nozzle when the cycle of the residual vibration of said diaphragm is longer than said first predetermined period and shorter than said second predetermined period.

64. The droplet ejection apparatus according to claim 49, wherein:

the actuator of each of said droplet ejection heads has a heating element that can film boil the liquid filled in said cavity;

each of said droplet ejection heads further includes a diaphragm that is displaced elastically in association with a change in internal pressure of said cavity, and an electrode provided opposite said diaphragm; and said ejection failure detecting means detects residual vibration of said diaphragm and detects an ejection failure based on a vibration pattern of the detected residual vibration of said diaphragm.

65. The droplet ejection apparatus according to claim 64, wherein:

said ejection failure detecting means includes an oscillation circuit, and said oscillation circuit oscillates based on a variance with time of an electric capacitance of a capacitor comprising said diaphragm and said electrode, associated with the residual vibration of said diaphragm.

66. The droplet ejection apparatus according to claim 65, wherein:

said oscillation circuit forms a CR oscillation circuit from an electric capacitance component of said capacitor and a resistance component of a resistor element.

67. An ejection failure recovery method for a droplet ejection apparatus having a head unit including a plurality of droplet ejection heads each ejecting liquid within a cavity through a nozzle in the form of droplets by driving an actuator with a driving circuit, said method comprising:

displacing a diaphragm associated with each of said droplet ejection heads during driving of said actuator;

detecting an ejection failure of said droplet ejection heads and a cause thereof by detecting a residual vibration of said diaphragm and determining an ejection failure of said droplets based on a vibration pattern of the detected residual vibration of said diaphragm, said vibration pattern of the residual vibration of said diaphragm including a cycle of the residual vibration;

judging at least one of a presence and an absence of an ejection failure of the droplets in the corresponding droplet ejection head based on the vibration pattern of the residual vibration of said diaphragm and judging the cause of the ejection failure upon judging the presence of the ejection failure of the droplets in said droplet ejection head; and performing recovery processing depending on the cause of the ejection failure in a case where the ejection failure is detected;

wherein said judging means idles that;

an air bubble has intruded inside said cavity when the cycle of the residual vibration of said diaphragm is shorter than a predetermined first period;

the liquid has thickened in the vicinity of said nozzle when the cycle of the residual vibration of said diaphragm is longer than a predetermined second period; and dust is adhering in the vicinity of the outlet of said nozzle when the cycle of the residual vibration of said diaphragm is longer than said first period and shorter than said second period.

68. A droplet ejection apparatus having a head unit including a plurality of droplet ejection heads each ejecting liquid within a cavity through a nozzle in the form of droplets by driving an actuator by way of a driving circuit, said apparatus comprising:

an ejection failure detector which detects an ejection failure of said droplet ejection heads and a cause thereof; and a recovery device which performs recovery processing depending on the cause of the ejection failure if said ejection failure detector detects the ejection failure;

wherein each of said droplet ejection heads includes a diaphragm that is displaced when the actuator is driven and said ejection failure detector detects a residual vibration of said diaphragm and determines an ejection failure of said droplets based on a vibration pattern of the detected residual vibration of said diaphragm;

wherein said ejection failure detector includes judging means for judging at least one of a presence and an absence of an ejection failure of the droplets in the corresponding droplet ejection head based on the vibration pattern of the residual vibration of said diaphragm, and judging the cause of the ejection failure upon judging the presence of the ejection failure of the droplets in said droplet ejection head, said vibration pattern of the residual vibration of said diaphragm including a cycle of the residual vibration; and wherein said judging means judges that:

an air bubble has intruded inside said cavity when the cycle of the residual vibration of said diaphragm is shorter than a predetermined first period;

the liquid has thickened in the vicinity of said nozzle when the cycle of the residual vibration of said diaphragm is longer than a predetermined second period; and dust is adhering in the vicinity of the outlet of said nozzle when the cycle of the residual vibration of said diaphragm is longer than said first period and shorter than said second period.

69. A droplet ejection apparatus, provided with a plurality of droplet ejection heads each ejecting a liquid through a nozzle communicating with a cavity in the form of droplets by changing an internal pressure of said cavity filled with the liquid by driving an actuator with a driving circuit, for ejecting the droplets through said nozzles while scanning said droplet ejection heads relatively with respect to a droplet receptor so that the droplets land on said droplet receptor, said apparatus comprising:

an ejection failure detector which detects an ejection failure of the droplets through said nozzles and a cause thereof;

a recovery device which performs recovery processing for said droplet ejection heads to eliminate the cause of the ejection failure of the droplets; and a storage device which stores a nozzle where the ejection failure is detected by said ejection failure detector, in connection with the cause thereof, wherein if detection by said ejection failure detector is performed for all of said nozzles and the presence of a failing nozzle in which an ejection failure is occurring is detected, recovery processing depending on the cause of the ejection failure is performed by said recovery device at least for said failing nozzle, after which detection by said ejection failure detector is performed again by forcing said failing nozzle alone to perform a droplet ejection operation.

70. A droplet ejection apparatus, provided with a plurality of droplet ejection heads each ejecting a liquid through a nozzle communicating with a cavity in the form of droplets by changing an internal pressure of said cavity filled with the liquid by driving an actuator with a driving circuit, for ejecting the droplets through said nozzles while scanning said droplet ejection heads relatively with respect to a droplet receptor so that the droplets land on said droplet receptor, said apparatus comprising:

an ejection failure detector which detects an ejection failure of the droplets through said nozzles and a cause thereof;

a recovery device for performing recovery processing for said droplet ejection heads to eliminate the cause of the ejection failure of the droplets; and a storage device which stores a nozzle where the ejection failure is detected by said ejection failure detector, in connection with the cause thereof, wherein:

said recovery device includes a flusher for performing a flushing process by which the droplets are preliminarily ejected through said nozzles by driving said actuators; and if the presence of a failing nozzle in which an ejection failure is occurring is detected when detection by said ejection failure detector is performed for all of said nozzles, the flushing process is performed for said failing nozzle alone, after which detection by said ejection failure detector is performed again by forcing said failing nozzle alone to perform a droplet ejection operation, and when the presence of a re-failing nozzle in which the ejection failure has not been eliminated is detected, recovery processing depending on the cause of the ejection failure of said re-failing nozzle is performed by said recovery device at least for said re-failing nozzle, after which detection by said ejection failure detector is performed once again by forcing said re-failing nozzle alone to perform the droplet ejection operation.

* * * * *

UNITED STATES PATENT AND TRADEMARK OFFICE

CERTIFICATE OF CORRECTION

PATENT NO. : 7,150,513 B2
APPLICATION NO. : 10/789819
DATED : December 19, 2006
INVENTOR(S) : Osamu Shinkawa et al.

It is certified that error appears in the above-identified patent and that said Letters Patent is hereby corrected as shown below:

Col. 25, line 19: “go” should be -- $g_o$ --

Col. 26, line 5: “dV/dt=. Is/C1,” should be -- dV/dt=Is/C1, --

Col. 26, line 33: “go” should be -- $g_o$ --

Col. 51, line 61: “1 B” should be -- 1B --

Col. 66, line 25: after “wherein:” start new paragraph with “said”

Col. 66, line 51: “said-a_cavity” should be -- a cavity --

Col. 69, line 52: “idles that;” should be -- judges that: --

Signed and Sealed this

Sixth Day of January, 2009

JON W. DUDAS
*Director of the United States Patent and Trademark Office*